US012478184B2

(12) United States Patent
Yoo et al.

(10) Patent No.: US 12,478,184 B2
(45) Date of Patent: Nov. 25, 2025

(54) CABINET DEVICE

(71) Applicant: LG ELECTRONICS INC., Seoul (KR)

(72) Inventors: Daehyun Yoo, Seoul (KR); Geonwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 82 days.

(21) Appl. No.: 18/578,954

(22) PCT Filed: Jun. 14, 2022

(86) PCT No.: PCT/KR2022/008371
§ 371 (c)(1),
(2) Date: Jan. 12, 2024

(87) PCT Pub. No.: WO2023/287027
PCT Pub. Date: Jan. 19, 2023

(65) Prior Publication Data

US 2024/0324776 A1 Oct. 3, 2024

(30) Foreign Application Priority Data

Jul. 15, 2021 (KR) ..... 10-2021-0092814
Jul. 15, 2021 (KR) ..... 10-2021-0093005

(51) Int. Cl.

| | |
|---|---|
| ***A47B 96/00*** | (2006.01) |
| ***A47B 96/20*** | (2006.01) |
| ***F25D 23/02*** | (2006.01) |
| *A47L 15/42* | (2006.01) |

(52) U.S. Cl.
CPC ..... *A47B 96/205* (2013.01); *F25D 23/028* (2013.01); *A47L 15/4257* (2013.01)

(58) Field of Classification Search
None
See application file for complete search history.

(56) References Cited

U.S. PATENT DOCUMENTS

| | | | | |
|---|---|---|---|---|
| 8,789,900 | B2 | 7/2014 | Laible et al. | |
| 11,047,613 | B1 | 6/2021 | Park et al. | |
| 2011/0304251 | A1* | 12/2011 | Bernett | A47B 17/00 312/348.4 |
| 2017/0282349 | A1* | 10/2017 | Zhao | A47B 81/00 |

(Continued)

FOREIGN PATENT DOCUMENTS

| | | | |
|---|---|---|---|
| CN | 208042601 | 11/2018 | |
| EP | 3722713 A1 * | 10/2020 | F25D 23/067 |

(Continued)

OTHER PUBLICATIONS

International Search Report dated Sep. 28, 2022 issued in Application No. PCT/KR2022/008371.

*Primary Examiner* — Steven M Marsh
(74) *Attorney, Agent, or Firm* — KED & ASSOCIATES, LLP

(57) ABSTRACT

A cabinet device is proposed. The cabinet device has an upper surface assembly of which an upper surface is separately provided from an outer casing, and the bottom of the upper surface assembly is coupled to an upper surface of an inner casing. Therefore, the appearance design of the cabinet device is freely and easily changed in response to a user's need.

19 Claims, 35 Drawing Sheets

(56) References Cited

U.S. PATENT DOCUMENTS

| | | | | |
|---|---|---|---|---|
| 2019/0289734 | A1* | 9/2019 | Foote | A47B 96/021 |
| 2020/0326119 | A1 | 10/2020 | Lee et al. | |
| 2022/0288810 | A1* | 9/2022 | Healey | B32B 21/02 |
| 2023/0248149 | A1* | 8/2023 | Soyk | E06B 5/006 49/501 |

FOREIGN PATENT DOCUMENTS

| | | | | |
|---|---|---|---|---|
| JP | 2018-122024 | | 8/2018 | |
| KR | 10-2007-0003397 | | 1/2007 | |
| KR | 10-2011-0042786 | | 4/2011 | |
| KR | 10-2013-0135485 | | 12/2013 | |
| KR | 10-2014-0102808 | | 8/2014 | |
| KR | 10-2019-0106175 | | 9/2019 | |
| KR | 10-2147123 | | 8/2020 | |
| WO | WO-2021141154 | A1 * | 7/2021 | F25D 29/005 |

* cited by examiner

[Fig. 1]
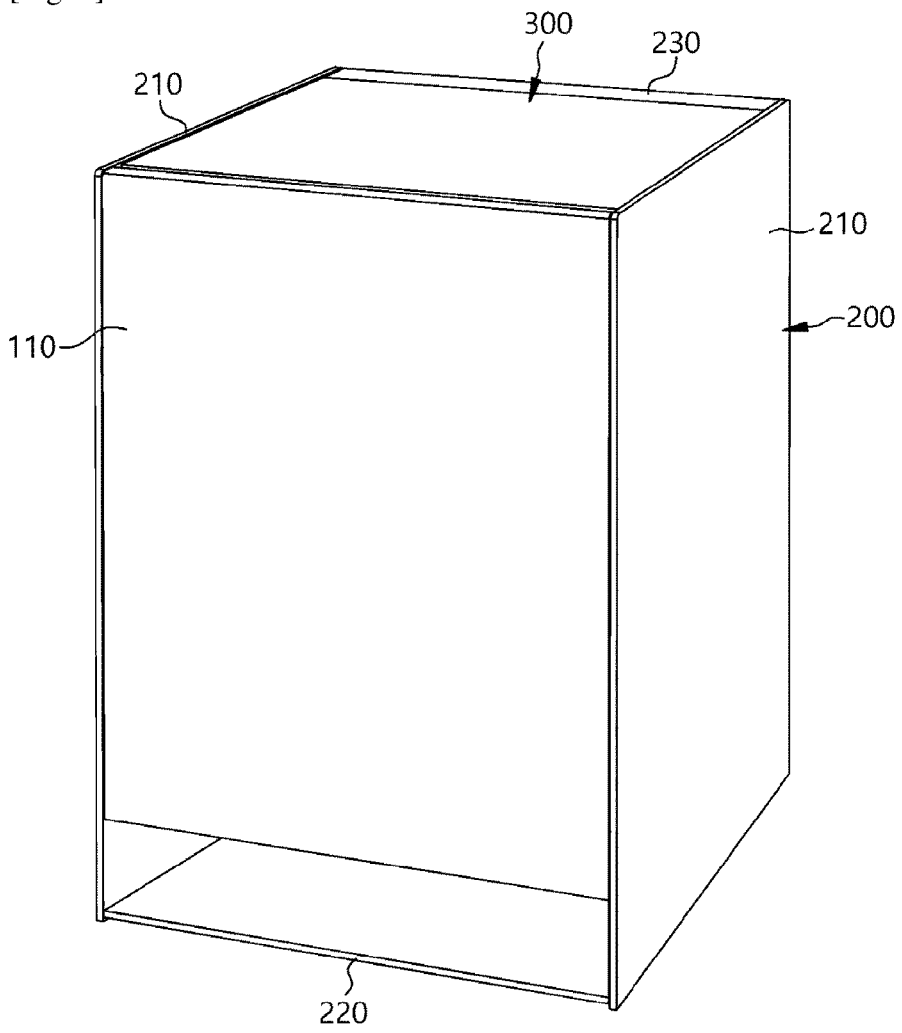

[Fig. 2]
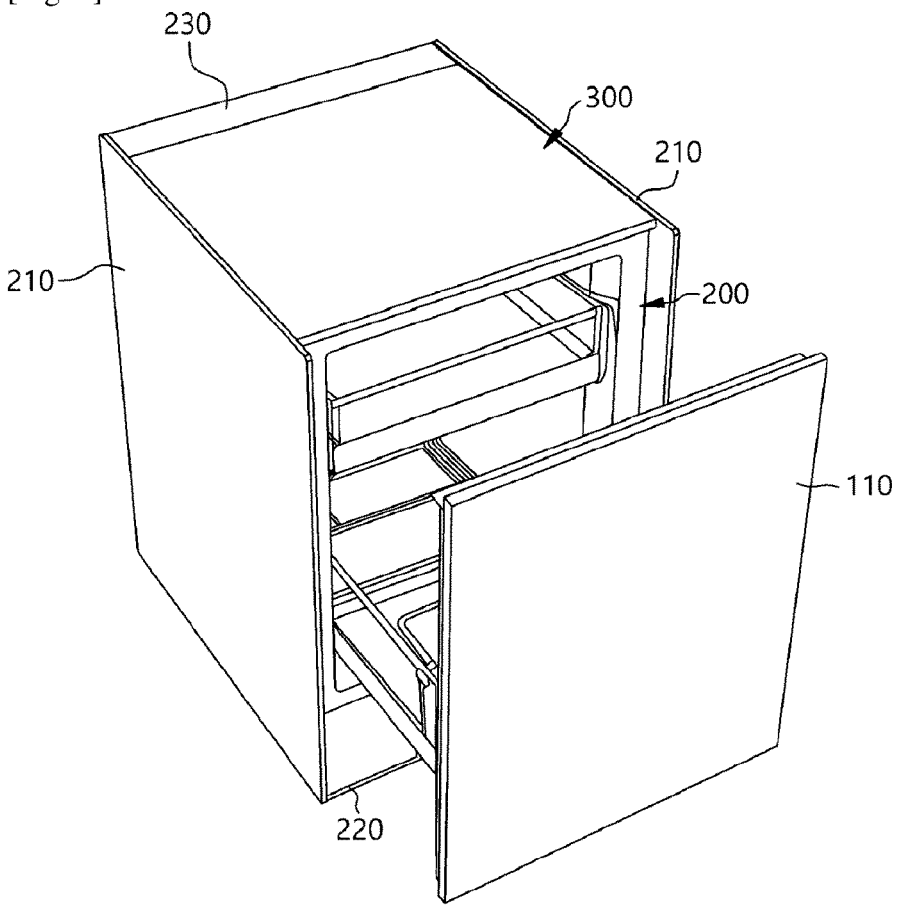

[Fig. 3]
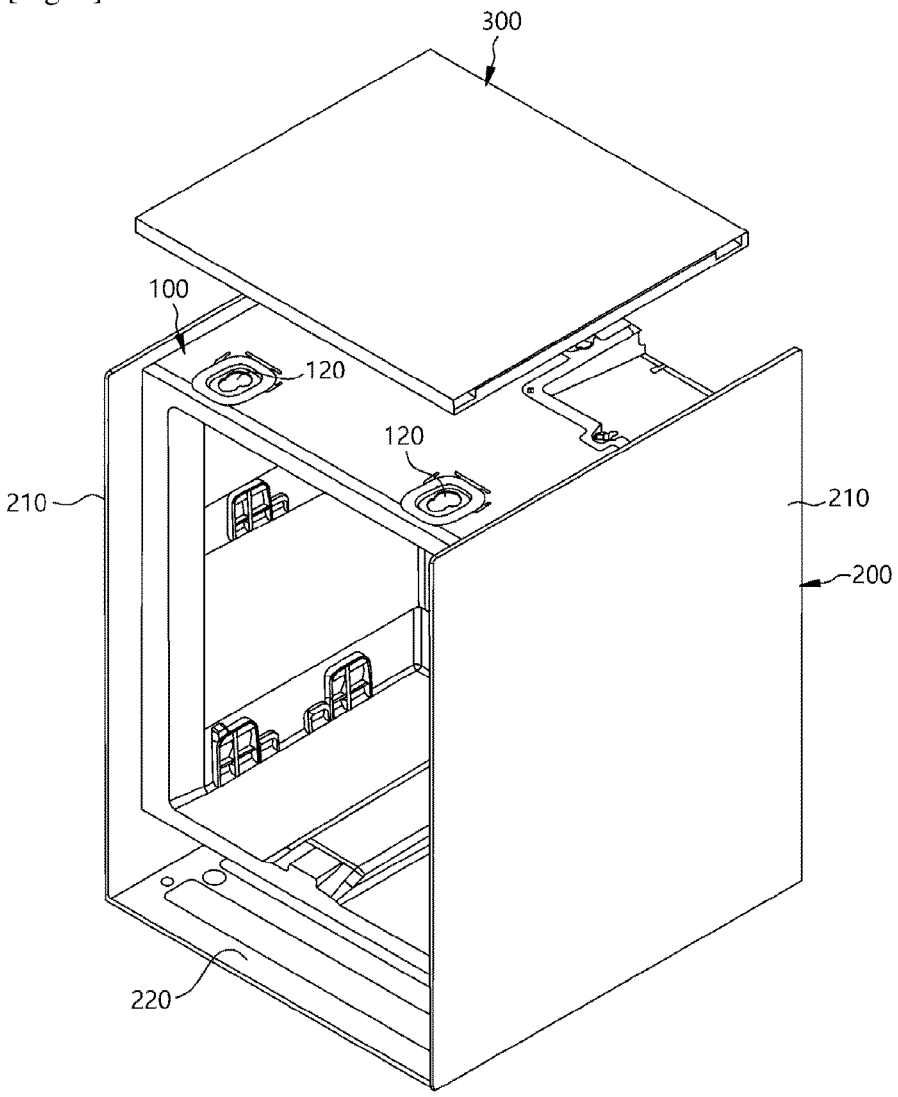

[Fig. 4]
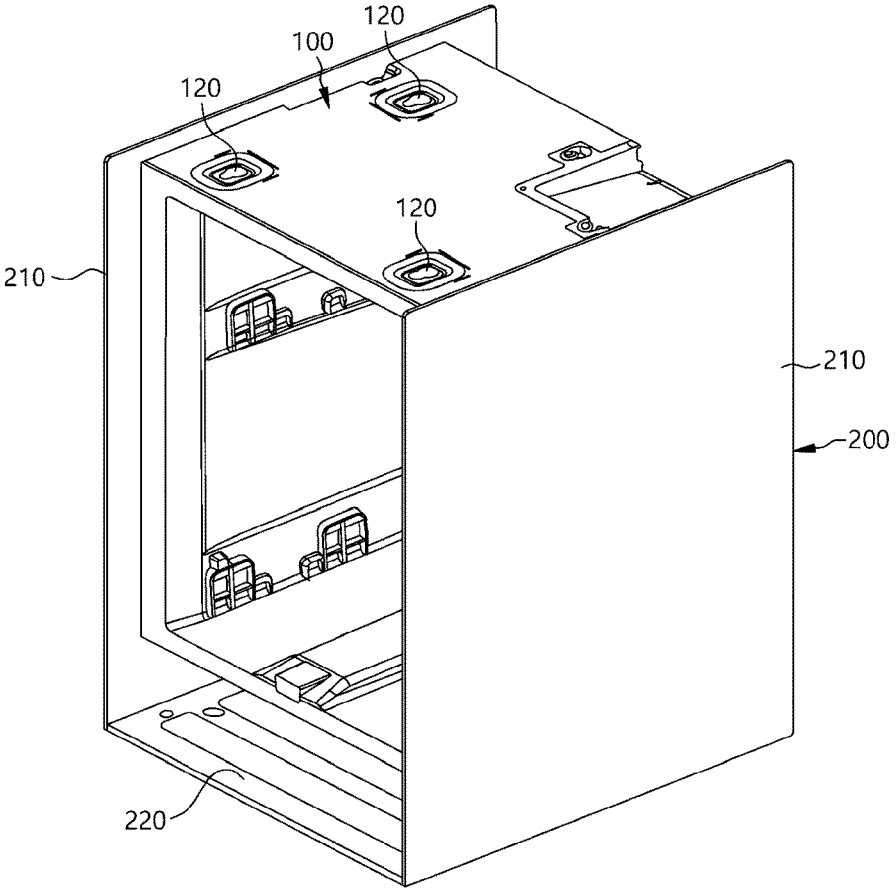
[Fig. 5]
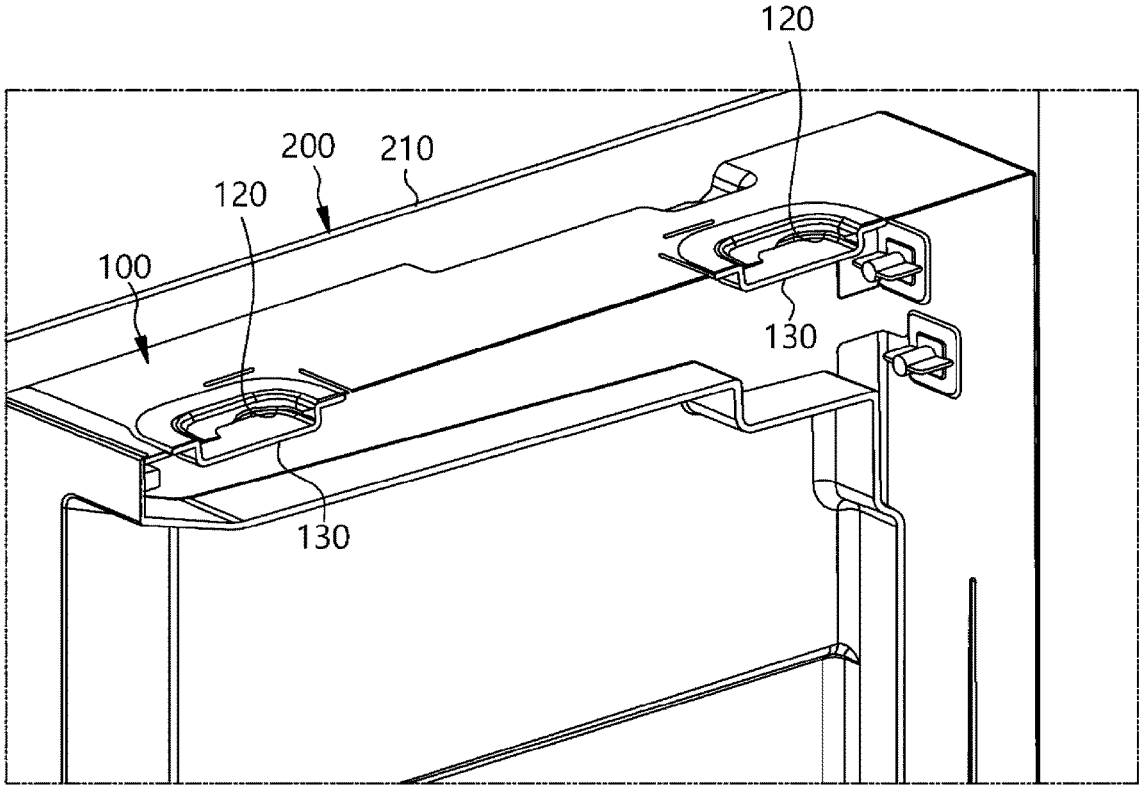

[Fig. 6]
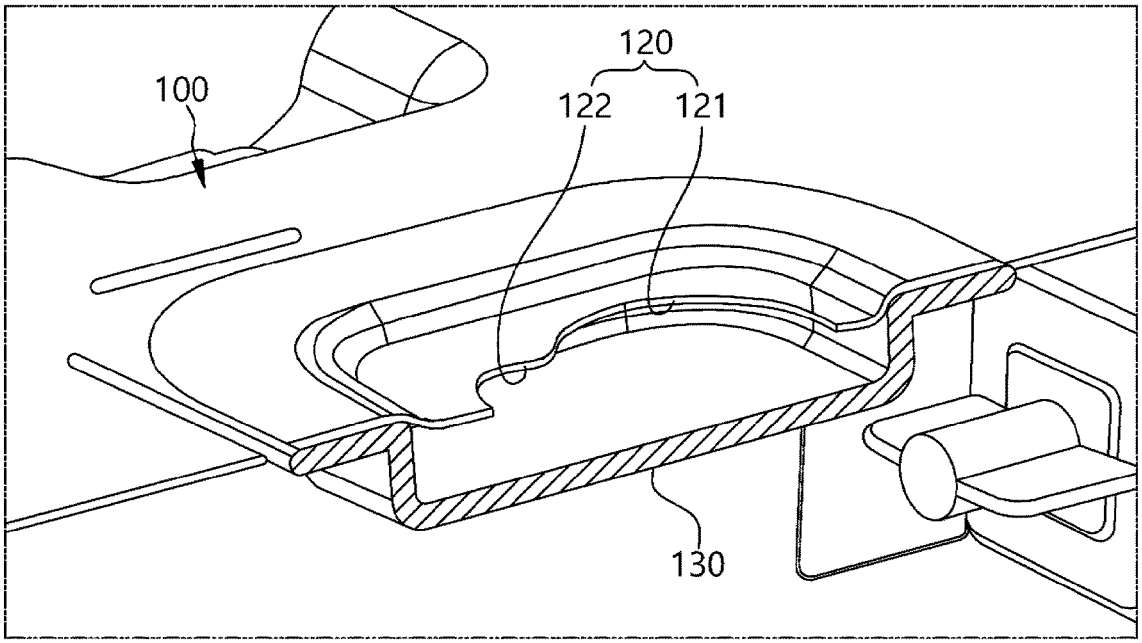
[Fig. 7]
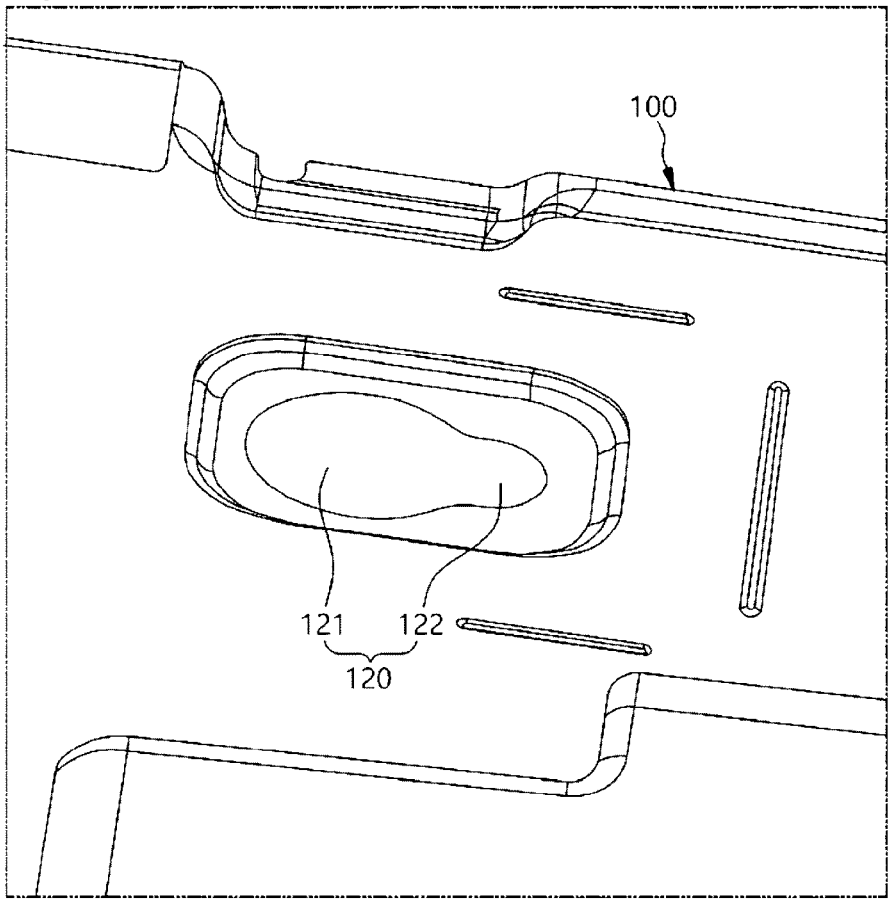

[Fig. 8]
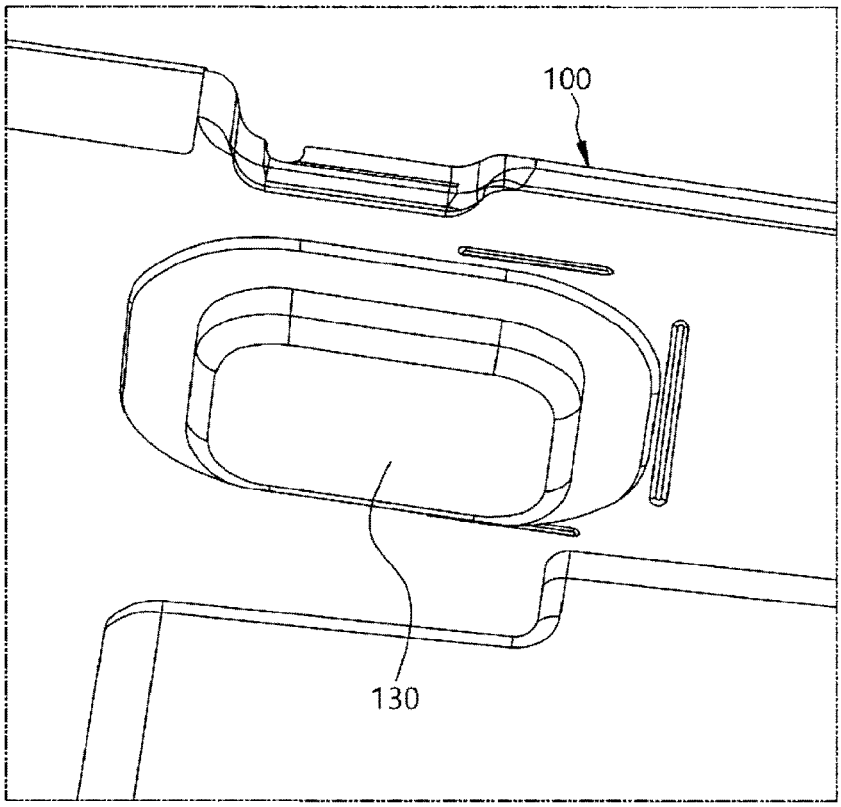
[Fig. 9]
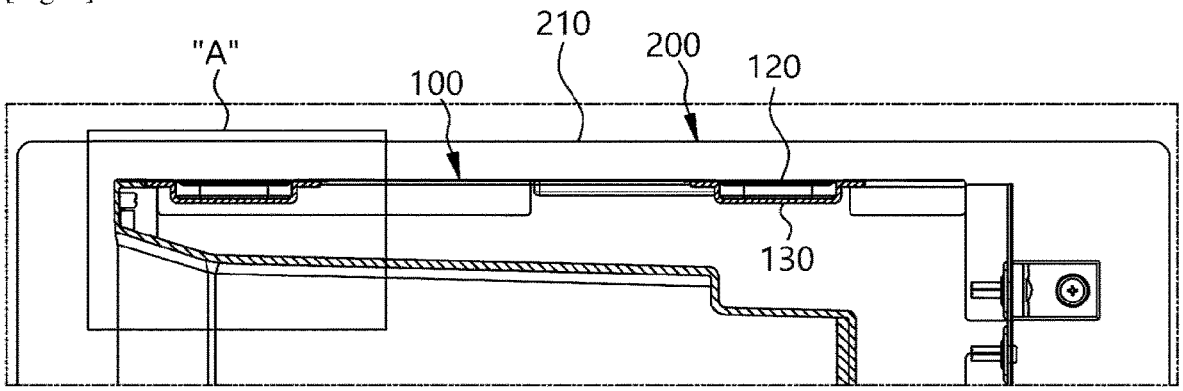

[Fig. 10]
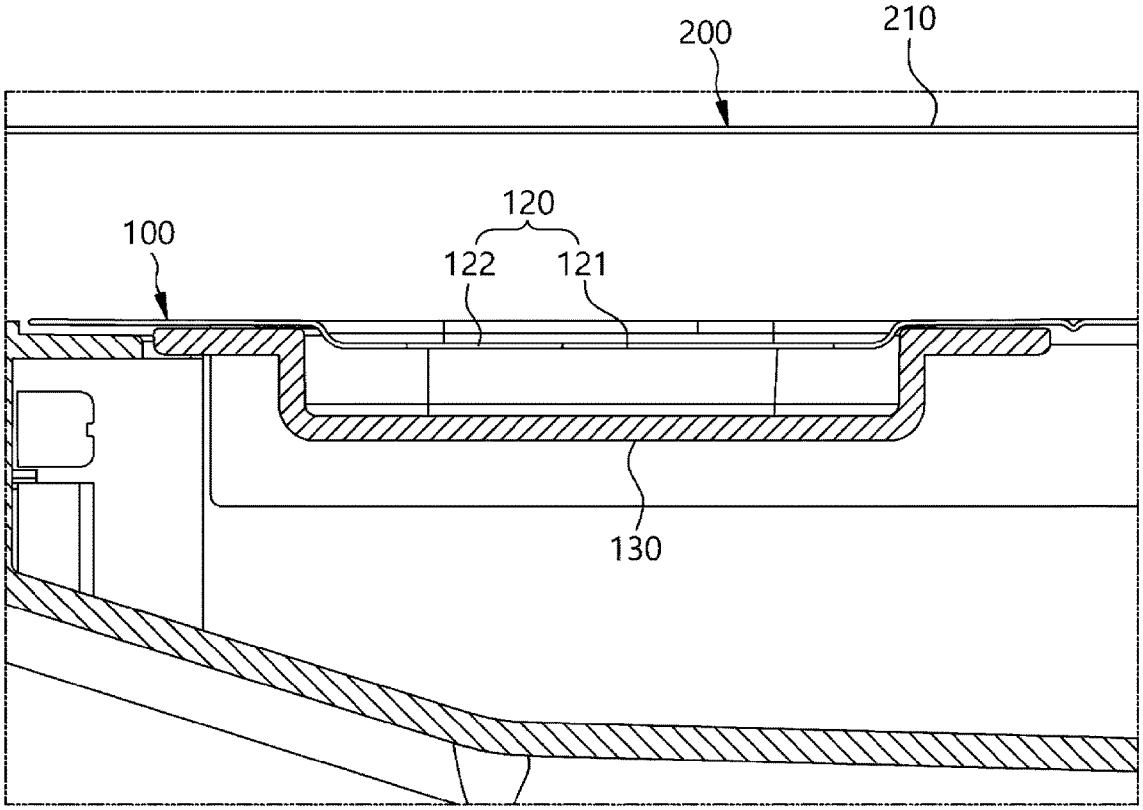

[Fig. 11]
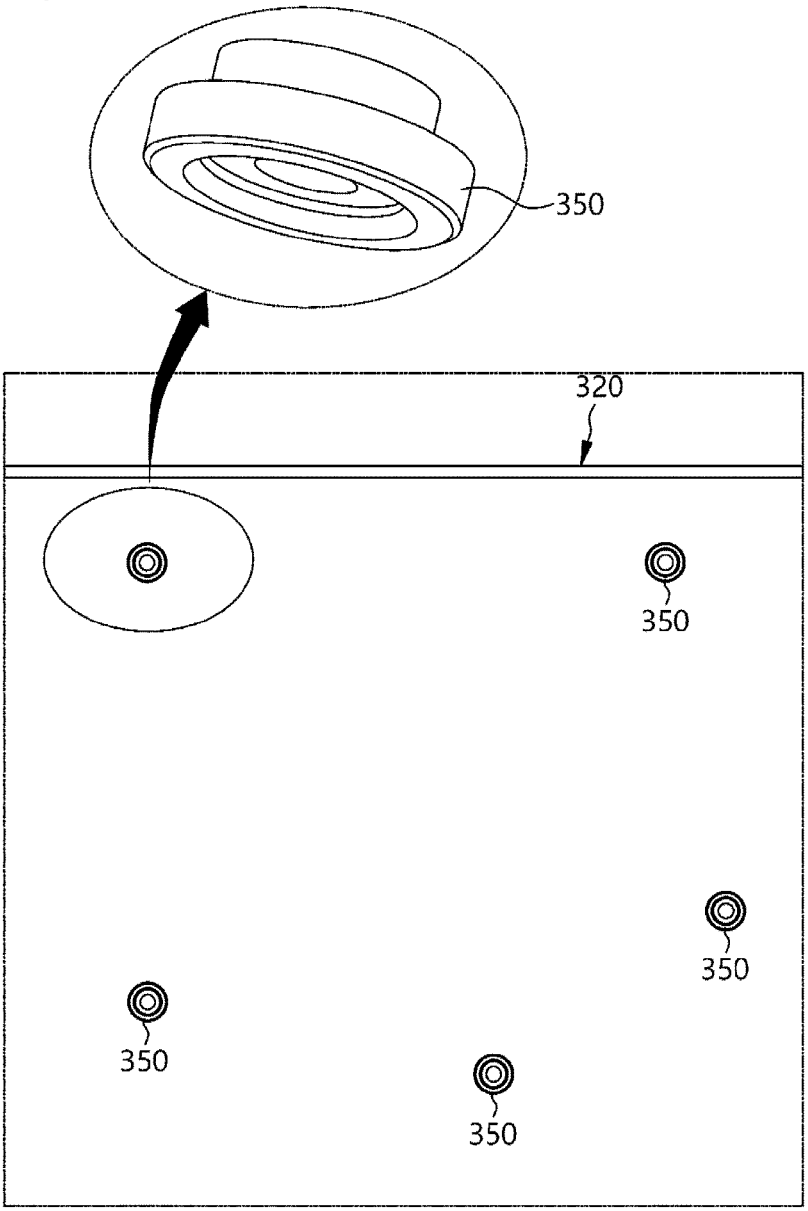

[Fig. 12]
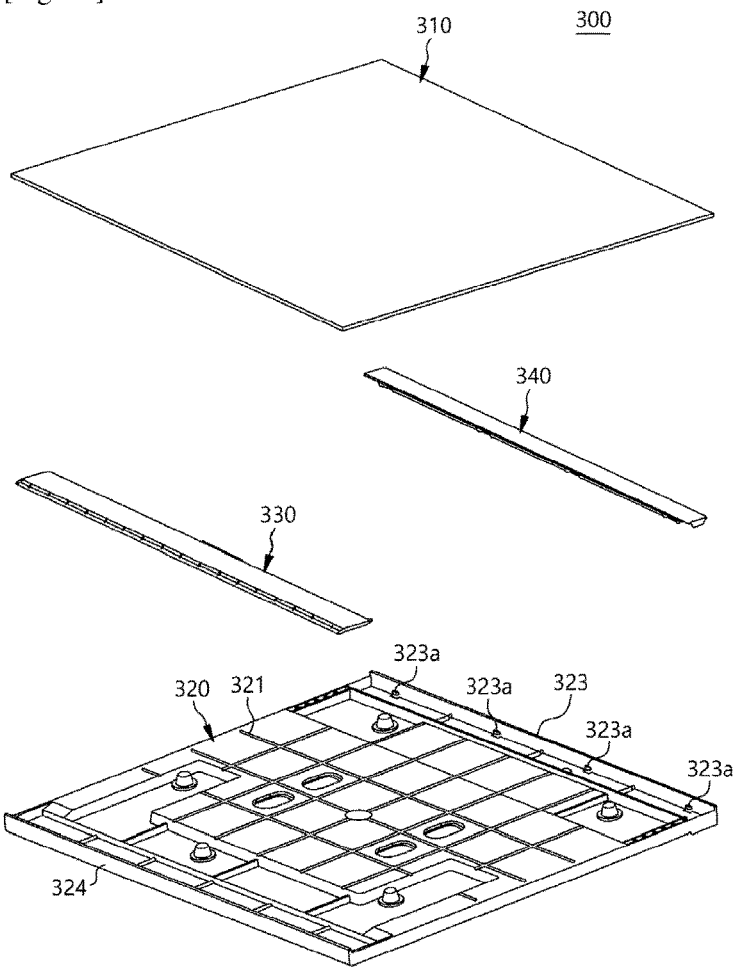
[Fig. 13]
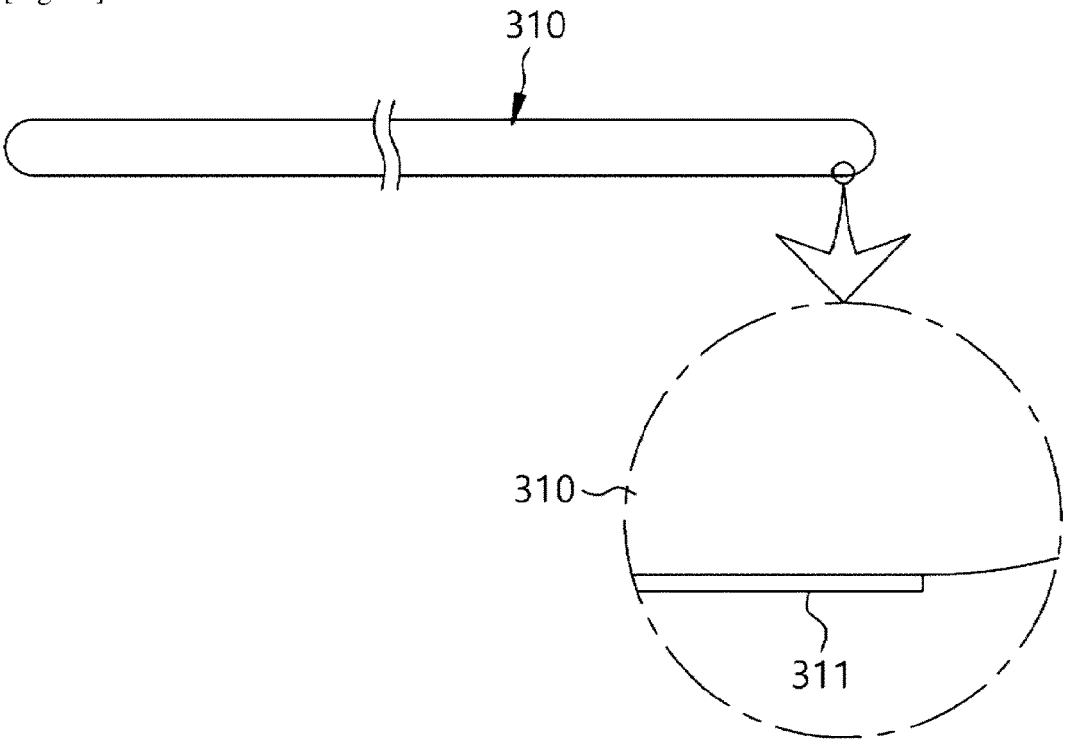

[Fig. 14]
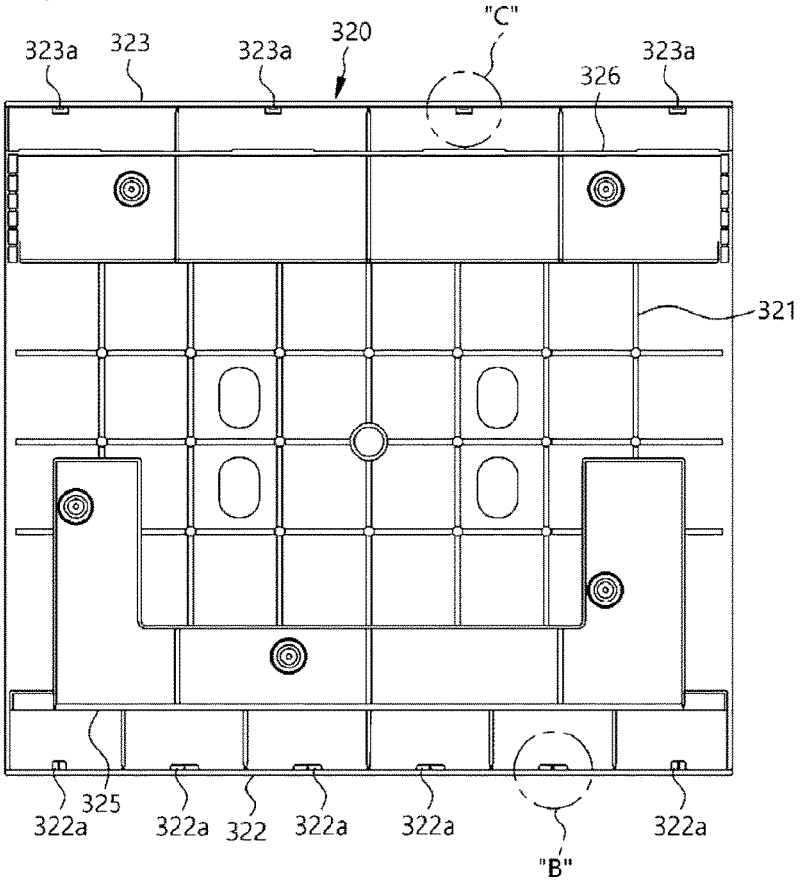
[Fig. 15]
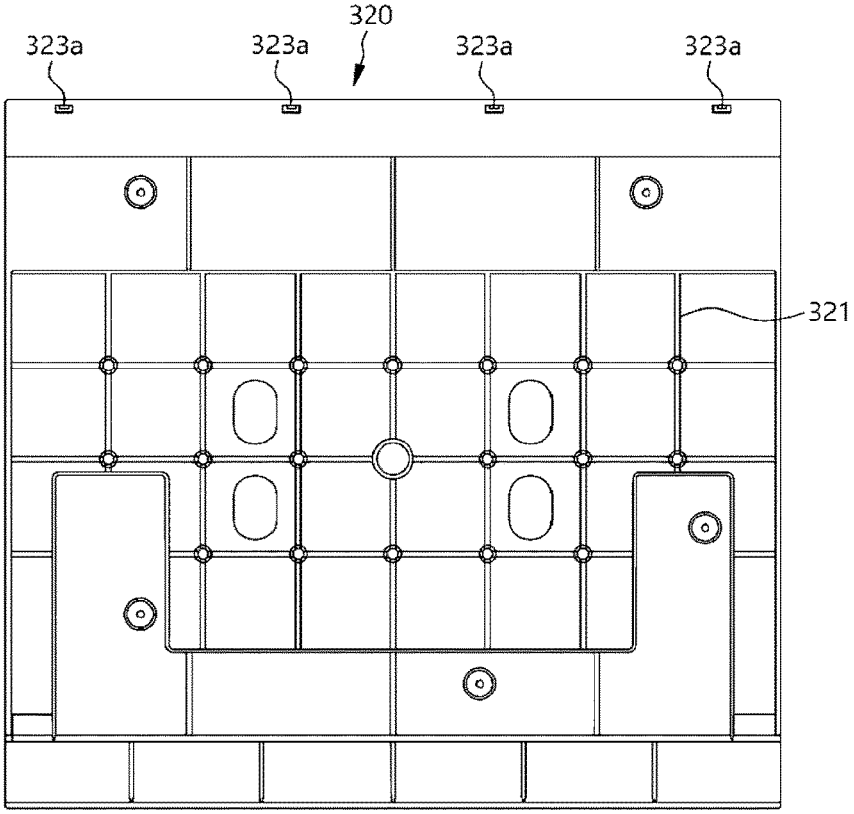

[Fig. 16]
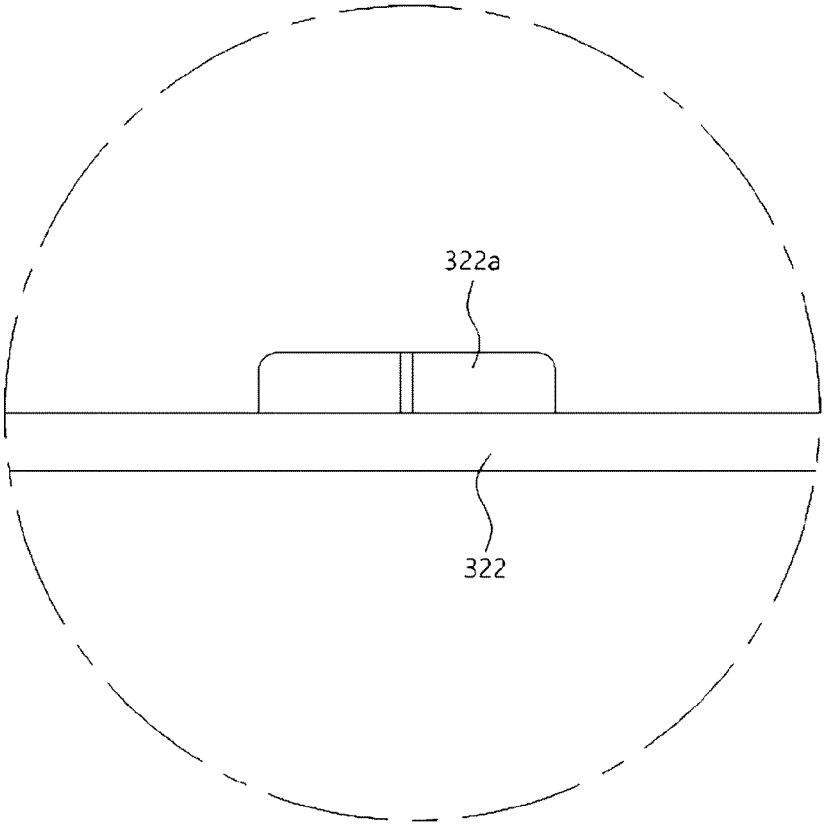
[Fig. 17]
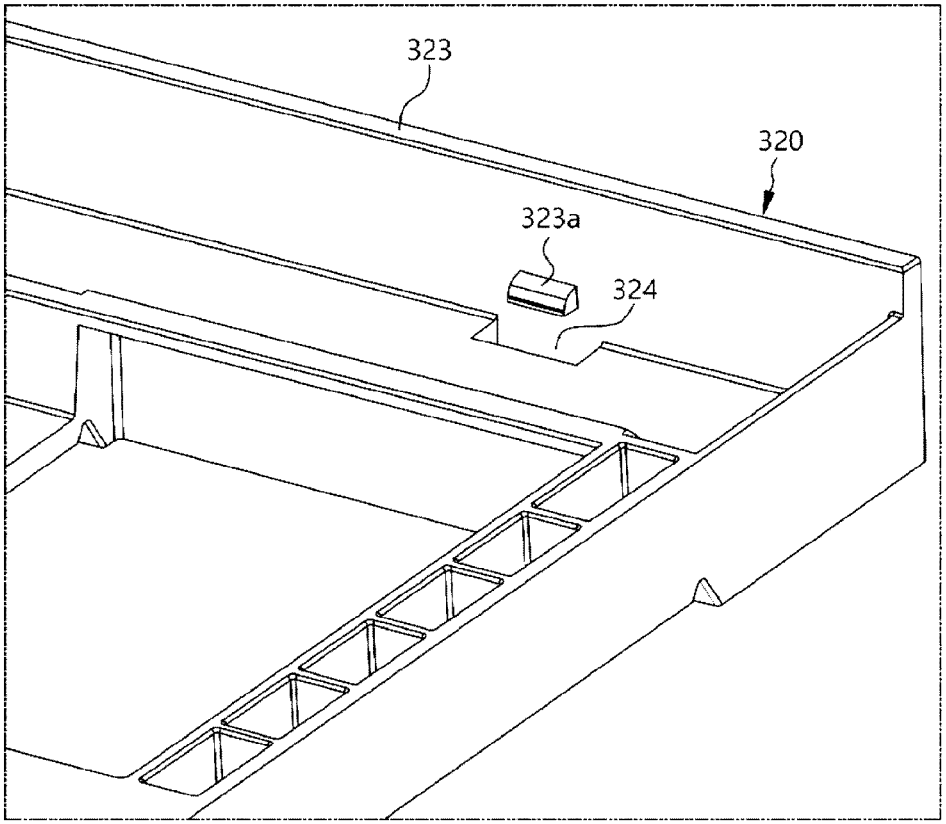

[Fig. 18]
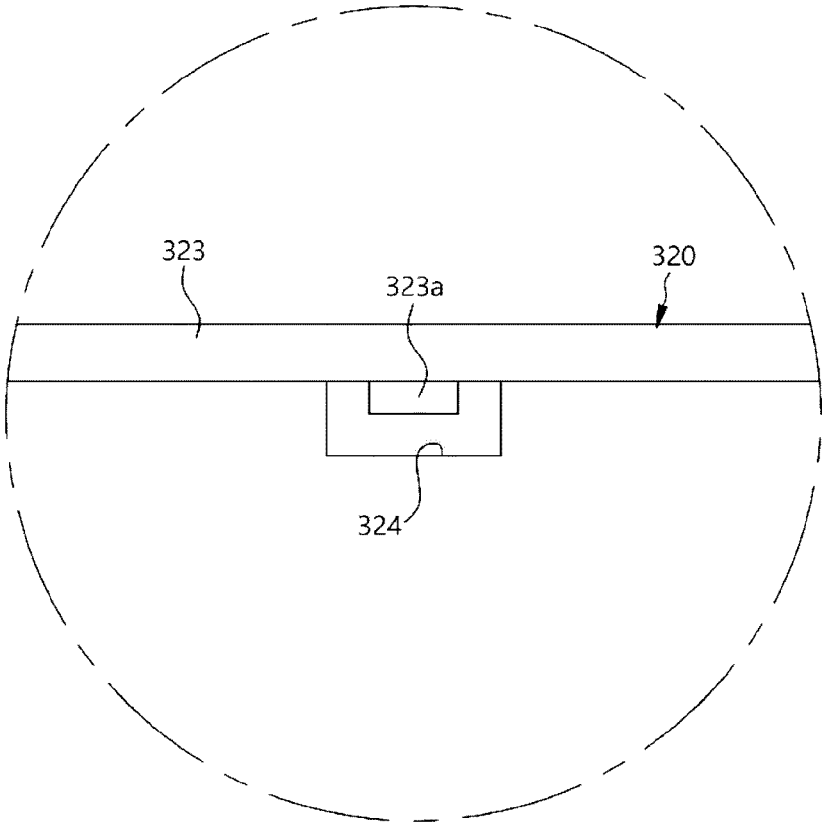
[Fig. 19]
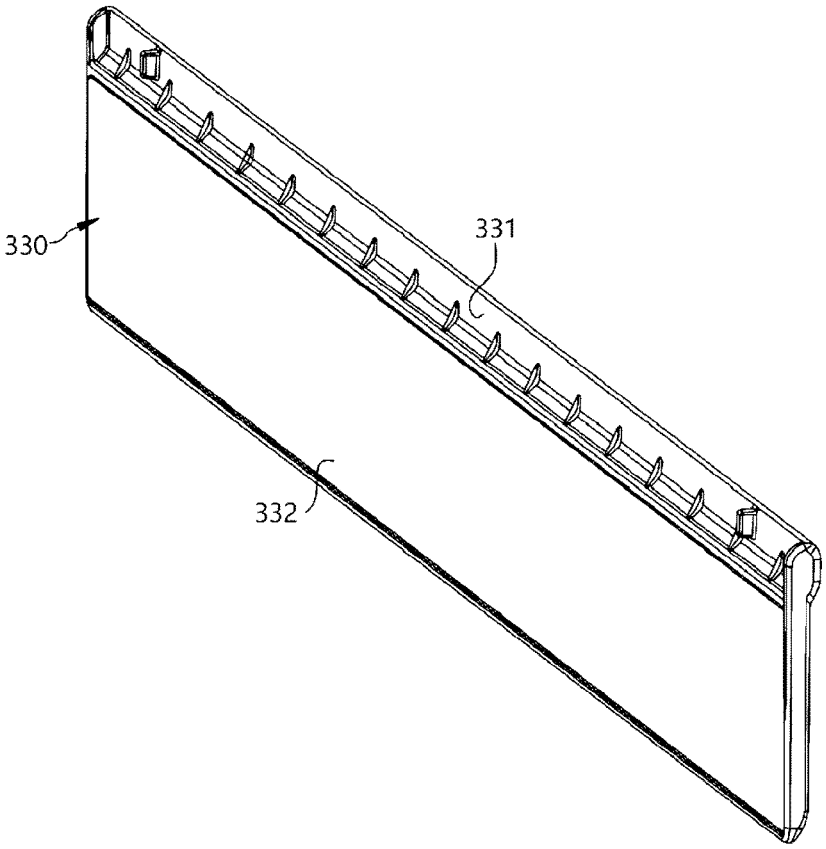

[Fig. 20]
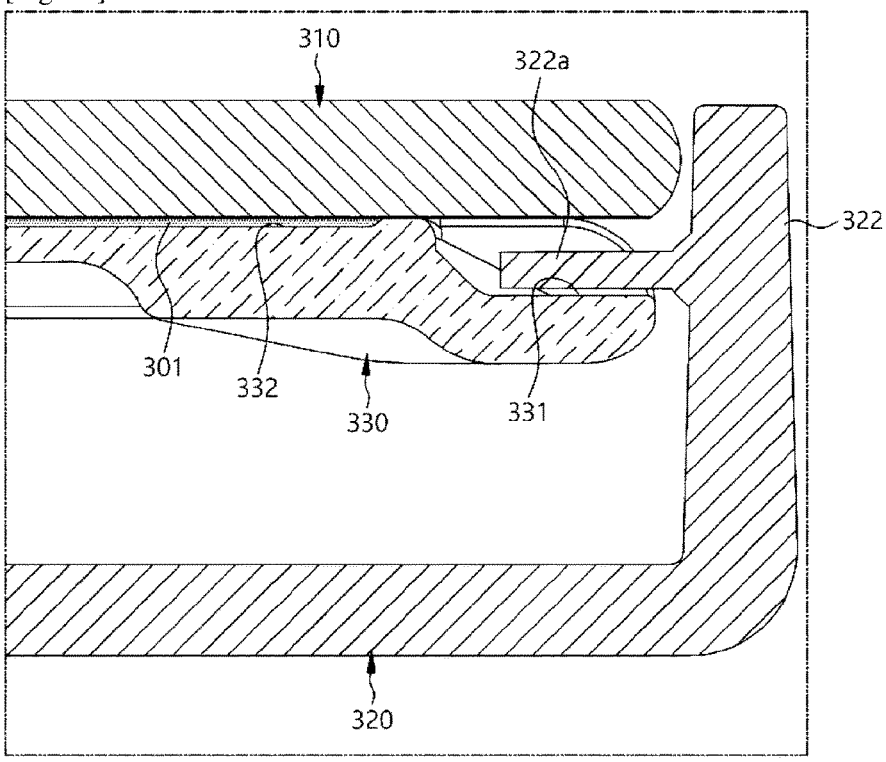
[Fig. 21]
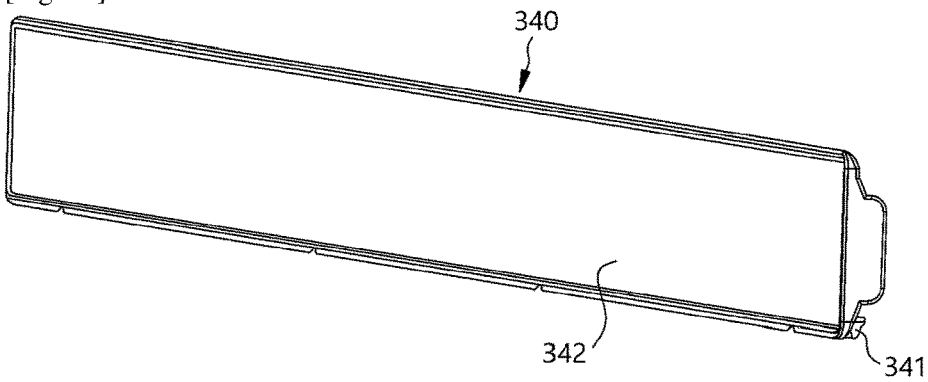
[Fig. 22]
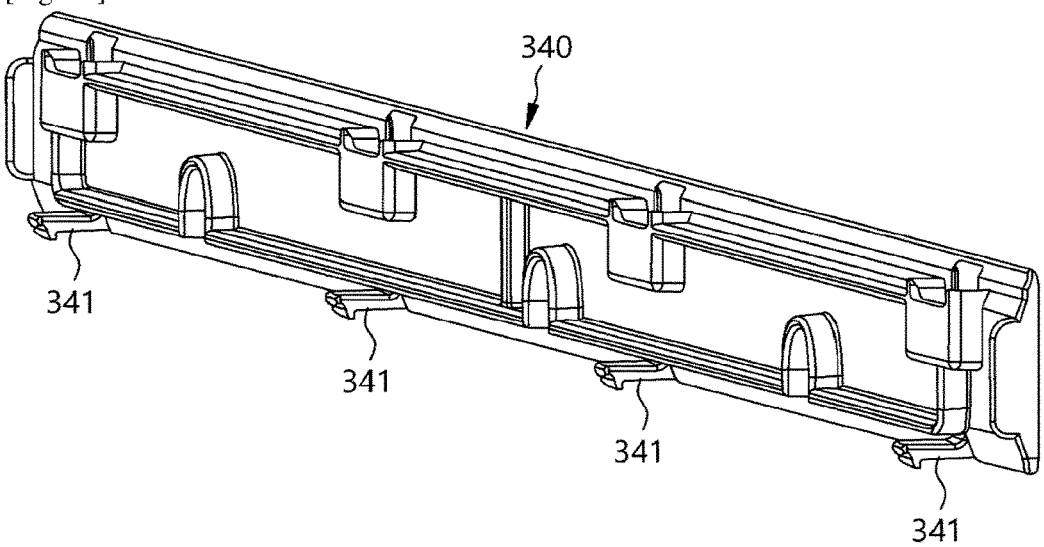

[Fig. 23]
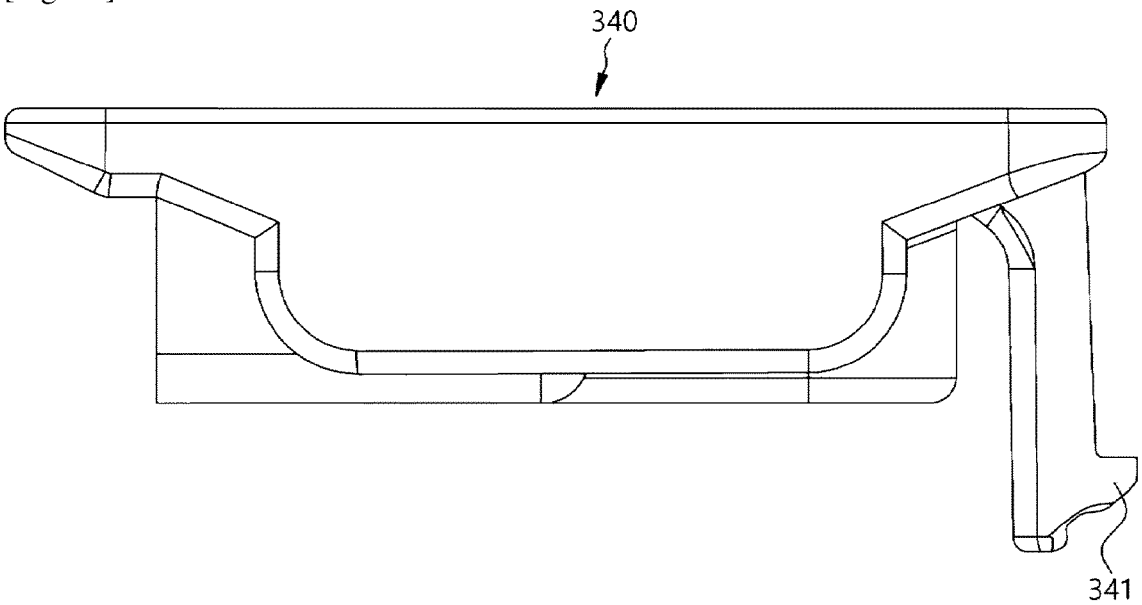
[Fig. 24]
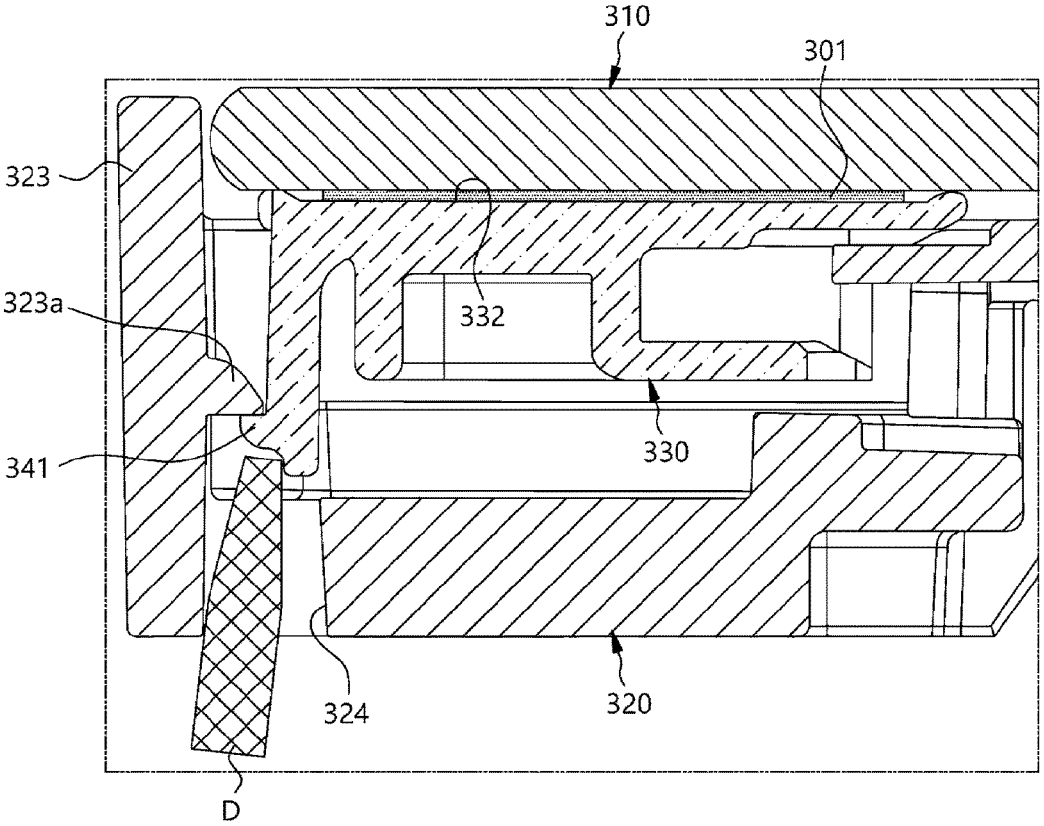

[Fig. 25]
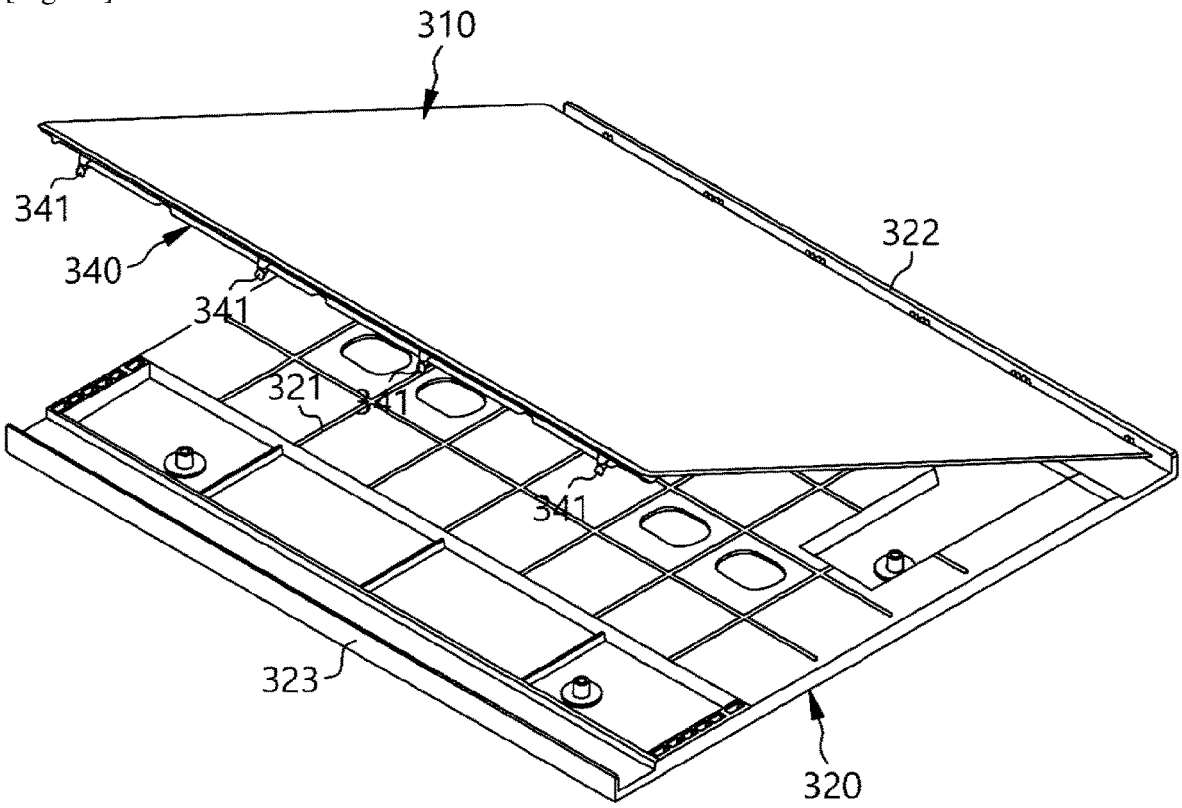
[Fig. 26]
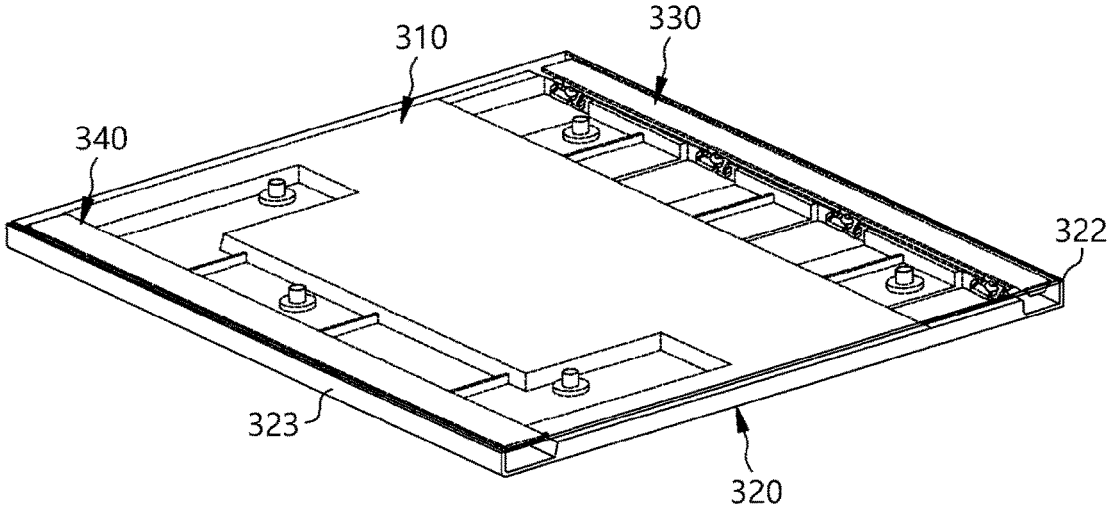

[Fig. 27]
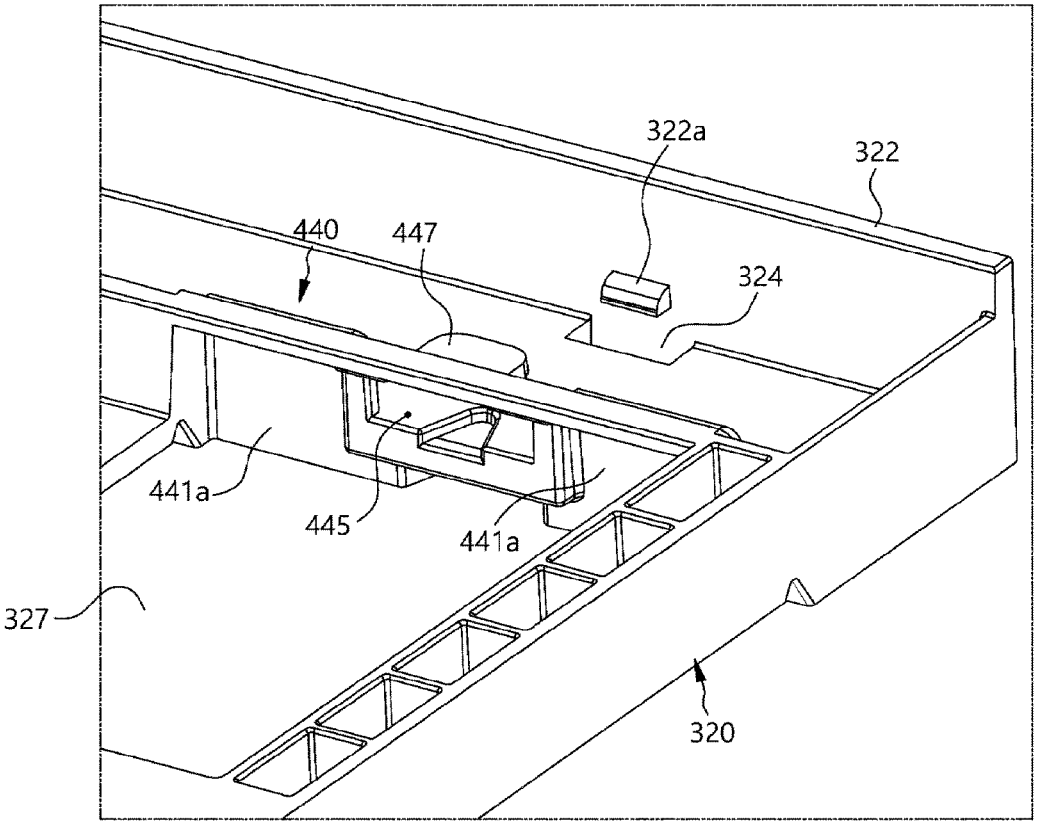
[Fig. 28]
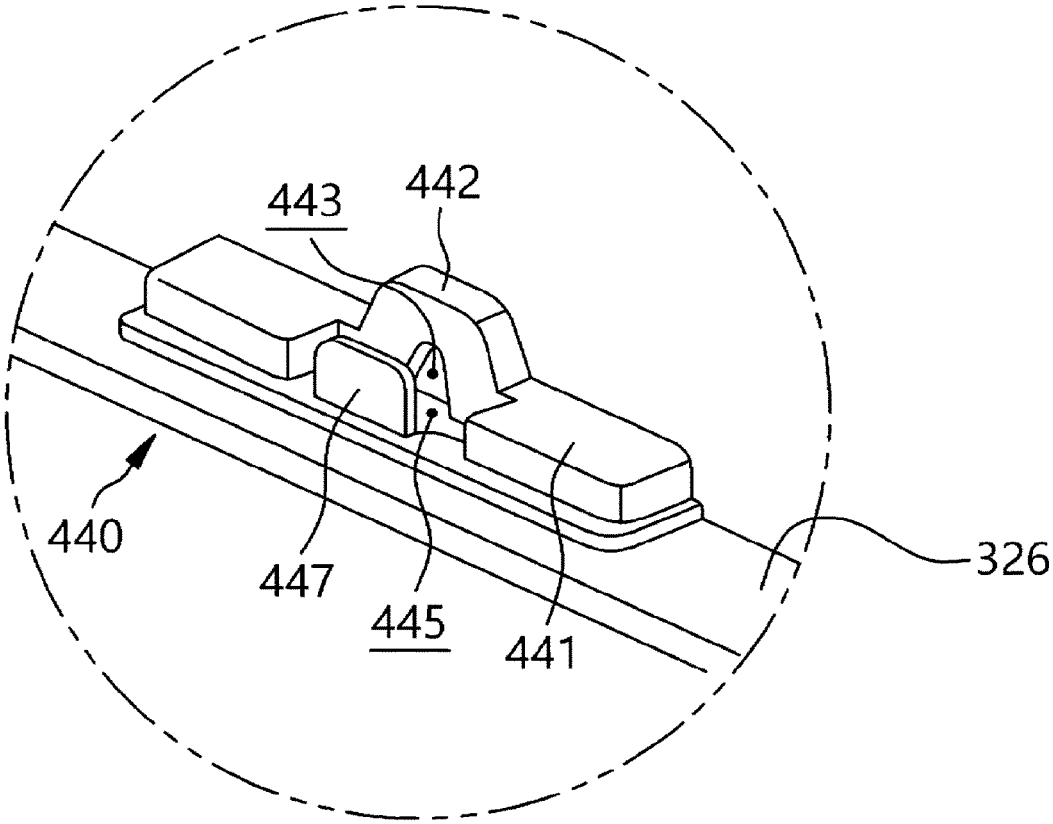

[Fig. 29]
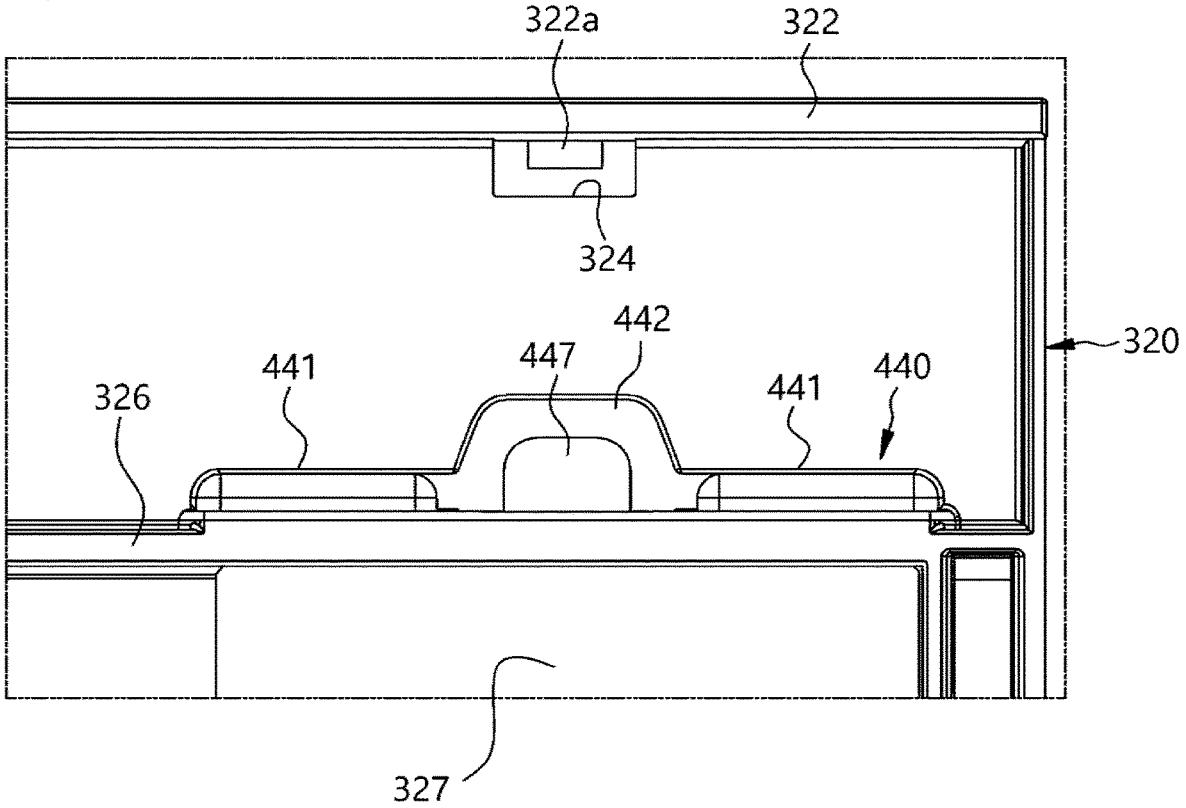
[Fig. 30]
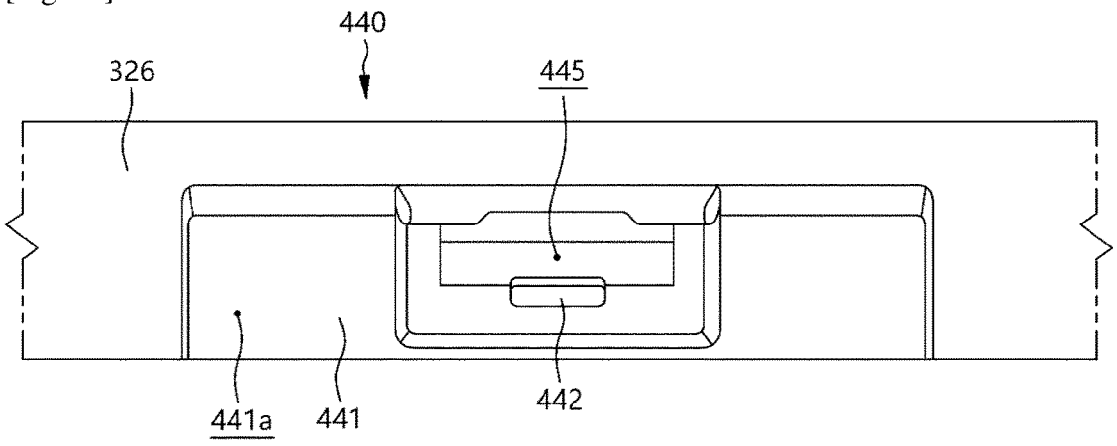

[Fig. 31]
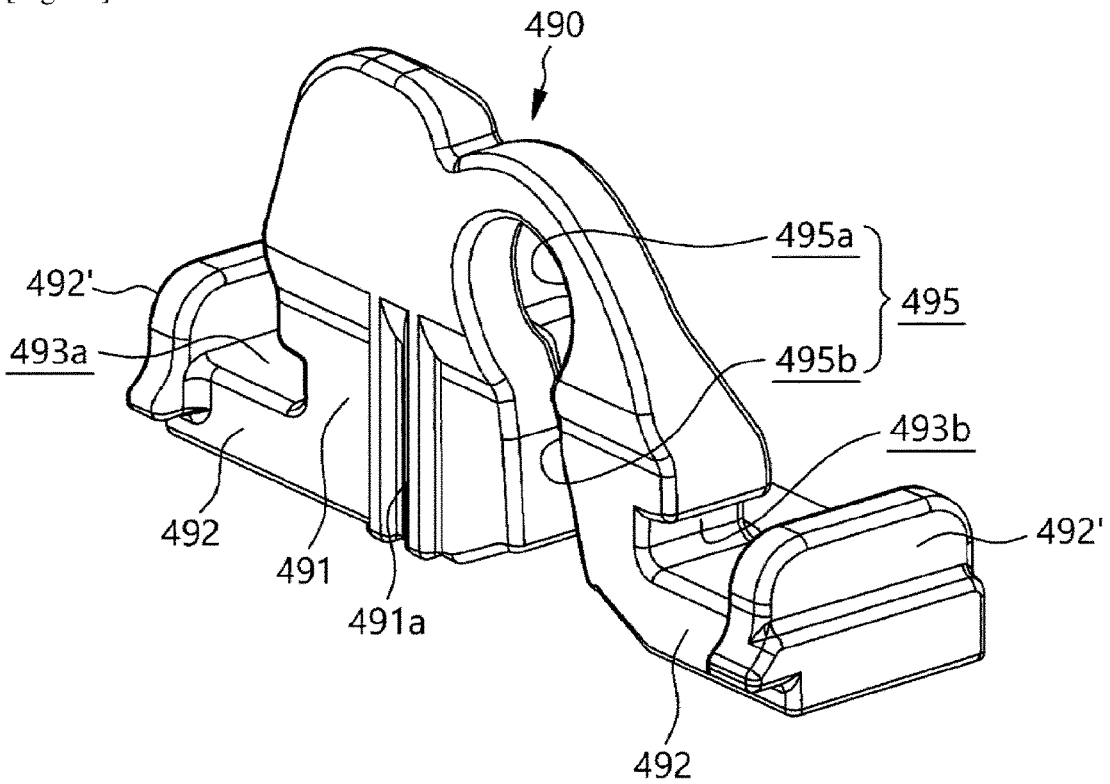
[Fig. 32]
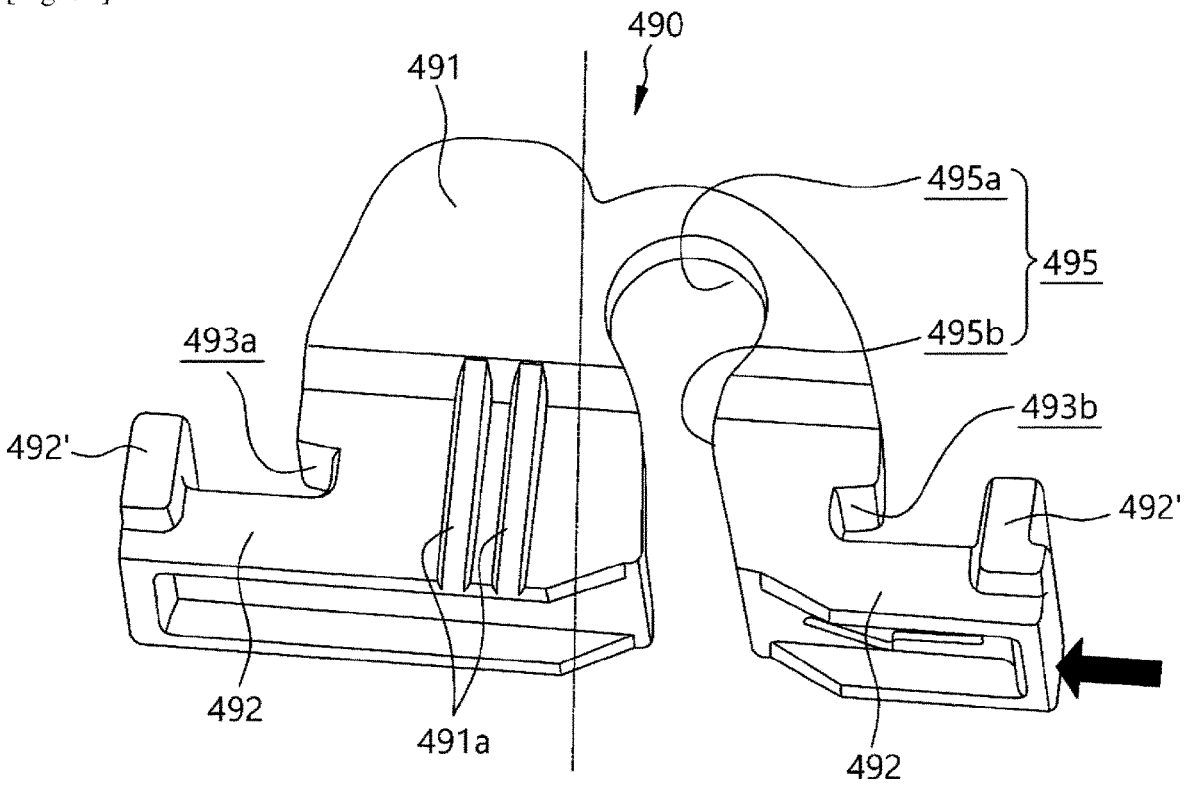

[Fig. 33]
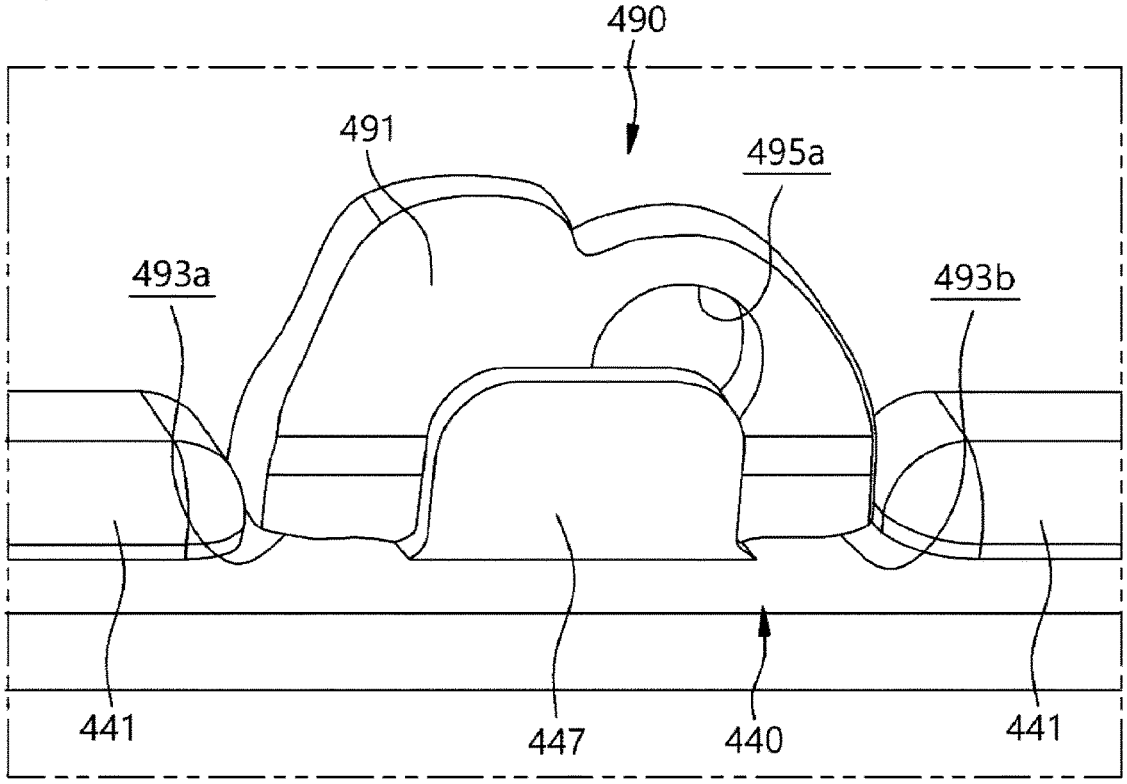
[Fig. 34]
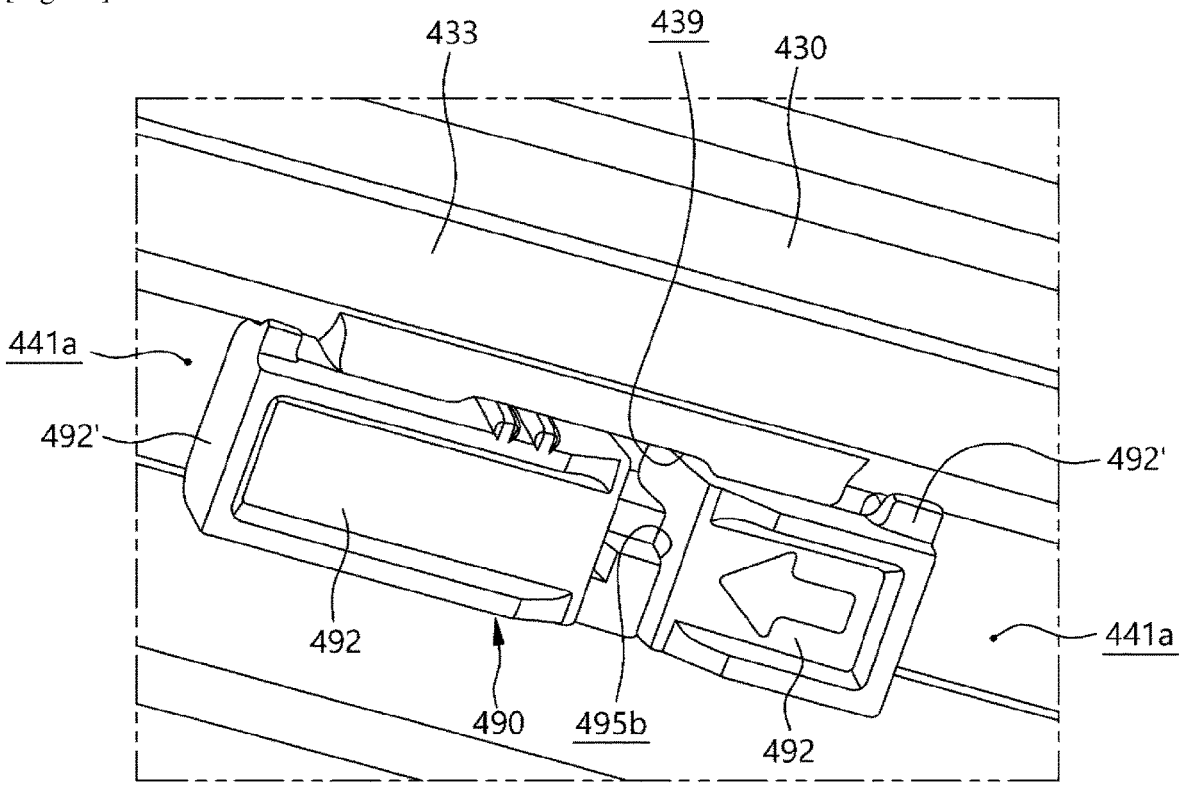

[Fig. 35]
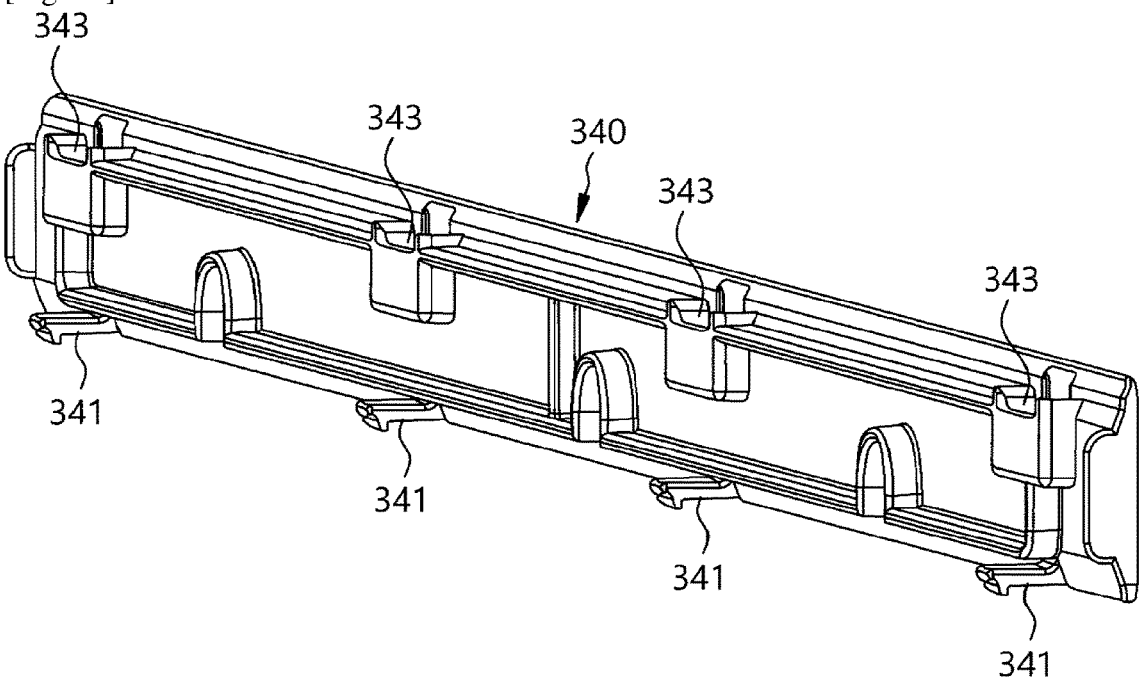
[Fig. 36]
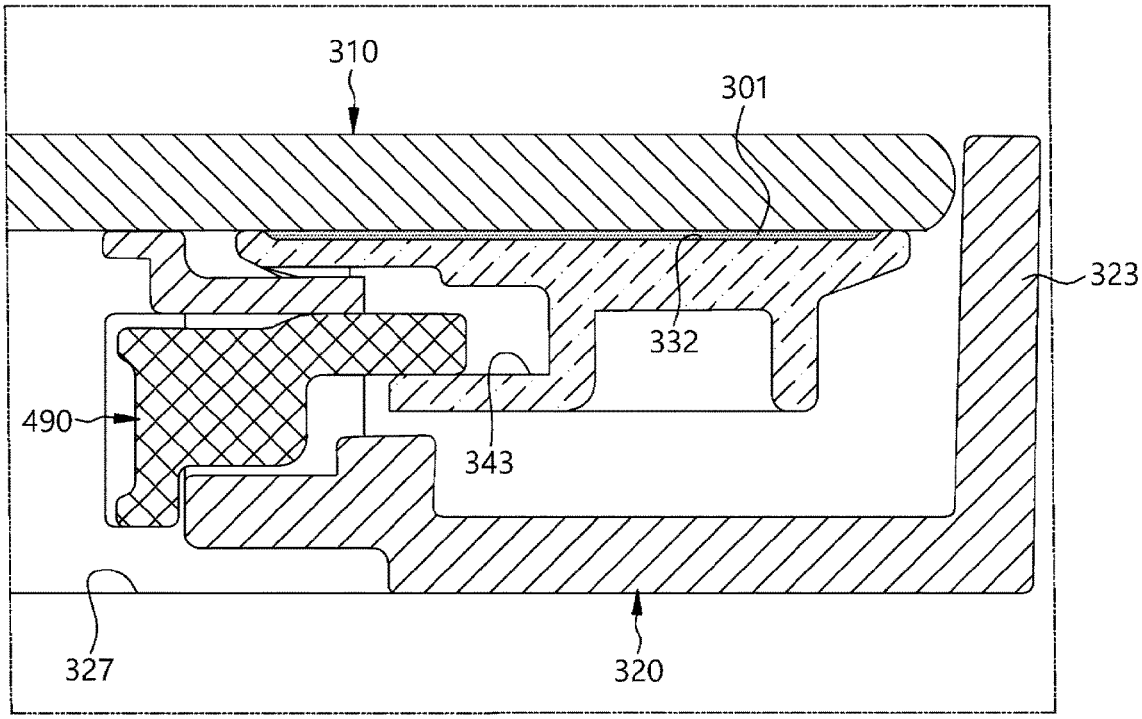

[Fig. 37]
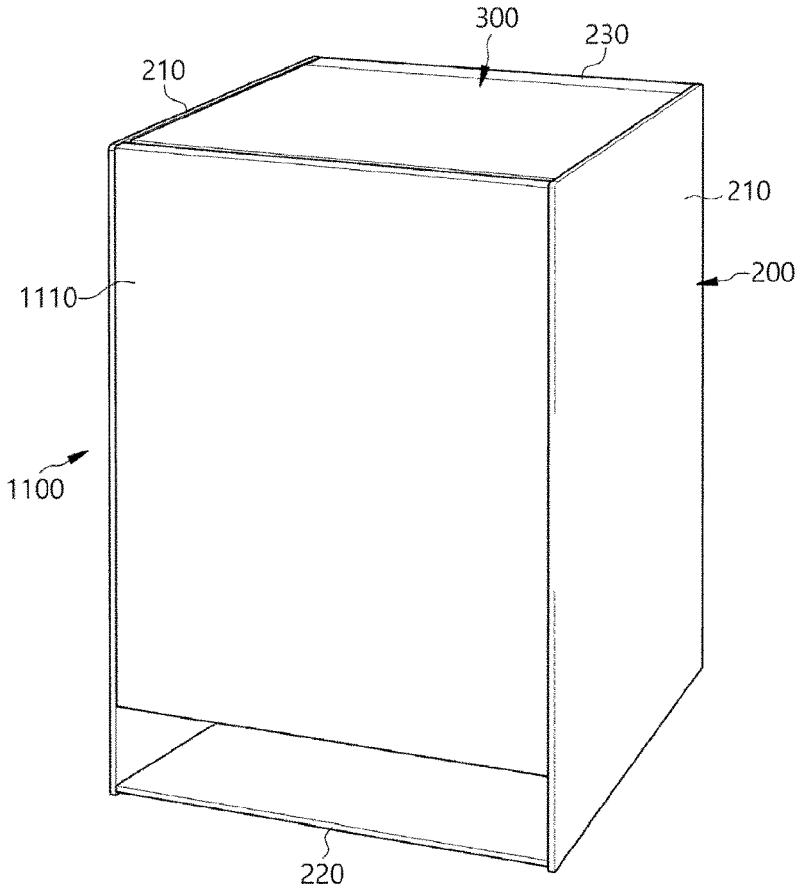
[Fig. 38]
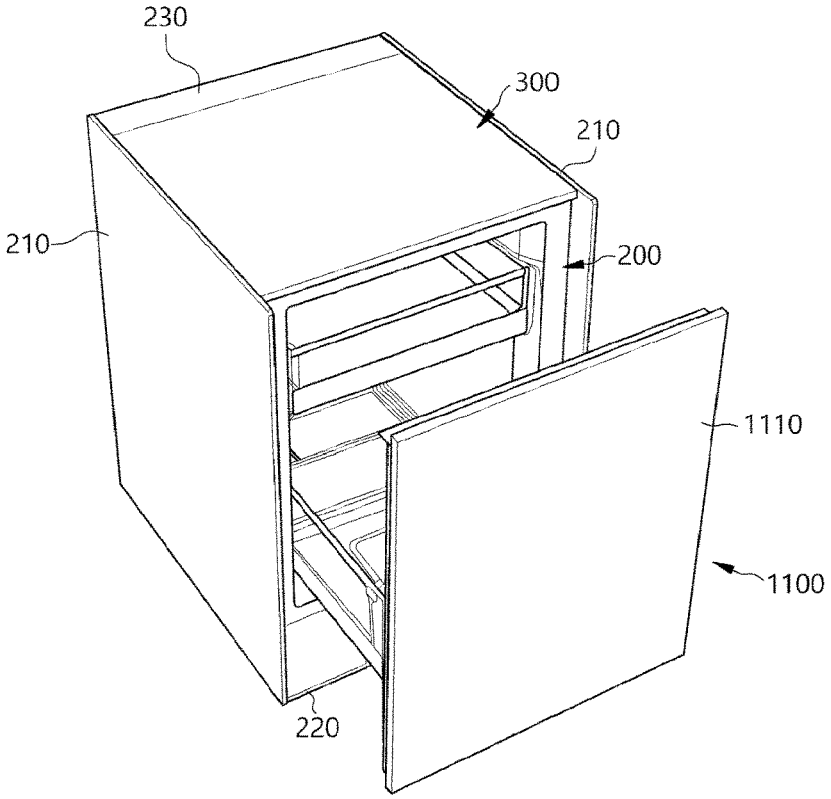

[Fig. 39]
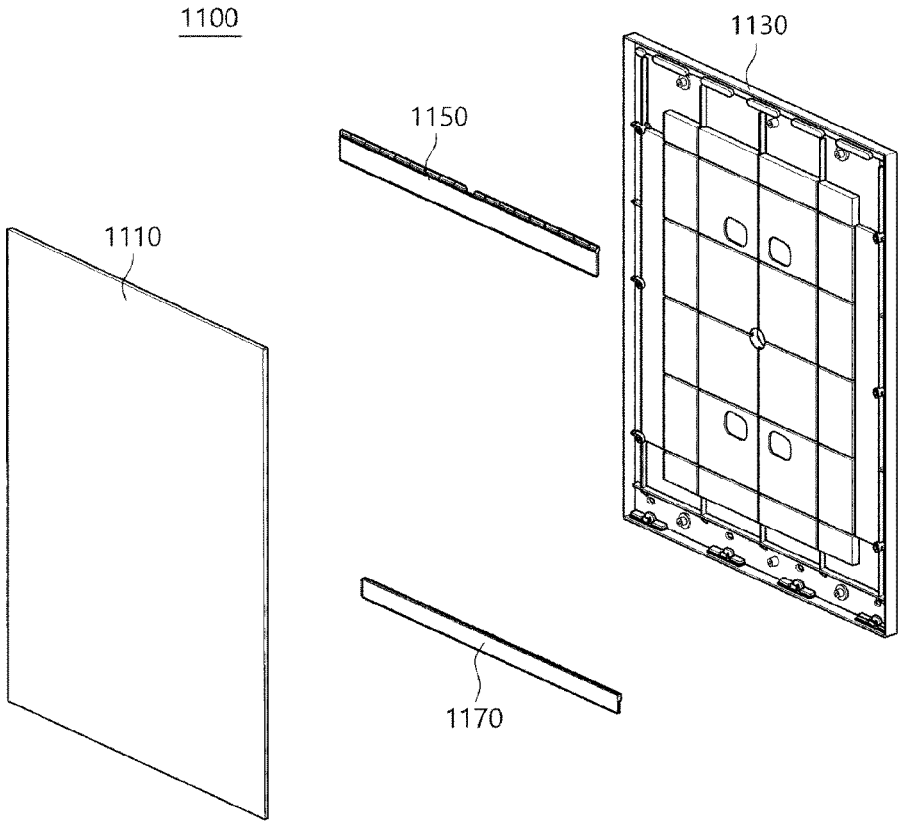

[Fig. 40]
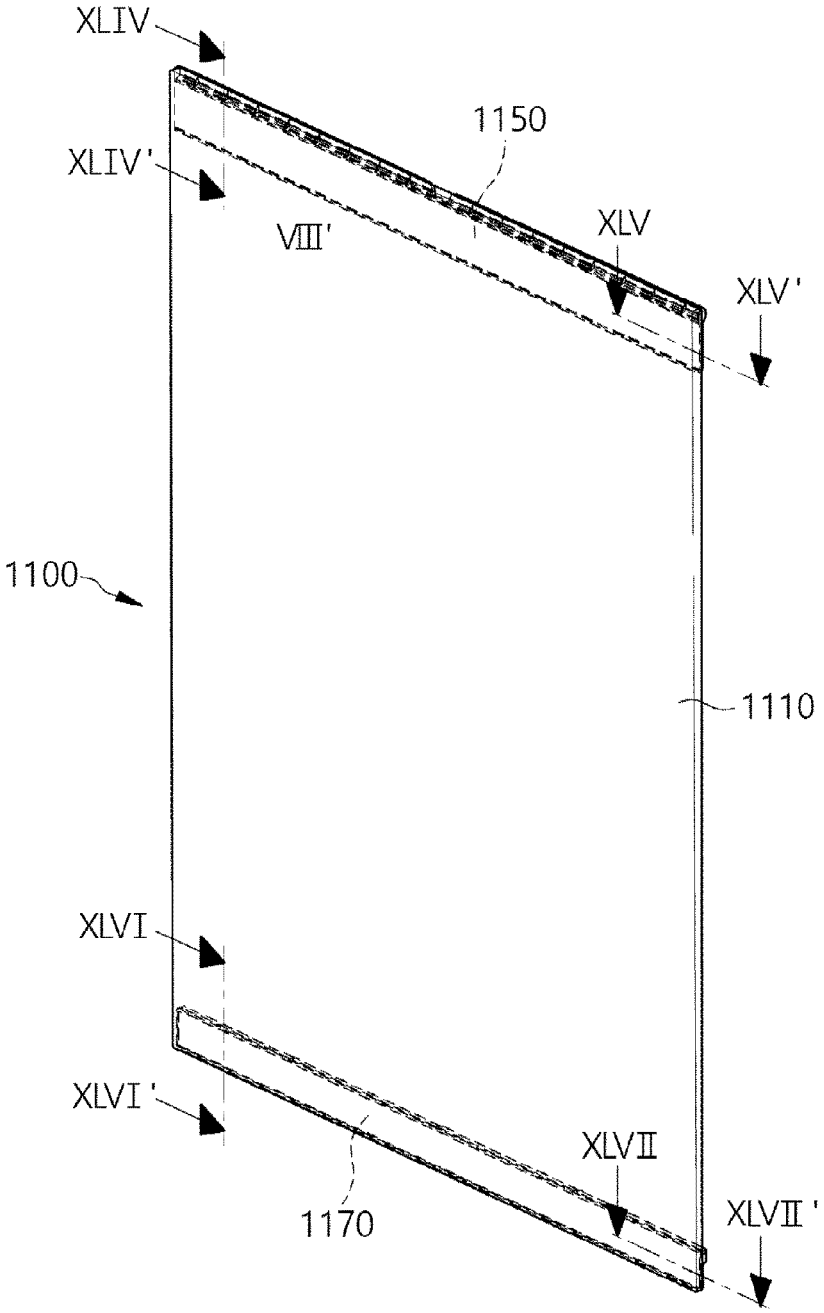

[Fig. 41]
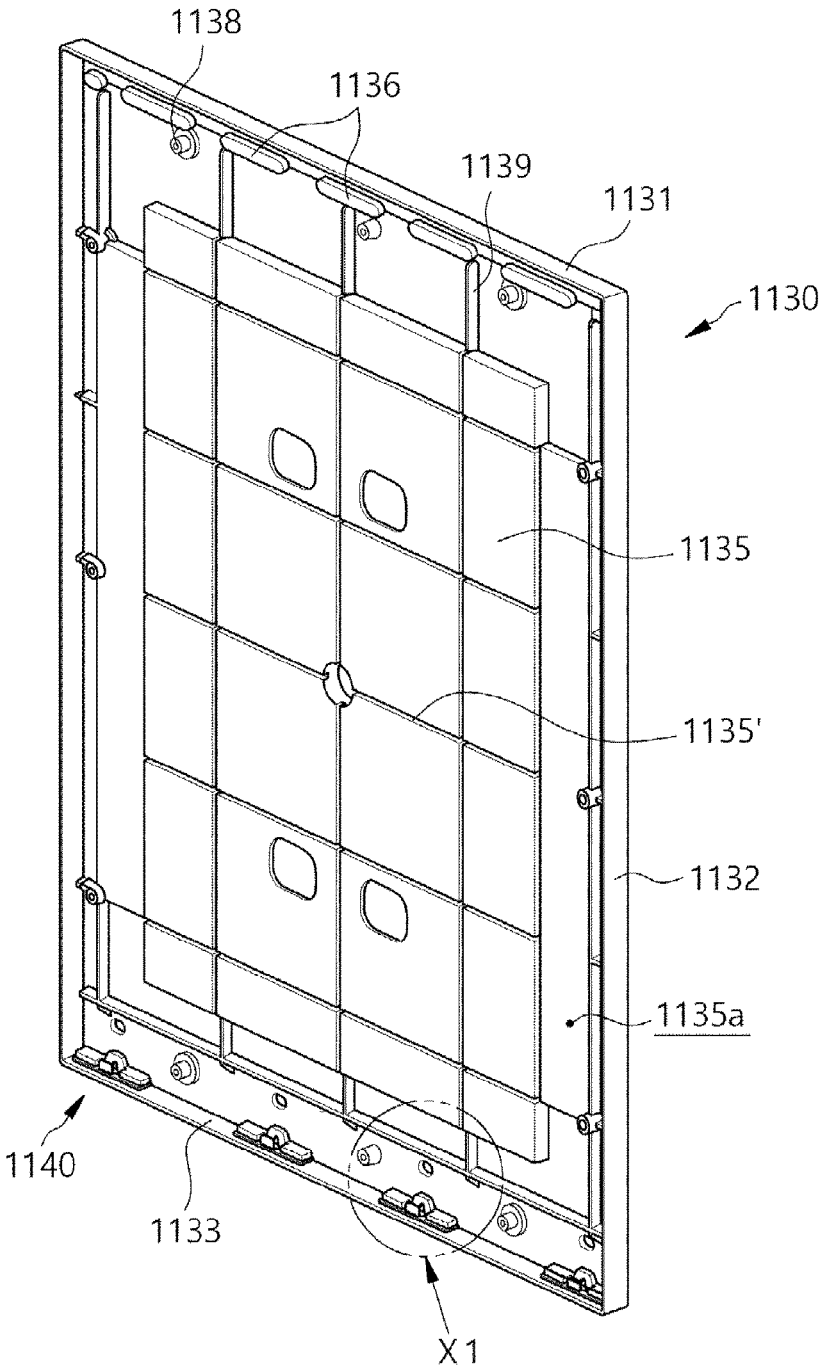

[Fig. 42]
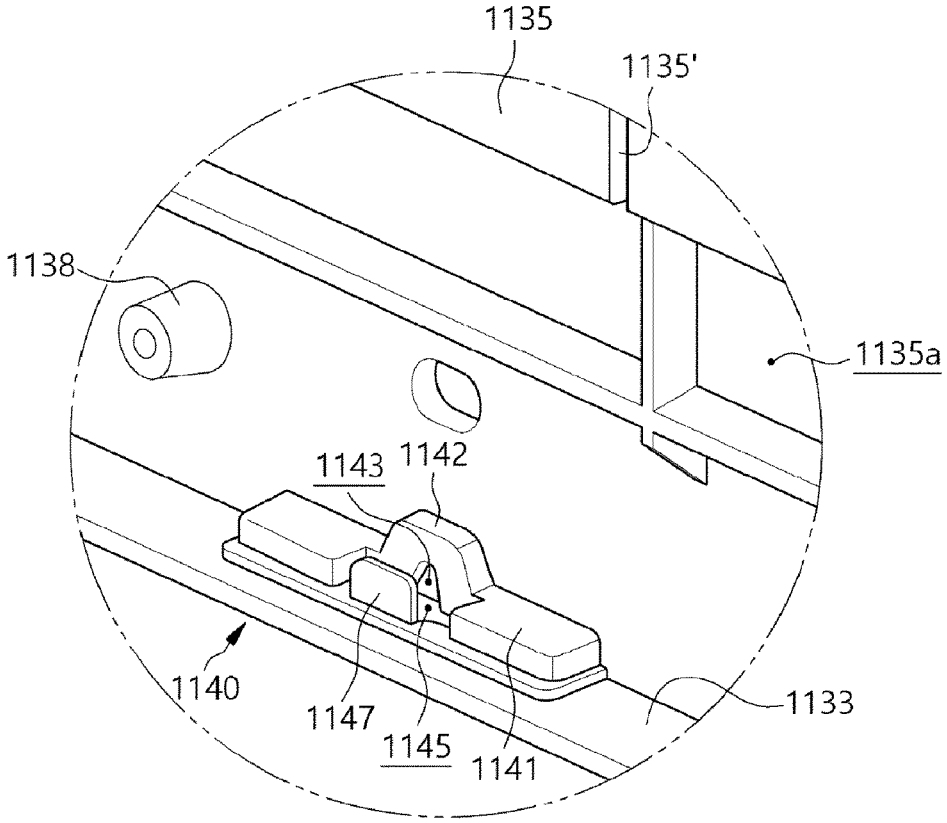
[Fig. 43]
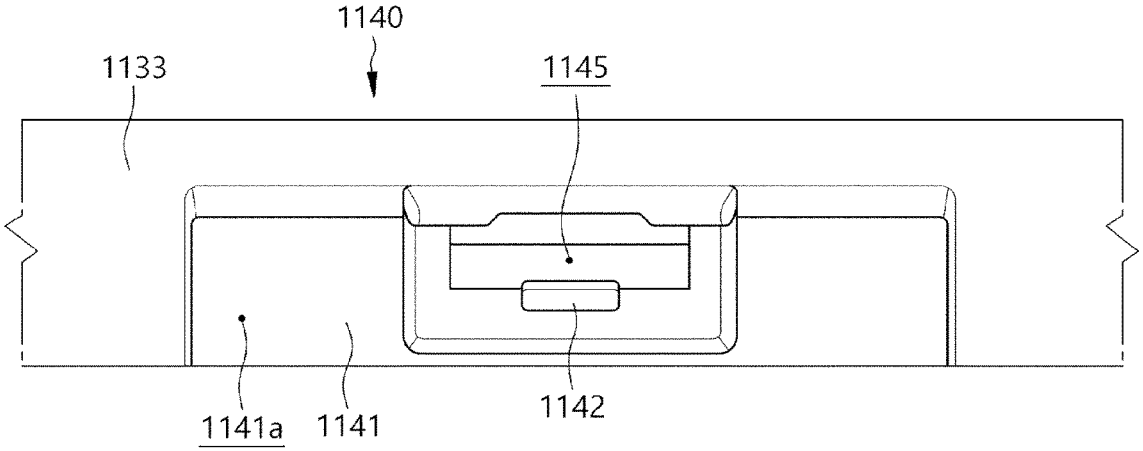

[Fig. 44]
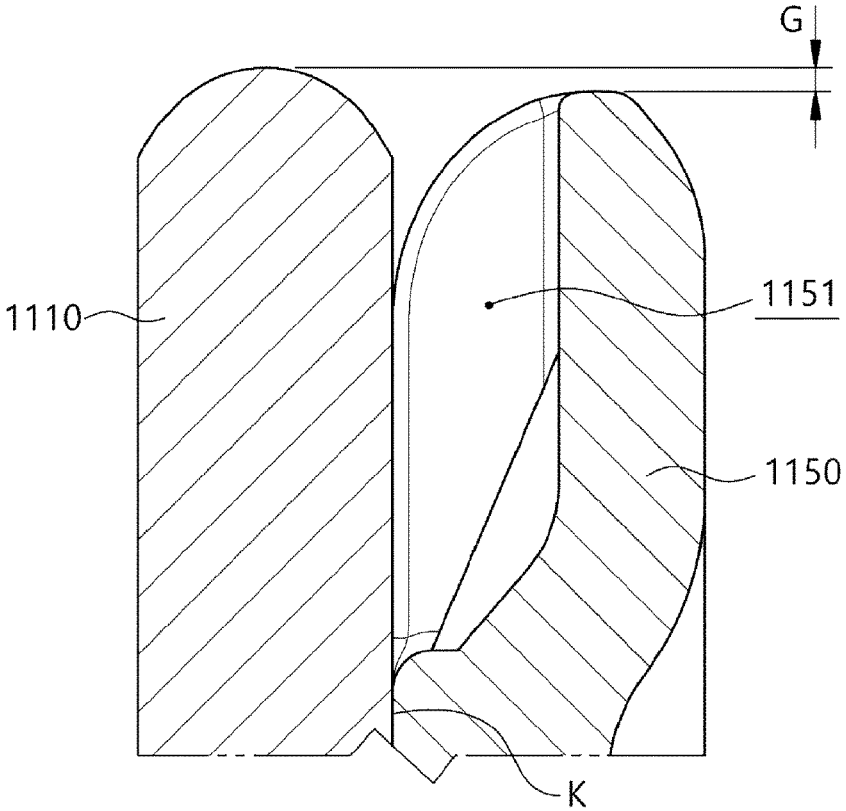
[Fig. 45]
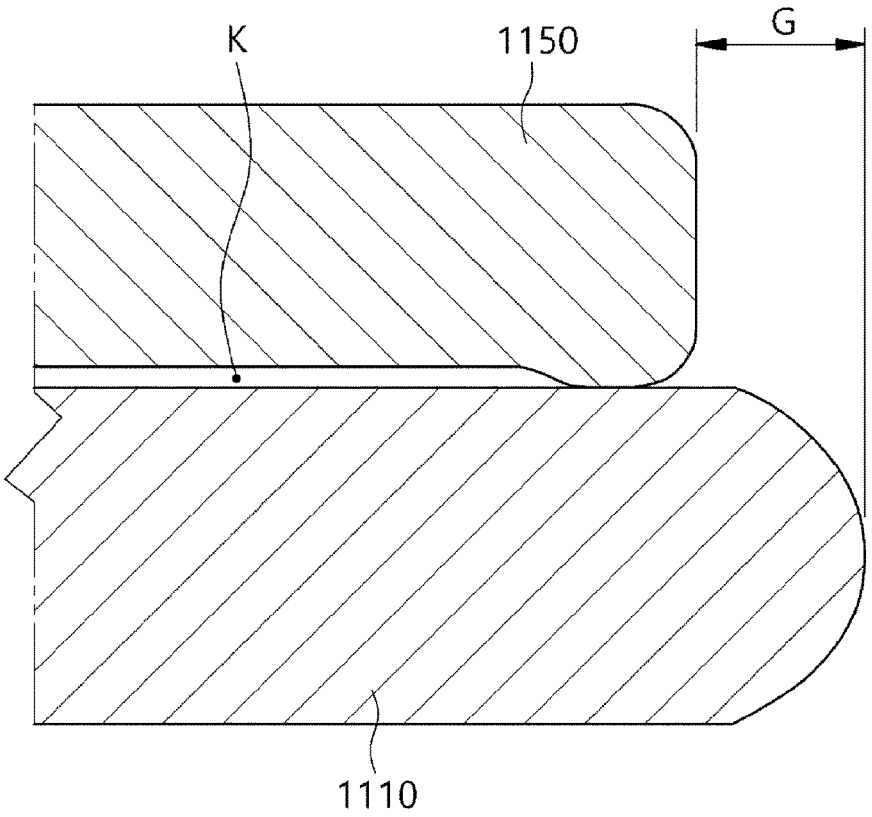

[Fig. 46]
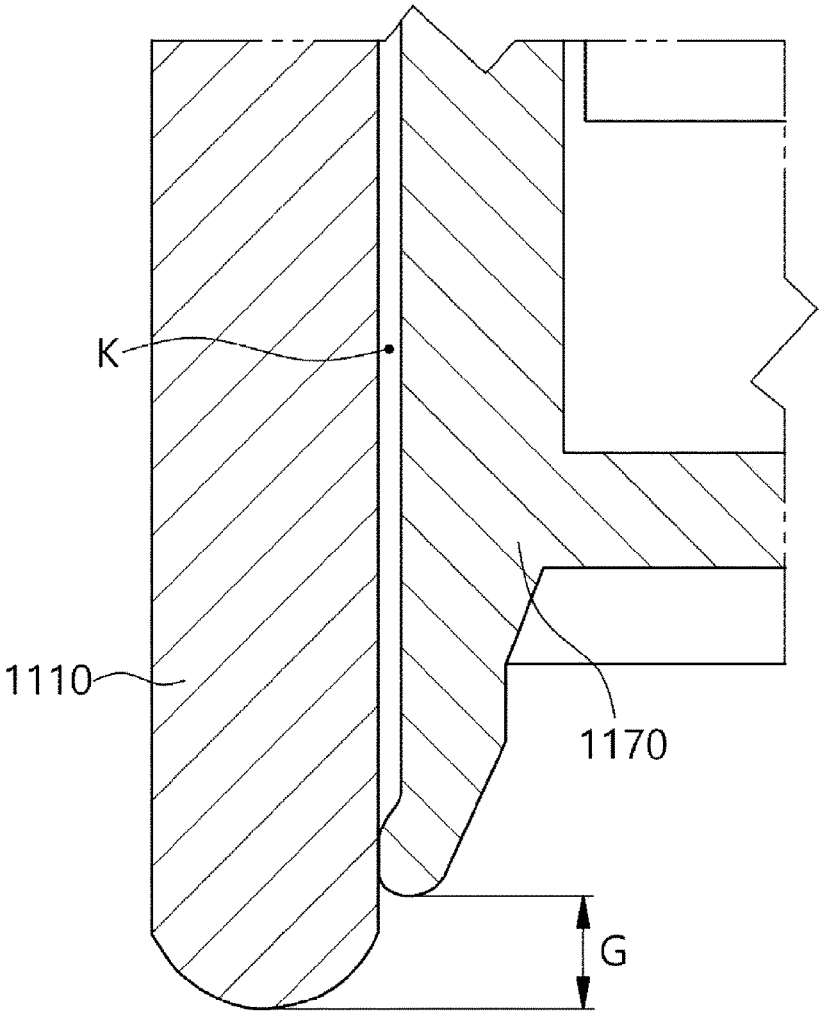

[Fig. 47]
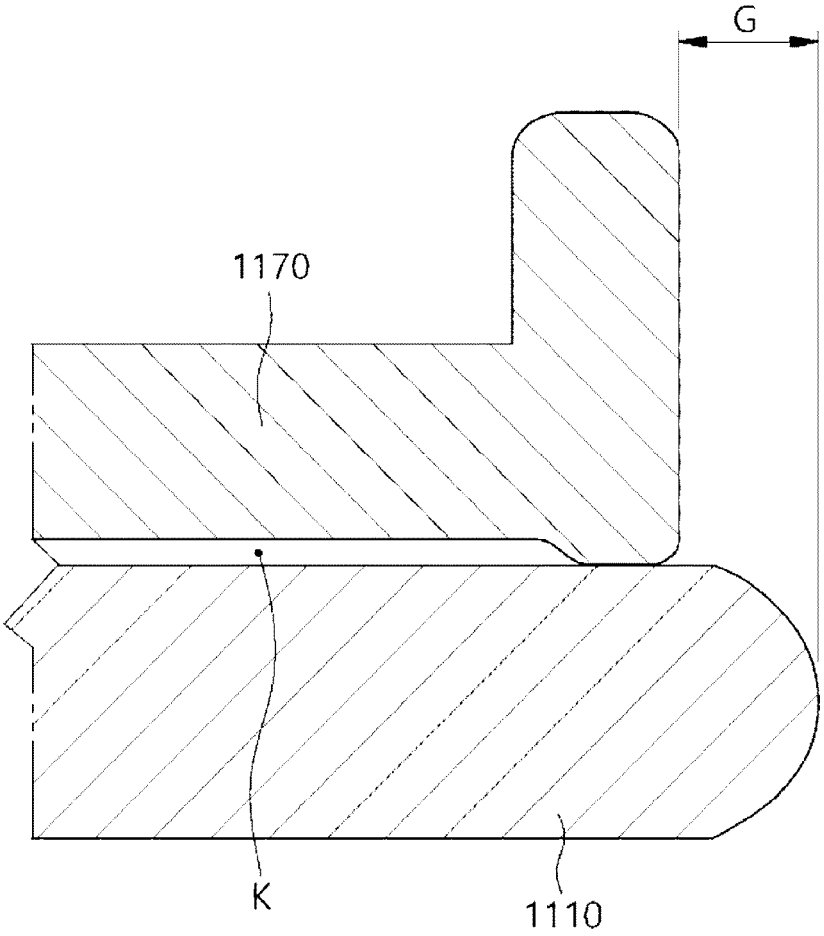

[Fig. 48]
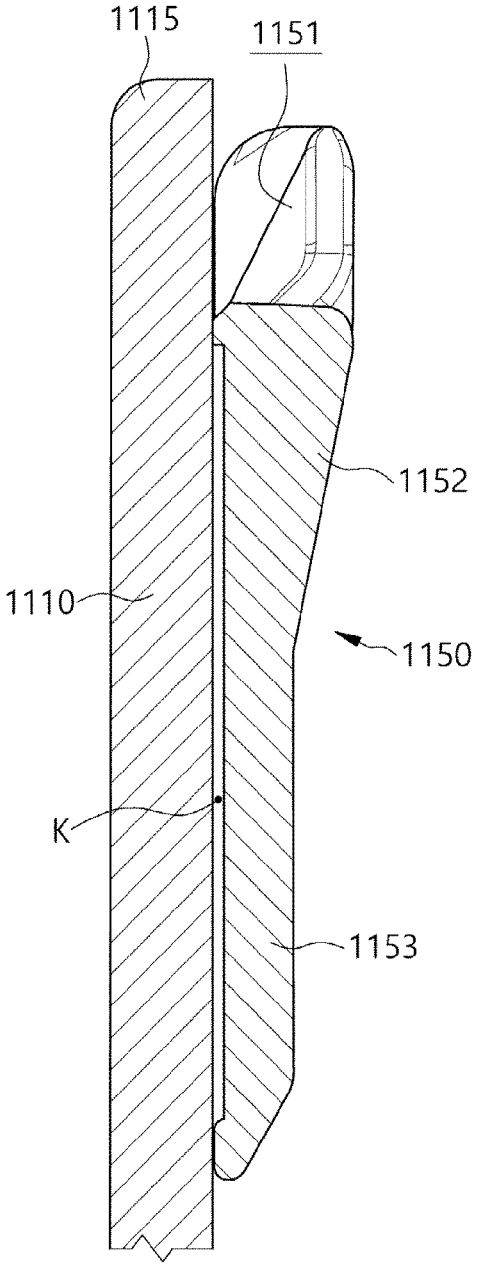

[Fig. 49]
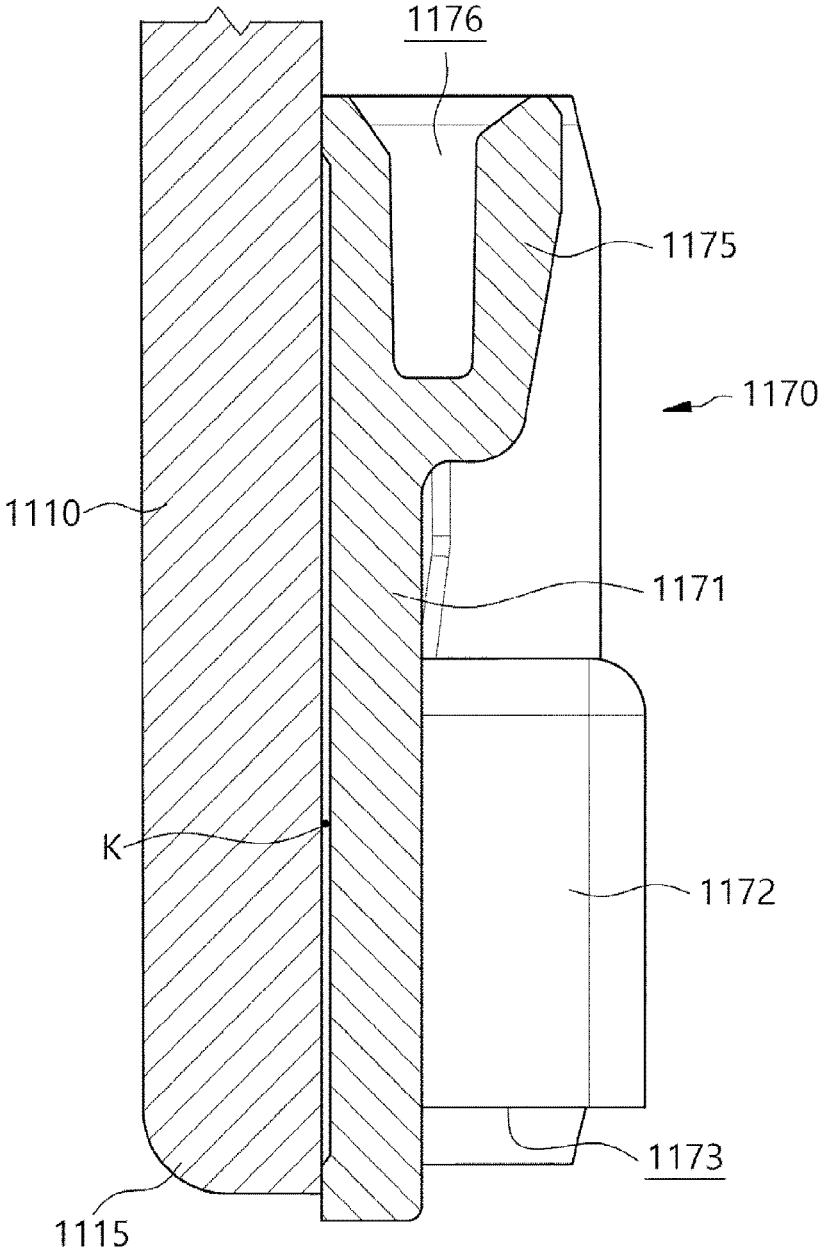

[Fig. 50]
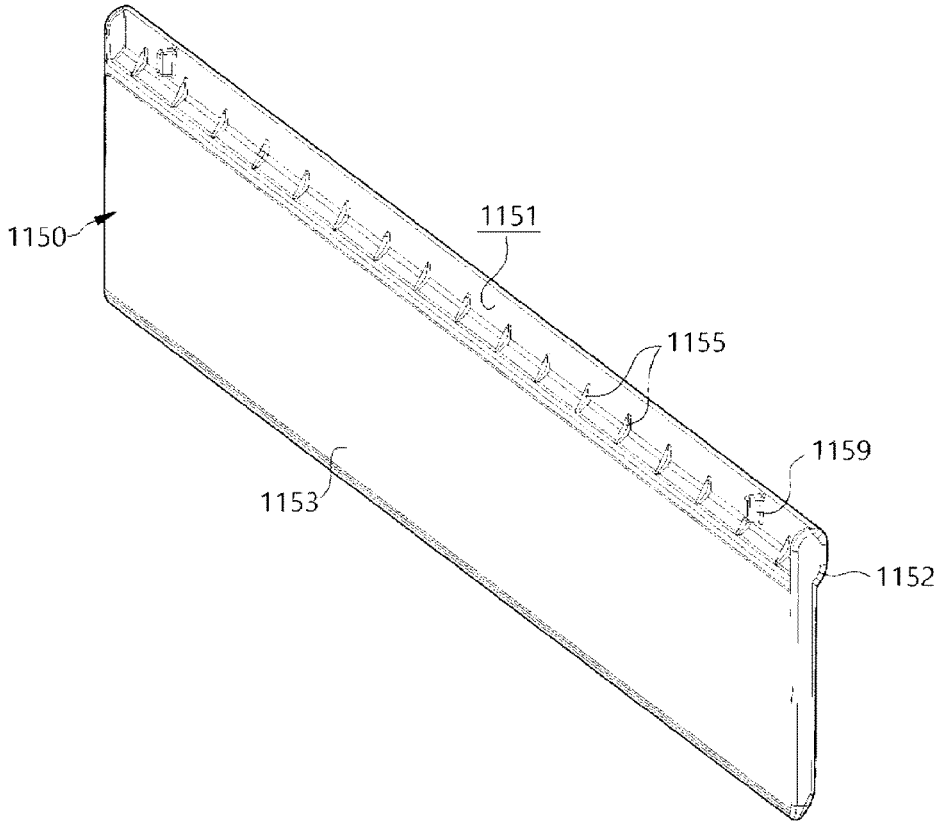
[Fig. 51]
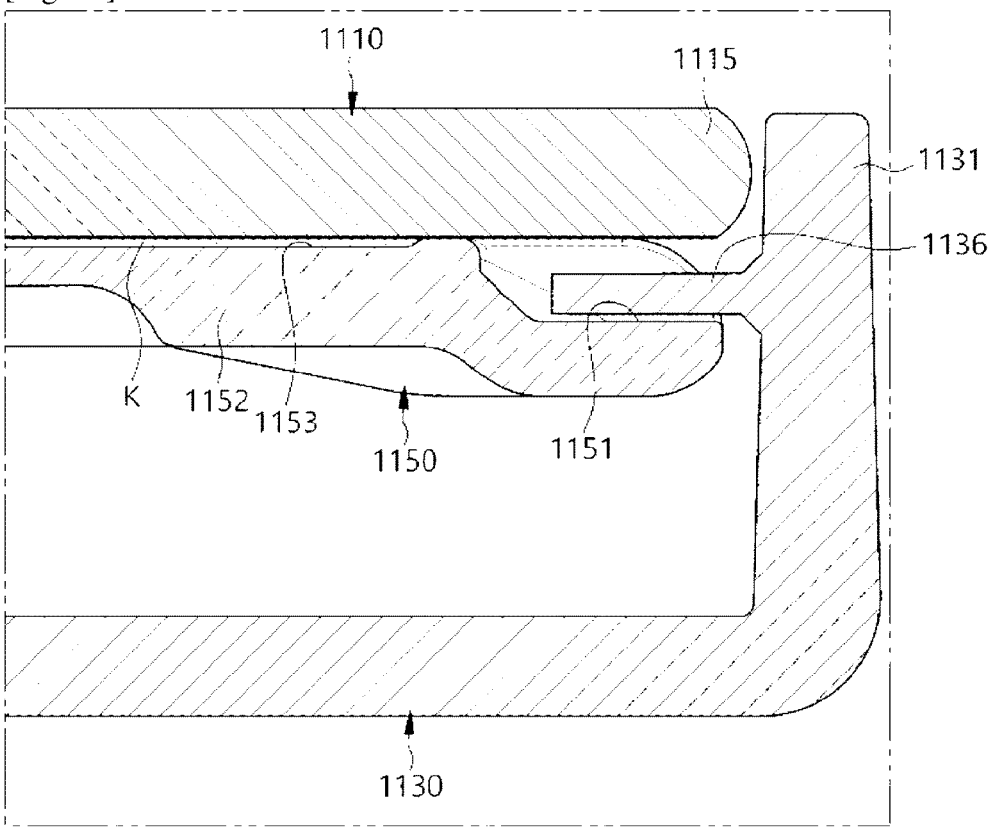

[Fig. 52]
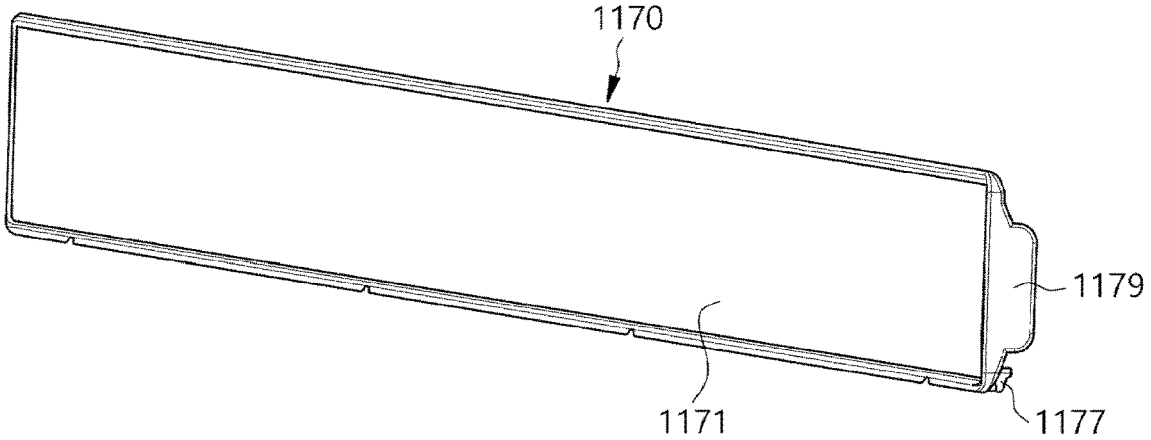
[Fig. 53]
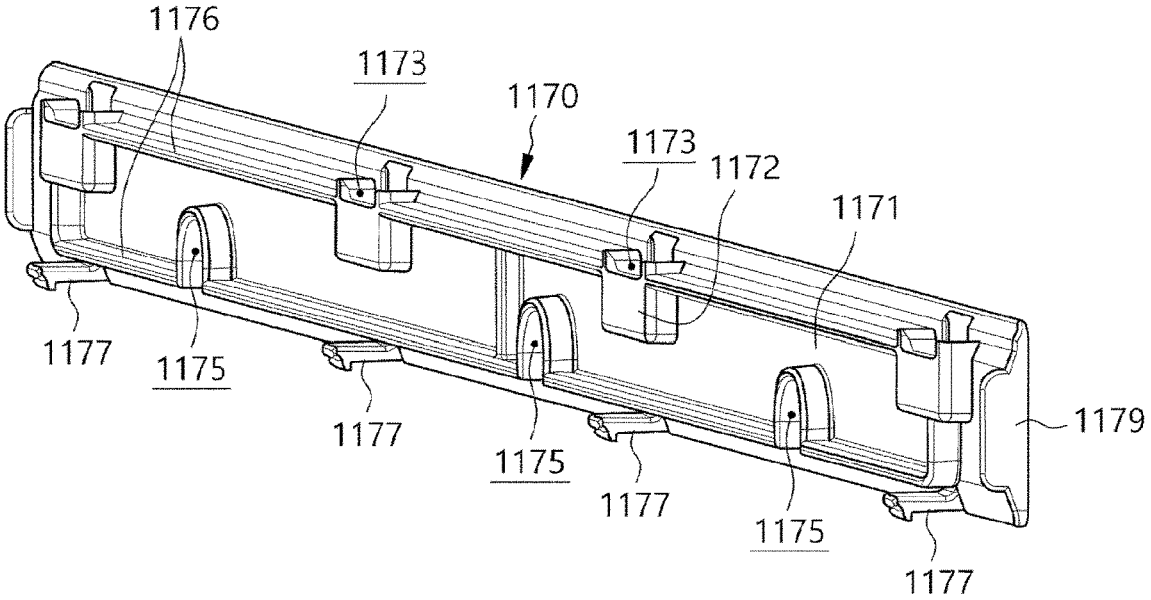
[Fig. 54]
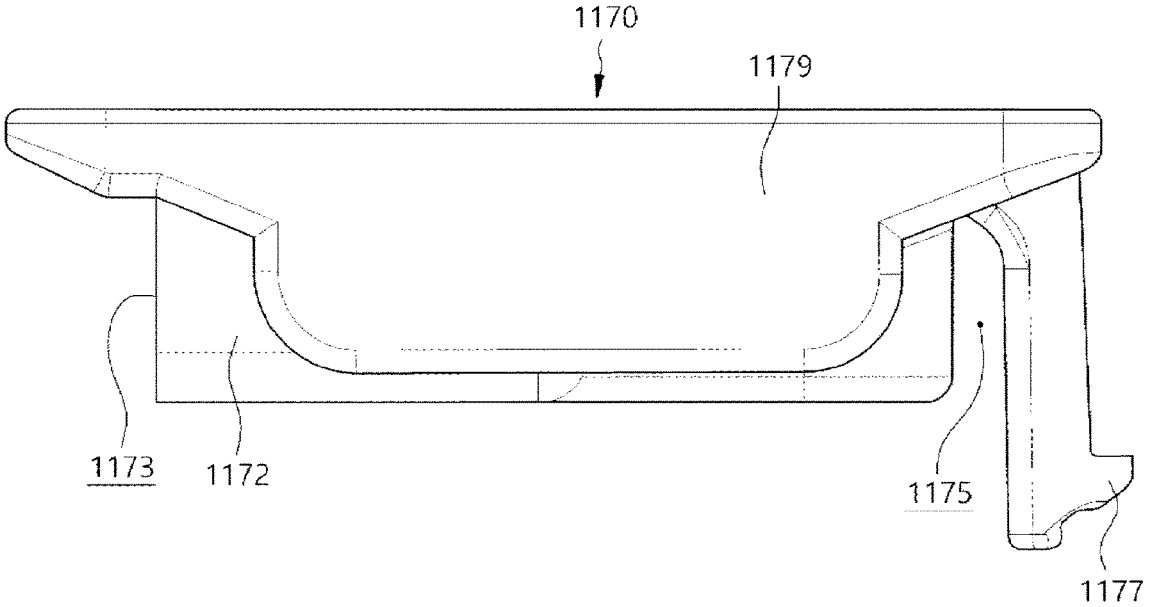

[Fig. 55]
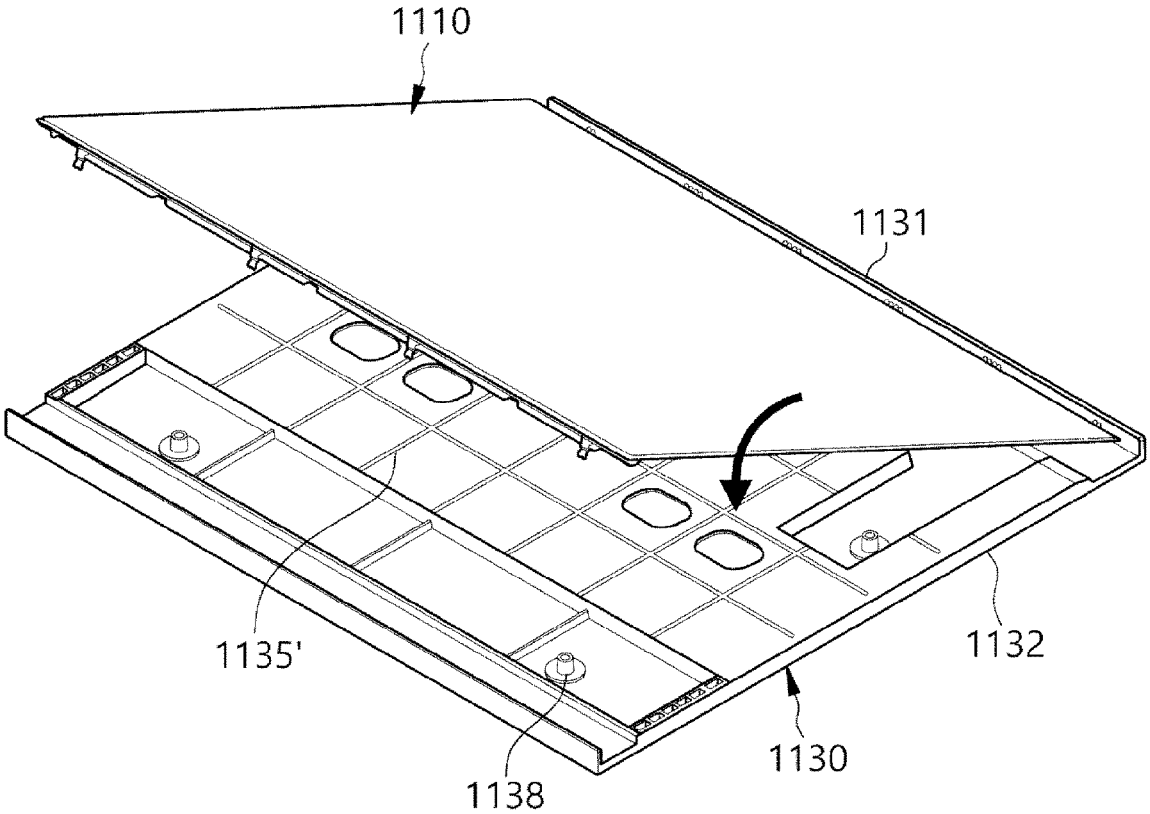
[Fig. 56]
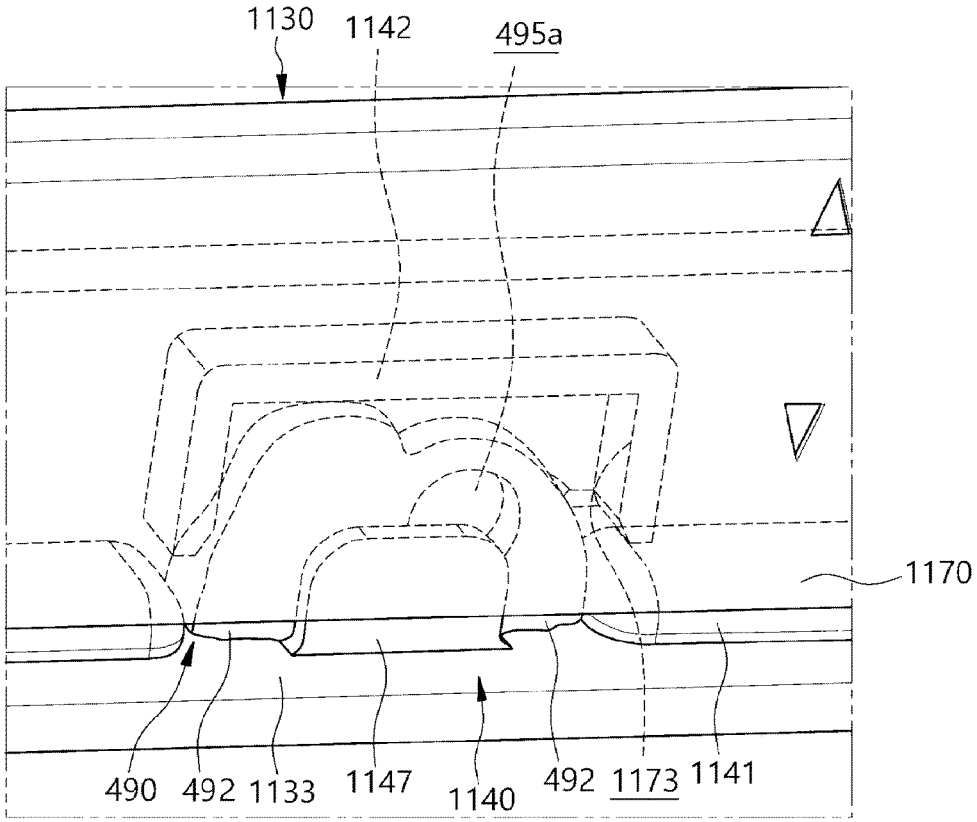

[Fig. 57]
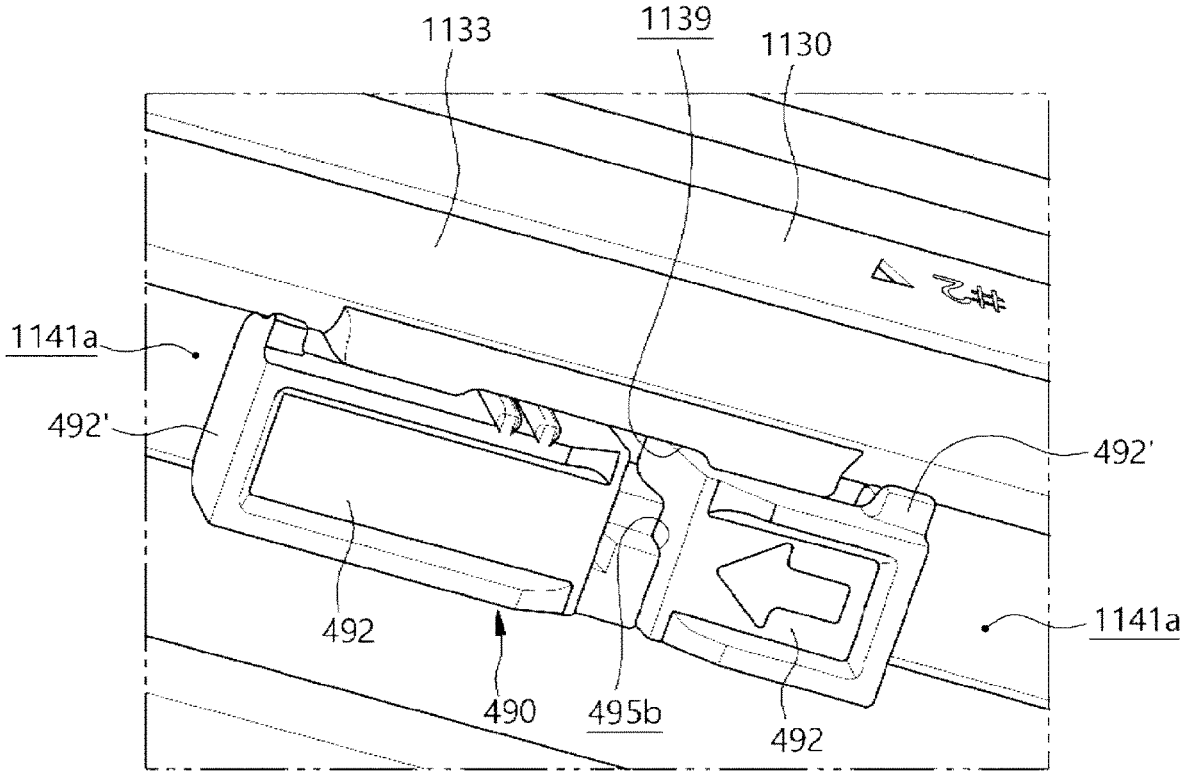
[Fig. 58]
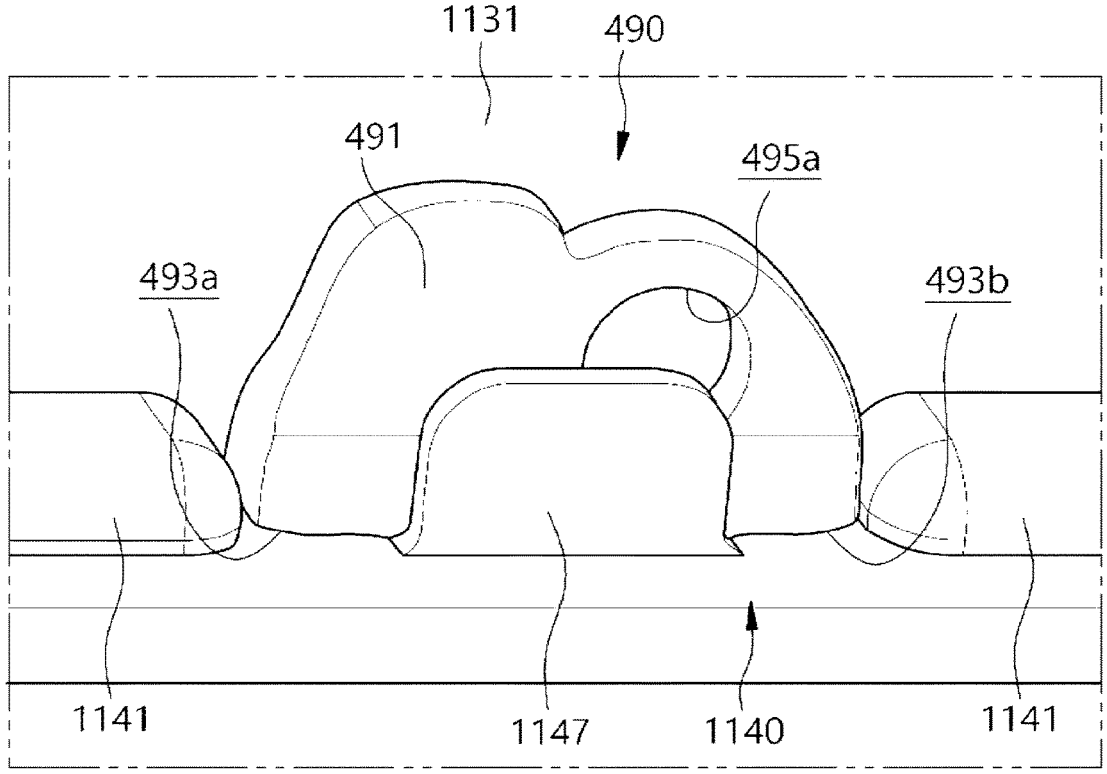

[Fig. 59]
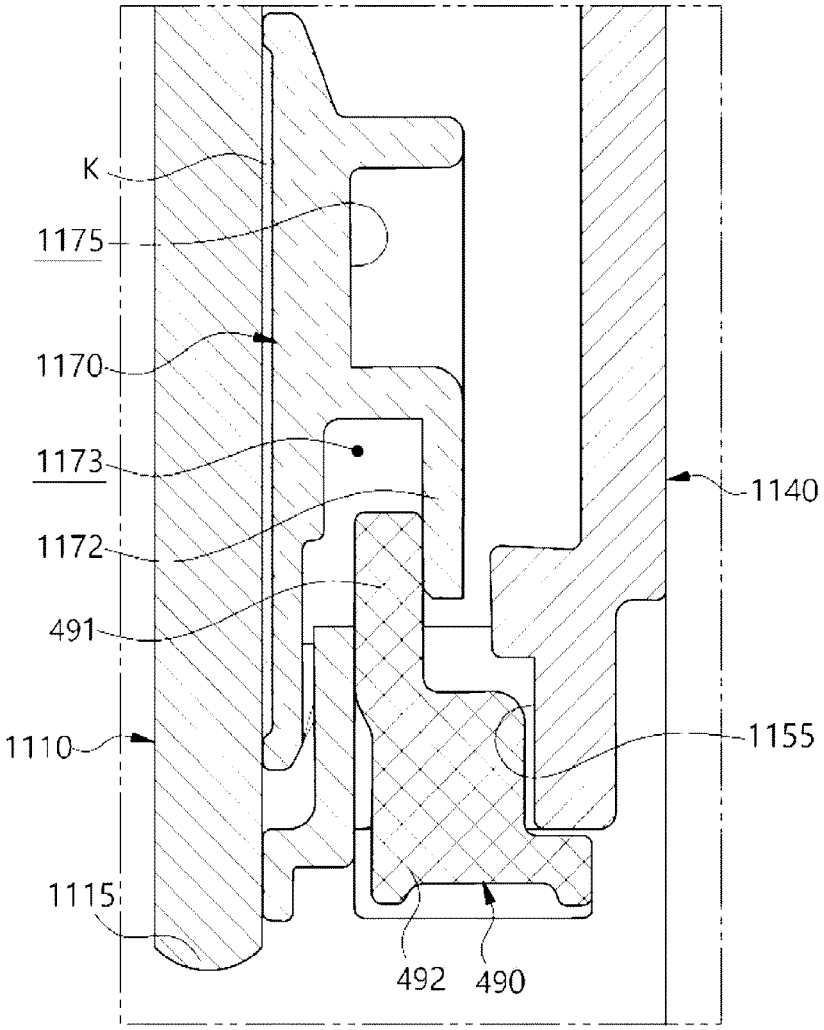

CABINET DEVICE

CROSS-REFERENCE TO RELATED PATENT APPLICATIONS

This application is a U.S. National Stage Application under 35 U.S.C. § 371 of PCT Application No. PCT/KR2022/008371, filed Jun. 14, 2022, which claims priority to Korean Patent Application Nos. 10-2021-0092814 and 10-2021-0093005, both filed Jul. 15, 2021, whose entire disclosures are hereby incorporated by reference.

TECHNICAL FIELD

The present disclosure relates to a device provided to store various objects, or a cabinet device provided to achieve the appearance of other home appliances.

BACKGROUND ART

In general, a cabinet device is a device provided to store objects, food, or products in a storage space therein.

The cabinet device may be an appliance or a piece of furniture that can be used independently while having an internal storage space, such as a chest of drawers, a nightstand, a safe, or a storage box, and may configure the appearance of home appliances that have internal storage space, such as refrigerators and washing machines.

Recently, as consumer interest in design increases in the design of home appliances such as a cabinet device or a refrigerator, various products that can change the appearance thereof to suit user preferences are being developed. For example, in order to harmonize with an installation environment such as the cabinet device or a refrigerator or with surrounding furniture/home appliances, a structure that varies a color or design of a front surface of a cabinet device are being developed.

For example, Korean Patent Application Publication No. 10-2011-0042786 (related art 1), Korean Patent No. 10-2147123 (related art 2), and U.S. Pat. No. 8,789,900 (related art 3) disclose techniques for forming a front surface of a door among the appearance of a refrigerator with a glass panel or a decorative panel.

Herein, the related art 1 relates to a technique to enhance the aesthetic of the refrigerator by attaching the decorative panel to the front surface of the door of the refrigerator, and the related art 2 relates to a technique to replace the decorative panel to vary the design the refrigerator door. The related art 3 relates to a technique to mount a cover panel forming the appearance to the front surface of the refrigerator door, wherein the cover panel is configured to be attachable and detachable to provide the appearance of the door front surface suitable for a user's taste.

However, in the related art 1, the door design cannot be arbitrarily changed according to the user's taste, and in the related art 2, since the decorative panel is fixed to a refrigerator frame using a simple hook structure, stability thereof may be reduced and, specifically, there is a high risk that the decorative panel may be separated from the door in a process of opening and closing the door with a heavy glass panel. In the related art 3, when the user wants to change the appearance of the refrigerator door, since the entire decorative panel should be removed and replaced, replacement is very inconvenient, the number of parts for separation and installation increases production cost, and the assembling of the decorative panel is degraded.

Furthermore, the above related arts are provided to fix the decorative panel installed at the front surface of the door to the door, and not to change the design for an upper wall or side walls of the cabinet device. Conventionally, since the upper wall of the cabinet device is integrally formed with the opposite side walls, the upper wall of the cabinet device is not configured to be changeable unlike the door.

Specifically, even in the case of the cabinet device, which has a low height, the exterior is recently designed according to the indoor environment in which the furniture and home appliances are provided. The cabinet device, which has a low height, is a small product, so that the cabinet device has the appearance (upper wall and opposite side walls) of integrated type, not a replaced type, and the cabinet device is sold in various designed colors.

In other words, the appearance design of the cabinet device is not combined with a color or design according to the consumer's (or user's) request, but is only combined with a color or design according to the seller's (or manufacturer's) choice.

DOCUMENTS OF RELATED ART (Patent Document 0001) Korean Patent Application Publication No. 10-2007-0003397

(Patent Document 0002) Korean Patent Application Publication No. 10-2013-0135485

(Patent Document 0003) Korean Patent Application Publication No. 10-2014-0102808

DISCLOSURE OF INVENTION

Technical Problem

The present disclosure has been provided to solve the above problems occurring in the related art, and the present disclosure is intended to provide a cabinet device configured to selectively change the design or color of the appearance thereof in response to a user's need.

Another objective of the present disclosure is configured to solidly fix a front panel of a door of to a door frame and simultaneously to easily separate the front panel from the door frame.

A further objective of the present disclosure is configured to replace only a front panel while a door frame is fixed.

A further objective of the present disclosure is configured such that when an upper panel made of a transparent material such as glass is damaged, a user easily replace only the upper panel.

A further objective of the present disclosure is configured to prevent an edge portion of an upper surface assembly from being exposed outward.

Solution to Problem

A cabinet device of the present disclosure has an upper surface assembly of which an upper surface is separately provided from an outer casing, and the bottom of the upper surface assembly may be coupled to an upper surface of an inner casing. Therefore, in response to a user's need, the appearance design of the cabinet device may be freely and easily changed.

Then, the cabinet device of the present disclosure may have the upper surface assembly located between upper ends of two side walls of the outer casing. Therefore, as the upper surface assembly is pushed or pulled forward or rearward, the upper surface assembly may be easily separated from the upper surface of the inner casing. In addition, the finishing treatment for the opposite side surfaces of the upper surface assembly is not needed.

Furthermore, the upper surface assembly of the cabinet device of the present disclosure may include an upper panel providing an upper surface thereof. The upper panel may be made of glass. Therefore, the design of the upper surface of the cabinet device may be enhanced.

Then, the upper surface assembly of the cabinet device of the present disclosure may have a bottom frame providing a bottom surface thereof and coupled to an upper surface of the inner casing.

Furthermore, the upper surface assembly of the cabinet device of the present disclosure may have holder brackets coupling the upper panel to the bottom frame. The holder brackets may be attached and fixed to at least of some portions of a bottom surface of the upper panel, and be removably coupled to the bottom frame.

Then, the bottom of the upper panel of the cabinet device of the present disclosure may be printed with an opaque colored paint.

Furthermore, the bottom of the upper panel of the cabinet device of the present disclosure may be covered with an opaque colored film.

Then, the holder brackets of the cabinet device of the present disclosure may include a plurality of holder brackets. The holder brackets may be respectively attached to at least two edge walls of the bottom surface of the upper panel.

Furthermore, the holder brackets of the cabinet device of the present disclosure may be respectively attached to the two edge walls of the upper panel symmetrical to each other.

Then, facing surfaces of each of the holder brackets and the upper panel may be bonded with an adhesive.

Furthermore, an attachment groove may be formed by being recessed on each of the holder brackets of the cabinet device of the present disclosure. Therefore, as an adhesive is covered or adheres in the attachment groove, it is possible to prevent the adhesive from leaking outward.

Then, edge walls may be respectively provided at front and rear ends of an upper surface of the bottom frame.

Furthermore, a supporting step may be provided on an inside surface of any one of the edge walls of the bottom frame, and any one of the holder brackets has an accommodating groove accommodating the supporting step.

Then, at least one supporting step may be provided on an inside surface of another edge wall of the bottom frame, and another holder bracket of the holder brackets may have a hook. Therefore, when the upper panel is seated on the bottom frame, it is possible to prevent the upper panel from moving upward.

Furthermore, the bottom of the bottom frame may have a tool insertion hole. Therefore, a hand or a tool may be inserted into the tool insertion hole so as to release a restriction state of the hook caught by the supporting step, so that the convenience of work may be improved.

The upper surface of the bottom frame may include a spacing wall located to be spaced apart from another edge wall, and the spacing wall may have a mounting hole formed by penetrating the spacing wall. Therefore, the mounting holder may be coupled to the mounting hole while passing therethrough.

The holder bracket of the cabinet device of the present disclosure may have a holder locking groove. Therefore, a part of the mounting holder passing through the mounting hole of the spacing wall may be accommodated therein and restrained.

A mounting hole may be formed by penetrating a portion of the bottom frame. Therefore, the mounting holder may be easily coupled to the holder locking groove of the holder bracket through the mounting hole of the spacing wall.

A moving prevention step may be provided on the spacing wall of the bottom frame. Therefore, when a part of the mounting holder is provided by passing through the mounting hole, a part of the mounting holder may prevent the mounting holder from moving in a vertical direction.

The bottom frame may include at least one strength reinforcing rib. Therefore, it is possible to prevent the bottom frame from twisting.

The opposite side walls of the outer casing of the cabinet device of the present disclosure may be made of a different material from the upper panel of the upper surface assembly. Therefore, the opposite side walls may be made of metal plate, so that the material cost may be reduced.

An upper surface of the inner casing may have an assembly groove, and the bottom surface of the upper surface assembly may have an assembly holder. Therefore, the upper surface assembly may be removably coupled to the upper surface of the inner casing.

The assembly groove and the assembly holder may include at least two assembly grooves and two assembly holders, respectively. Therefore, a problem in that the upper surface assembly is installed to be twist may be prevented.

The assembly groove may be shaped in a hole penetrating the upper surface of the inner casing, and the bottom of the upper surface of the inner casing may include a protection cap covering the assembly groove. Therefore, the upper surface of the inner casing may be made of a flat plate and it is possible to prevent the assembly holder from being exposed to the inside space of the inner casing.

The present disclosure may include a casing main body providing a storage space, and a door assembly configured to be coupled to the casing main body to shield the storage space. The door assembly a front panel constituting a front surface of the door assembly, and a rear surface frame arranged at a rear side of the front panel. A first bracket and a second bracket may be coupled to the front panel, a mounting holder may be fitted into the rear surface frame and the second bracket to fix the second bracket to the second location of the rear surface frame. Therefore, in the present disclosure, the front panel may be easily fixed and separated by the removable mounting holder.

The first bracket may be coupled to an upper edge of the front panel, and the second bracket may be coupled to a lower edge of the front panel. The front panel may be solidly fixed to the rear frame by using the two brackets.

The front panel may be made of glass, and the first bracket and the second bracket may be attached to a rear surface of the front panel. Therefore, while the rear frame constituting the door assembly is fixed to the door assembly, only the front panel may be replaced.

The mounting holder may be inserted into the holder locking hole of the rear frame and the holder locking groove of the second bracket. Herein, a part of the mounting holder may be inserted into the holder locking groove through the holder locking hole, and another part of the mounting holder may be caught and fixed to a circumference of the holder locking hole.

The mounting holder may have a pair of coupling grooves engaged with the circumference of the holder locking hole, an elastic deformation part may be provided between the mounting holder and the pair of coupling grooves to vary a distance between the pair of coupling grooves. Therefore, the user can easily attach and detach the front panel by elastically deforming the mounting holder.

The second bracket may be coupled to the second location of the front panel along an edge of a second front panel, and the holder locking groove may have an entrance open toward a direction opposite to the first bracket. Therefore, while the front panel is locked to the first location of the rear frame, the front panel may be fixed by using the mounting holder at the second location.

The rear surface frame may include a fixing protrusion at the first location thereof, and a fixing groove may be formed between a rear surface of the front panel and the first bracket so that the fixing protrusion may be fitted into the fixing groove. Therefore, the front panel may be easily fixed to the rear frame by the first bracket at the first location.

The rear surface frame may include a fixing protrusion at the first location thereof, and a fixing groove may be formed between a rear surface of the front panel and the first bracket so that the fixing protrusion be fitted into the fixing groove. Herein, the fixing protrusion may protrude toward the second location of the rear surface frame.

The mounting holder may have a holder body having an elastic deformation part, and a pair of coupling grooves provided at opposite portions of the holder body with the elastic deformation part located between the pair of coupling grooves. A pair of handles extended on the opposite portions of the holder body in opposite directions with the elastic deformation part located between the pair of handles, and the pair of handles may be extended in directions away from each other. When the holder body is elastically deformed in a direction in which the elastic deformation part is narrowed, a distance between the pair of coupling grooves may become shorter than a width of the holder locking hole.

The elastic deformation part may be formed by penetrating the holder body in a direction perpendicular to a direction in which the mounting holder may be fitted into both the holder locking hole and the holder locking groove.

The elastic deformation part may include a first deformation part, and a second deformation part connected to the first deformation part, and open toward a lower portion of the holder body. The first deformation part may have a transverse width larger than a transverse width of the second deformation part.

The elastic deformation part may be provided at a location separated from the center portion of the mounting holder based on a transverse center portion of the mounting holder.

A handle of the mounting holder may have a grip portion formed in a direction in which the handle may be increased in area, and the rear surface frame may have an avoidance groove into which the grip portion is placed.

A moving prevention part may protrude at a location spaced apart from one surface of the rear surface frame facing a rear surface of the mounting holder with the holder locking hole as the center in the rear surface frame.

A supporting step may protrude on a first surface of the rear surface frame facing a rear surface of the mounting holder in a direction toward the rear surface of the mounting holder.

A supporting groove may be recessed on the supporting step, and a supporting protrusion protruding from the rear surface of the mounting holder may be inserted into the supporting groove.

A door liner may be coupled to a rear portion of the rear surface frame, and both the door liner and the rear surface frame may be fixed to a door frame of the door assembly.

A fixing magnet may be provided on any one of a rear surface of the front panel or a front surface of the rear surface frame, and on remaining one of the rear surface of the front panel or the front surface of the rear surface frame, a magnetic part generating gravitation with the fixing magnet may be provided at a location matching with the fixing magnet.

A panel contact part may protrude on a center portion of the rear surface frame toward the rear surface of the front panel, an installation part may be provided between an edge of the rear surface frame and the panel contact part, and the fixing magnet or the magnetic part may be provided at the installation part.

An edge surface of the front panel may protrude outward more than an edge surface of the first bracket or the second bracket.

A cabinet device of the present disclosure may include a casing main body providing a storage space, and a surface assembly coupled to the casing main body, and constituting at least a part of surfaces of the cabinet device. The surface assembly may include a surface panel constituting a surface of the surface assembly, and a rear frame arranged at a rear side of the surface panel. The first bracket and the second bracket may be coupled to the surface panel, and the mounting holder may be fitted into the rear frame and the second bracket, so that the second bracket may be fixed to the second location of the rear frame. As described above, in the present disclosure, the removably mounting holder is used for fixing the surface panel, so that fixing and separation of the surface panel may be easily performed.

Advantageous Effects of Invention

The cabinet device according to the present disclosure as described above has following effects.

The cabinet device of the present disclosure is configured to separate the surface parts such as the front panel or the upper panel that are exposed outward among the door assembly from the door assembly, and the user can replace the surface parts with a front panel or an upper panel with desired various designs and colors. Therefore, the aesthetic sense of the cabinet device can be enhanced and the range of design choices can be broadened.

Then, the cabinet device of the present disclosure is assembled while the upper surface assembly is in contact with the upper surface of the inner casing, so that a gap between the upper surface assembly and the upper surface of the inner casing can be prevented or minimized.

Furthermore, in the cabinet device of the present disclosure, while the upper surface assembly is securely seated on the upper surface the inner casing, the opposite side surfaces thereof are covered by the two side walls of the outer casing. Accordingly, the finishing treatment for the opposite side surfaces of the upper surface assembly is not needed, and the structure of the cabinet device can be simplified, so that the manufacturing cost can be reduced. In addition, the upper surface assembly is installed at the outer casing in an embedded structure, so that the unity of the exterior design can be improved.

Then, according to the present disclosure, the front panel is solidly fixed to the rear frame by not only the two brackets, but also the attachable and detachable mounting holder, so that separation of the front panel can be easily performed. Therefore, there is an effect of improving convenience of replacement of the front panel.

Specifically, even when the door assembly is applied to products of which a door is repeatedly opened and closed, such as not only furniture, but also refrigerators, Styler®, dishwashers, etc., since the two brackets stably fix the front panel to the rear frame, vibrations of the front panel generated when the door is opened and closed can be reduced.

Furthermore, according to the present disclosure, while the rear frame is fixed to the door frame of the door assembly, only the front panel can be separated from the rear frame. There is no need to replace the entire rear frame when the design of the door assembly is changed, wherein a change structure of the door design becomes simple and the replacement cost becomes low.

Then, the mounting holder for fixing the front panel to the rear frame can be fitted into both the rear frame and the brackets by elastic deformation, and on the other hand, the mounting holder can be separated therefrom by elastic deformation. Therefore, the user can easily remove the front panel from the rear frame with a separate tool, which improves the convenience of usage of the cabinet device.

Furthermore, since the brackets coupled to the front panel are caught by the edge of the rear frame, even when the mounting holder is removed, the front panel is not immediately separated or separated from the rear frame, and can maintain a temporarily assembled state. Therefore, even when the front panel with heavy glass material is installed in a standing direction, the front panel has advantages of high convenience of replacement and high stability.

Then, among the door assembly, an outward-exposed portion of the front panel is made of glass material, so that the aesthetic sense of the front surface of the cabinet device can be enhanced.

Furthermore, the front panel and the rear frame constituting the door assembly have a magnet and a magnetic body, respectively, so that the front panel may be fixed to the rear frame by magnetic force. The magnet and the magnetic body can maintain the mounted state of the front panel even when the two brackets are damaged, and therefore the durability of installation and the stability of the door assembly can be improved.

BRIEF DESCRIPTION OF DRAWINGS

FIG. 1 is a perspective view showing the exterior of a cabinet device according to an embodiment of the present disclosure.

FIG. 2 is a perspective view showing a door of the cabinet device according to the embodiment of the present disclosure, wherein the door is open.

FIG. 3 is a perspective view showing the appearance of the cabinet device according to the embodiment of the present disclosure, wherein an upper assembly is separated from two side walls.

FIG. 4 is a perspective view showing the appearance of the cabinet device according to the embodiment of the present disclosure, wherein an upper surface of an inner casing while the upper assembly is removed from the two side walls.

FIG. 5 is a main part cut-out perspective view showing the structure of the upper surface side of the inner casing of the cabinet device according to the embodiment of the present disclosure.

FIG. 6 is a main part cut-out perspective view showing an assembly groove of the inner casing of the cabinet device according to the embodiment of the present disclosure.

FIG. 7 is a main part cut-out perspective view taken from a lower portion of the assembly groove, the view showing the assembly groove of the inner casing of the cabinet device according to the embodiment of the present disclosure.

FIG. 8 is a main part cut-out perspective view showing a protection cap provided at the lower portion of the assembly groove of the inner casing of the cabinet device according to the embodiment of the present disclosure.

FIG. 9 is a sectional view showing the structure of the upper surface side of the inner casing of the cabinet device according to the embodiment of the present disclosure.

FIG. 10 is an enlarged view showing part "A" in FIG. 9.

FIG. 11 is a bottom view showing an upper surface assembly of the cabinet device according to the embodiment of the present disclosure.

FIG. 12 is an exploded-perspective view showing the upper surface assembly of the cabinet device according to the embodiment of the present disclosure.

FIG. 13 is a sectional view showing an upper panel of the upper surface assembly of the cabinet device according to the embodiment of the present disclosure.

FIG. 14 is a plan view showing a bottom frame of the upper surface assembly of the cabinet device according to the embodiment of the present disclosure.

FIG. 15 is a bottom view showing the bottom frame of the upper surface assembly of the cabinet device according to the embodiment of the present disclosure.

FIG. 16 is an enlarged view showing part "B" in FIG. 14.

FIG. 17 is a main part enlarged view showing the structure of a supporting step of the upper surface assembly of the cabinet device according to the embodiment of the present disclosure.

FIG. 18 is an enlarged view showing part "C" in FIG. 14.

FIG. 19 is a perspective view showing the upper surface side of a first holder bracket of the cabinet device according to the embodiment of the present disclosure.

FIG. 20 is a main part cut-out sectional view showing the first holder bracket, in an installed state, of the cabinet device according to the embodiment of the present disclosure.

FIG. 21 is a perspective view showing the upper surface side of a second holder bracket of the cabinet device according to the embodiment of the present disclosure.

FIG. 22 is a perspective view showing the bottom side of the second holder bracket of the cabinet device according to the embodiment of the present disclosure.

FIG. 23 is a side view showing the second holder bracket of the cabinet device according to the embodiment of the present disclosure.

FIG. 24 is a main part cut-out sectional view showing the second holder bracket, in the installed state, of the cabinet device according to the embodiment of the present disclosure.

FIGS. 25 and 26 are perspective views showing a state for the upper panel of the upper surface assembly of the cabinet device according to the embodiment of the present disclosure to be coupled to the bottom frame.

FIGS. 27 and 28 are main part perspective views showing, from different directions, a mounting hole and a moving prevention step provided in a second spacing wall of the bottom frame of the cabinet device according to a second embodiment of the present disclosure.

FIG. 29 is a main part plan view showing the mounting hole and the moving prevention step provided in the second spacing wall of the bottom frame of the cabinet device according to the second embodiment of the present disclosure.

FIG. 30 is a state view showing, from the front, the mounting hole and the moving prevention step provided in the second spacing wall of the bottom frame of the cabinet device according to the second embodiment of the present disclosure.

FIGS. 31 and 32 are perspective views showing a mounting holder of the cabinet device according to the second embodiment of the present disclosure.

FIG. 32 is a main part perspective view showing the moving prevention step provided in the second spacing wall of the bottom frame of the cabinet device according to the second embodiment of the present disclosure.

FIG. 33 is a main part perspective view showing, from the rear end side of the second spacing wall, the mounting holder mounted to a holder mounting part of the cabinet device according to the second embodiment of the present disclosure.

FIG. 34 is a main part perspective view showing, from the front end side of the second spacing wall, the mounting holder mounted to the holder mounting part of the cabinet device according to the second embodiment of the present disclosure.

FIG. 35 is a perspective view showing the second holder bracket of the cabinet device according to the second embodiment of the present disclosure.

FIG. 36 is a sectional view showing the second holder bracket in the assembled state due to the mounting holder of the cabinet device according to the second embodiment of the present disclosure.

FIG. 37 is a perspective view showing the appearance of the cabinet device according to a third embodiment of the present disclosure.

FIG. 38 is a perspective view showing the door in the open state according to the third embodiment of the present disclosure.

FIG. 39 is an exploded perspective view showing parts of the door according to the third embodiment of the present disclosure.

FIG. 40 is a perspective view showing a front panel according to the third embodiment of the present disclosure.

FIG. 41 is a perspective view showing the configuration of a rear frame among the parts of the door according to the third embodiment of the present disclosure;

FIG. 42 is an enlarged perspective view showing part X1 in FIG. 41.

FIG. 43 is a bottom view showing, from the lower side, part X1 in FIG. 41.

FIG. 44 is a sectional view taken along line VIII-VIII' in FIG. 40.

FIG. 45 is a sectional view taken along line IX-IX' in FIG. 40.

FIG. 46 is a sectional view taken along line X-X' in FIG. 40.

FIG. 47 is a sectional view taken along line XI-XI' in FIG. 40.

FIG. 48 is a sectional view showing a coupling structure between the front panel and a first bracket among the parts of the door according to the third embodiment of the present disclosure.

FIG. 49 is a sectional view showing a coupling structure between the front panel and a second bracket among the parts of the door according to the third embodiment of the present disclosure.

FIG. 50 is a perspective view showing the configuration of the first bracket according to the third embodiment of the present disclosure.

FIG. 51 is a sectional view showing the structure in which the first bracket and the front panel according to the third embodiment of the present disclosure is coupled to the rear frame.

FIG. 52 is a perspective view showing the configuration of the second bracket according to the third embodiment of the present disclosure.

FIG. 53 is a perspective view at a different angle from FIG. 52, the view showing the configuration of the second bracket according to the third embodiment of the present disclosure.

FIG. 54 is a side view showing the configuration of the second bracket according to the third embodiment of the present disclosure.

FIG. 55 is a perspective view showing the structure in which the first bracket and the front panel according to the third embodiment of the present disclosure is coupled to the rear frame.

FIG. 56 is a perspective view showing the mounting holder according to the third embodiment of the present disclosure, wherein the mounting holder is coupled to the rear frame and the second bracket.

FIG. 57 is a perspective view showing the lower side of the mounting holder according to the third embodiment of the present disclosure, wherein the mounting holder is coupled to the rear frame and the second bracket.

FIG. 58 is a perspective view showing the mounting holder according to the third embodiment of the present disclosure, the mounting holder being coupled to the rear frame.

FIG. 59 is a sectional view showing the mounting holder according to the third embodiment of the present disclosure, wherein the mounting holder is coupled to the rear frame and the second bracket.

MODE FOR THE INVENTION

Hereinbelow, some embodiments of the present disclosure will be described in detail with reference to illustrative drawings. In assigning reference numerals to components in each drawing, the same components are given the same reference numerals as much as possible even through the components are indicated in different drawings. Furthermore, in the following description, when it is decided that a detailed description of known configuration or function related to the present disclosure interferes with understanding of an embodiment of the present disclosure, the detailed description will be omitted.

The present disclosure relates to a cabinet device, and particularly, to a cabinet device including a door assembly 110 constituting a front surface of the cabinet device, an outer casing 200 constituting side surfaces and a bottom surface of the cabinet device, and an upper surface assembly 300 constituting an upper surface of the cabinet device. Herein, a part of the surface assembly including the door assembly 110, the outer casing 200, and the upper surface assembly 300 may be made of glass at an outward exposed portion.

A part of the surface assembly may be removably provided and be replaced. For example, any one of the door assembly 110, the outer casing 200, and the upper surface assembly 300 may be replaced, at the outward exposed portion, to be changed in design or be maintained.

Meanwhile, the cabinet device of the present disclosure may be cabinets for storing objects or furniture, or home appliances such as refrigerator, freezer, kimchi refrigerator, plant cultivation apparatus, Styler® (clothing treatment system), washing machine, etc. Hereinbelow, the cabinet device of the present disclosure, for example, will be described as a refrigerator.

Hereinbelow, an embodiment in which the design of the upper surface assembly 300 may be changed will be described with reference to FIGS. 1 to 36.

The cabinet device according to the embodiment of the present disclosure may include the inner casing 100. The inner casing 100 may serve as an inner body of the cabinet device. The inner casing 100 is formed in a container body with an open front surface, opposite side surfaces, top and lower surfaces, and a rear surface, and the inside space of the inner casing 100 may be used as a storage space. In other words, the inner casing 100 provides the storage space.

Although not shown in the drawings, the storage space in the inner casing 100 may be divided into a plurality of spaces by at least one shelf or partition wall.

The inner casing 100 may be made of such as a metal plate, synthetic resins, or various other materials.

Furthermore, the storage space of the inner casing 100 may be opened and closed by the door assembly 110.

Herein, the door assembly 110 may be formed of a shelf type door. Of course, although not shown in the drawings, the door assembly 110 may be formed of a swinging door or a sliding door.

Meanwhile, FIGS. 4 to 10 show a structure for the inner casing 100 to be coupled to the upper surface assembly 300, and the structure is provided on an upper surface of an inner casing 100.

According to the embodiment shown in the drawings, an assembly groove 120 may be formed on the upper surface of the inner casing 100. The assembly groove 120 is provided for coupling with the upper surface assembly 300, which will be described later.

The assembly groove 120 may include two assembly grooves 120 or more. For example, the assembly grooves 120 may be respectively formed at portions on the upper surface of the inner casing 100, and the portions are front opposite portions and rear one portion. Therefore, it is possible to prevent the upper surface assembly 300 from twisting or rotating toward the left or right and from being imprecisely installed.

Specifically, each of the assembly grooves 120 may be located at portions that are transversally and longitudinally symmetrical to each other based on the center of the inner casing 100, and assembly holders 350 of the upper surface assembly 300 may be formed in portions that are longitudinally and transversally symmetrical to each other based on the center of the upper surface assembly 300. The above structure allows the assembly regardless of a longitudinal direction of the upper surface assembly 300.

In addition, each of the assembly grooves 120 may include a connected hole 121, 122 with different diameters. In other words, the assembly holders 350 is inserted into a large hole 121 with a relatively large diameter and then moves into a small hole 122 with a relatively small diameter, so that each of the assembly holders 350 is prevented from being separated from the assembly groove. Herein, each of the assembly holders 350 may have an upper diameter formed smaller than a lower diameter, and the lower end of the assembly holder 350 and the small hole 122 of the assembly groove 120 may have the same diameter as each other.

Furthermore, the portions with the assembly grooves 120 in the upper surface of the inner casing 100 may be formed by being depressed. Therefore, the bottom of the upper surface assembly 300 and the upper surface of the inner casing 100 may be brought into contact with each other or located close to each other.

Furthermore, the upper surface of the inner casing 100 is made of a plate, so that the assembly groove 120 may be shaped in a hole penetrating the upper surface of the inner casing 100. In this case, the assembly holder 350 passing through the assembly groove 120 may be exposed toward the storage space in the inner casing 100, so a protection cap 130 may be provided at the bottom of the upper surface of the inner casing 100 to cover the assembly groove 120.

Next, the cabinet device according to the embodiment of the present disclosure may include the outer casing 200.

The outer casing 200 may serve as an outer body of the cabinet device.

As shown in accompanying FIGS. 3 and 4, the outer casing 200 may include two side walls 210 providing opposite side surfaces of the outer casing and a bottom part 220.

Unlike an upper panel 310 of the upper surface assembly 300 and a front surface of the door assembly 110, the outer casing 200 does not need to be formed with advanced design, and may be formed of a metal plate for case of molding or, may be formed by injection. Preferably, considering a case where the outer casing 200 is likely to be hit and damaged in various ways, the outer casing 200 may be made of a metal material so as to prevent a damage of the outer casing 200. In other words, the metal plate is bent in multiple steps, thereby forming the outer casing 200 in which the two side walls 210 and the bottom part 220 are integrated.

Meanwhile, an open rear surface of the outer casing 200 may be closed by the rear surface frame 230. Although not shown in the drawings, the rear surface frame 230 may be coupled to rear surfaces of the two side walls 210.

Next, the cabinet device according to the embodiment of the present disclosure may include the upper surface assembly 300.

The upper surface assembly 300 may serve as an upper surface of the cabinet device.

The upper surface assembly 300 may be located between upper ends of the two side walls 210.

In addition, a bottom surface of a bottom frame 320 includes assembly holders 350 to be coupled to the inner casing 100. Herein, each of the assembly holders 350 may be formed to have different diameters at upper and lower ends thereof, whereby each of the assembly holders 350 may be inserted into the large hole 121 of the assembly groove 120 and then to move into the small hole 122. A plurality of assembly holders 350 may be provided and be fixed to the bottom surface of the bottom frame 320 by screwing. The above structure is as shown in accompanying FIG. 11.

Therefore, by an operation of pulling or pushing the upper surface assembly 300 forward or rearward, the upper surface assembly 300 may be easily separated from or coupled to the upper surface of the inner casing 100.

In addition, since the two side walls 210 prevent opposite side surfaces of the upper surface assembly 300 from being exposed to the outside space, the opposite side surfaces of the upper surface assembly 300 does not need to be applied with a finishing process, thereby reducing the assembly cost.

Accompanying FIGS. 12 to 23 show an embodiment of each state for describing the upper surface assembly. Each of parts of the upper surface assembly 300 will be described in detail with reference to the drawings.

As shown in FIG. 12, the upper surface assembly 300 may include the upper panel 310 providing an upper surface of the upper surface assembly 300, the bottom frame 320 providing a bottom surface thereof, and a holder bracket 330, 340 coupling the upper panel 310 to the bottom frame 320.

Herein, the upper panel 310 is exposed to the outside space of the cabinet device and may be made of glass for advanced design.

A colored film 311 may be attached to the upper panel 310 as shown in accompanying FIG. 13. In other words, the upper panel 310 may have various colors as the film 311 is attached thereto, and thus a request of the user for various colors may be satisfied. Herein, the film 311 may be a film with general color or pattern or an opaque sheet, so that a structure or a form in the upper surface assembly 310 are not seen through the film. In addition, the film 311 may have various-shaped patterns as well as having various colors.

The film 311 may be attached to a bottom surface of the upper panel 310. Accordingly, it is possible to prevent the film 311 from being scratched or damaged due to outward exposure.

Of course, the upper panel 310 may be made of glass having color itself, or be covered with any one color paint at the bottom surface of the upper panel 310.

A front surface and a rear surface of the upper panel 310 may be rounded. Accordingly, it is possible to prevent the upper panel 310 made of glass from causing injuries, such as abrasions, to the user or being damaged by cracks, for example.

Then, the bottom frame 320 may serve as a body of the upper surface assembly 300.

The bottom frame 320 may be formed by injection because the bottom frame 320 is a non-exposed portion.

As shown in accompanying FIGS. 14 and 15, an upper surface or the bottom surface of the bottom frame 320 may have a plurality of strength reinforcing ribs 321 to prevent twisting of the bottom frame 320 caused when molding is performed in injection. Of course, the upper surface or the bottom surface of the bottom frame 320 may have a structure with a plurality of uneven portions.

An edge wall 322, 323 may be formed at each of a front end and a rear end of the upper surface of the bottom frame 320.

As shown in FIGS. 14 and 16, a supporting step 322*a* may be formed on an inner surface of any one of the first edge wall 322 and the second edge wall 323. For example, the supporting step 322*a* may protrude rearward from an inner surface of the first edge wall 322.

The supporting step 322*a* may protrude from the inner surface of the first edge wall 322 in a perpendicular direction and may be accommodated in an accommodating groove 331 of a first holder bracket 330, which will be described later. In other words, the structure of the supporting step 322*a* and the accommodating groove 331 may prevent the front end side of the upper panel 310 from moving upward when the upper panel 310 is seated on the bottom frame 320. Herein, the supporting step 322*a* may include one supporting step or two supporting steps or more.

As shown in accompanying FIGS. 14, 15, 17, and 18, at least one holding step 323*a* may be formed on another edge wall of the bottom frame 320. For example, the holding step 323*a* may protrude on an inner surface of the second edge wall 323.

The holding step 323*a* may protrude on the inner surface of the second edge wall 323 and have an inclined or round structure of which a lower portion gradually protrudes forward, and may be limited by being caught by a hook 341 of a second holder bracket 340, which will be described below. In other words, the structure of the holding step 323*a* and the hook 341 may prevent the rear end side of the upper panel 310 from moving upward when the upper panel 310 is seated on the bottom frame 320.

As shown in accompanying FIGS. 17, 18, and 24, the bottom of the bottom frame 320 may have a tool insertion hole 324. The tool insertion hole 324 is a hole for insertion of a tool D, and may be located directly below the holding step 323*a* and be formed by vertically penetrating the bottom of the bottom frame 320. Therefore, in order to release restriction of the hook 341 caught by the holding step 323*a*, the tool (for example, a flat-head driver, etc.) may be inserted into the tool insertion hole 324 and work convenience can be improved. Of course, the tool insertion hole 324 may be formed in a size large enough for a finger of the user to be inserted.

The upper surface of the bottom frame 320 may have a spacing wall 326 located to be spaced apart from the second edge wall 323. Herein, the spacing wall 326 may be formed to be spaced apart from the second edge wall 323 by a distance large enough for the second holder bracket 340 to be inserted.

Furthermore, the upper surface assembly 300 may include the holder bracket 330, 340.

The holder bracket 330, 340 is provided to couple the upper panel 310 to the bottom frame 320.

The upper panel 310 is made of glass, so that it is different to provide various coupling structures (e.g., a step, a hole, a hook, etc.) to the upper panel 310 and there may be a risk of breakage of the upper panel 310. Considering the above problems, as the holder bracket 330, 340 is additionally provided, the upper panel 310 may be precisely coupled to the bottom frame 320 without changing the form of the upper panel 310.

The holder bracket 330, 340 may include a plurality of holder brackets. In other words, the holder bracket 330, 340 restrains the upper panel 310 to the bottom frame 320 at a plurality of locations, so that a coupling force between the upper panel 310 and the bottom frame 320 may be improved.

Of course, when the holder bracket 330, 340 is excessively provided, an assembly process may be difficult. Considering the above problem, it is preferable that the holder bracket 330, 340 includes two holder brackets and the holder brackets are respectively provided at least two edges of the bottom surface of the upper panel 310.

For example, the first holder bracket 330 may be located at an edge of the front end side of the bottom surface of the upper panel 310 and the second holder bracket 340 may be located at an edge of the rear end side thereof.

Specifically, the holder bracket 330, 340 may be attached and fixed to the upper panel 310. In other words, since the holder bracket 330, 340 or the bottom frame 320 is formed by injection, even when the holder bracket or the bottom frame is attached to the upper panel 310 by an adhesion 301, safely fixed state may be maintained.

For achieving the structure, as shown in FIGS. 19 and 21, the bottom surface of the holder bracket 330, 340 has a attaching groove 332, 342, and as shown in FIGS. 20 and 24, the adhesion 301 may be covered or adhere in the attaching groove 332, 342. Of course, the thickness of the adhesion 301 may be formed thicker than the depth of the attaching groove 332, 342.

Meanwhile, the first holder bracket 330 and the second holder bracket 340 may have different shapes.

When the two holder brackets 330 and 340 have the same shape, there may be a problem of difficulty in assembling the upper panel 310 to the bottom frame 320 or an increase of manufacturing cost. Considering the above problem, it may be preferable that any one of the holder brackets is configured to be simply hooked by the bottom frame 320 and another holder bracket is configured to be restricted by the bottom frame 320.

For example, as shown in accompanying FIGS. 19 and 20, the first holder bracket 330 may have the accommodating groove 331 to accommodate the supporting step 322*a* of the first edge wall 322 therein. Herein, the accommodating groove 331 is bent or stepped so that a rear end of the first holder bracket 330 is spaced apart from the upper panel 310. Of course, although not shown in the drawings, the accommodating groove 331 may be formed by recessing a part of a rear surface of the first holder bracket 330 forward.

For example, as shown in accompanying FIGS. 21 to 24, the second holder bracket 340 may include the hook 341 to hook by the holding step 323*a* of the second edge wall 323. Herein, the hook 341 may include a plurality of hooks, and may protrude downward from a rear end of the second holder bracket 340.

Next, according to the embodiment of the present disclosure as described above, an assembly process of the upper surface assembly 300 of the cabinet device will be described in detail.

First, the first holder bracket 330 is attached to the front end of edges of the bottom surface of the upper panel 310, and the second holder bracket 340 is attached to the rear end thereof.

Herein, the holder brackets 330 and 340 are respectively attached to the upper panel 310 after the adhesion 301 is covered to or adheres the attaching grooves 332 and 342 formed at opposite surfaces of the holder brackets 330 and 340 to the upper panel 310.

Then, the first holder bracket 330 attached to the upper panel 310 is located to face the first edge wall 322 of the bottom frame 320 and the second holder bracket 340 is located to face the second edge wall 323.

In the above described state, the supporting step 322*a* of the first edge wall 322 is inserted into the accommodating groove 331 of the first holder bracket 330 and then the rear end of the upper panel 310 moves downward to restrict the hook 341 of the second holder bracket 340 to the holding step 323*a* of the second edge wall 323. In other words, while the first holder bracket 330 is hung on the first edge wall 322 of the bottom frame 320, the second holder bracket 340 is coupled to the second edge wall 323 of the bottom frame 320 by leaning movement of the upper panel 310. The above described operation is the same as shown in FIGS. 25 and 26.

Therefore, the upper panel 310 may be fixed to the bottom frame 320 by the holder brackets 330 and 340.

Continuously, the upper surface assembly 300 is complete by assembling the assembly holders 350 on the bottom surface of the bottom frame 320. Herein, the assembly holders 350 may be installed to the bottom surface of the bottom frame 320 by various methods such as fit coupling, press-fit coupling, screwing, etc.

Next, a process of assembling the upper surface assembly 300 of the cabinet device according to the embodiment of the present disclosure to the inner casing 100 and the outer casing 200 will be described in detail.

First, the inner casing 100 is installed in the outer casing 200.

Herein, the upper ends of the two side walls 210 of the outer casing 200 are provided to protrude upward from the upper surface of the inner casing 100.

Then, after the upper surface assembly 300 is prepared, the upper surface assembly 300 is located at the upper side of the outer casing 200 and the inner casing 100. Herein, the upper surface assembly 300 is located with attention to the transversely and longitudinally directions.

Then, the assembly holders 350 of the upper surface assembly 300 are aligned and then inserted into the assembly grooves 120 on the upper surface of the inner casing 100. Herein, each of the assembly holders 350 is inserted into the large hole 121 with a relatively large diameter of each of the assembly grooves 120. Accordingly, the bottom surface of the upper surface assembly 300 (the bottom surface of the bottom frame) is brought into a state of being seated on the upper surface of the inner casing 100.

Then, the upper surface assembly 300 slidingly moves forward. Accordingly, the upper end of each of the assembly holders 350 is located in the small hole 122 with a relatively small diameter of the assembly groove 120, and thus the upper surface assembly 300 is prevented from being separated upward from the inner casing 100.

Then, the assembly of the cabinet device is finished as the door assembly 110 and the rear surface frame 230 are coupled to the cabinet device, respectively.

Consequently, the upper surface assembly 300 of the cabinet device of the present disclosure is made of glass at the outward exposed portion, so that improved design can be applied to the upper surface of the cabinet device. Specifically, although the upper panel 310 is made of glass, the upper panel 310 may be maintained in the stably coupled state to the bottom frame 320 by the holder bracket 330, 340.

Furthermore, the cabinet device of the present disclosure may be configured to be diversified in color as the glass upper panel 310 is covered with one color paint or a color film.

Furthermore, the cabinet device of the present disclosure is assembled while the upper surface assembly 300 is in contact with the upper surface of the inner casing 100, so that it is possible to prevent or minimize a gap between the upper surface assembly 300 and the upper surface of the inner casing 100.

Furthermore, while the upper surface assembly 300 of the cabinet device of the present disclosure is seated on and fixed to the upper surface of the inner casing 100, the opposite surfaces of the upper surface assembly 300 are covered by the two side walls 210 of the outer casing 200. Accordingly, the finishing treatment for the opposite surfaces of the upper surface assembly 300 is not required and the structure of the upper surface assembly 300 can be simplified, and thus manufacturing cost can be reduced. In addition, the upper surface assembly 300 is installed to the outer casing 200 in an embedded structure, so that it is possible to prevent aesthetic sensibility from being degraded.

Furthermore, the cabinet device of the present disclosure has the simple assembly structure between the holder bracket 330, 340 and the bottom frame 320, so that the upper panel 310 may be easily replaced even when the glass upper panel 310 is broken.

Meanwhile, among the coupling structures of the holder bracket 330, 340 and the bottom frame 320 the upper surface assembly 300 of the cabinet device of the present disclosure, the restricting structure may be formed differently from the structure of the above-described embodiment.

As another embodiment of the present disclosure, the holder bracket 330, 340 may be coupled to the bottom frame 320 by using a mounting holder 490.

The coupling structure will be described with reference to FIGS. 27 to 36.

FIGS. 27 and 28 are views showing a mounting hole and a moving prevention step that are formed in a second spacing wall of the bottom frame. FIGS. 29 and 30 are views showing the mounting hole and the moving prevention step formed on the second spacing wall.

In order to achieve application of the mounting holder 490, the bottom frame 320 may include a holder mounting part 440.

The holder mounting part 440 may include an avoidance part 441. The avoidance part 441 protrudes upward on the holder mounting part 440, and an avoidance groove 441*a* is provided on the opposite side of the avoidance part 441. Referring to FIG. 34, a grip portion 492' of the mounting holder 490, which will be described below, is seated into the avoidance groove 441*a*. In other words, the avoidance groove 441*a* may prevent the grip portion 492' from interfering with the second spacing wall 326.

A supporting step 442 may protrude on the holder mounting part 440. The supporting step 442 may be provided on one surface of the bottom frame 320, the surface facing a rear surface of the mounting holder 490. More specifically, the supporting step 442 may be arranged at a portion where the second spacing wall 326 and an upper surface of the bottom frame 320 are connected to each other. The supporting step 442 may protrudes toward the rear surface of the mounting holder 490 and serves to support the mounting holder 490, and prevents the mounting holder 490 from shaking in forward and rearward directions.

A supporting groove 443 is depressed from the supporting step 442. The supporting groove 443 may have a depressed structure at a lower portion of the supporting step 442. According to the embodiment, the supporting groove 443 is approximately shaped in a triangle, and into which a supporting protrusion (not shown) formed at the rear surface of the mounting holder 490 may be inserted. When the supporting protrusion is fitted into the supporting groove 443, in an elastically deformed process of the mounting holder 490, it is possible to prevent the mounting holder 490 from shaking sideways.

The holder mounting part 440 has a holder locking hole 445. The holder locking hole 445 is formed by vertically penetrating the holder mounting part 440. In the embodiment, the holder locking hole 445 may be formed in the second spacing wall 326. A part of the mounting holder 490 is inserted into the holder locking hole 445, and the inserted part of the mounting holder 490 is fitted into a the holder locking groove 343 (referring to FIGS. 35 and 36) of the second holder bracket 340. In other words, a part of the mounting holder 490 is inserted into the holder locking groove 343 while passing through the holder locking hole 445. Therefore, the second holder bracket 340 may be fixed to the bottom frame 320 at the second location.

With the holder locking hole 445 as the center, a moving prevention part 447 protrudes on the opposite portion to the supporting step 442. The moving prevention part 447 faces a front surface of the mounting holder 490. The moving prevention part 447 may prevent the mounting holder 490 from shaking in the forward and rearward directions together with the supporting step 442. The moving prevention part 447 may have the height equal to or higher than the supporting step 442 for breakage prevention.

FIGS. 31 and 32 show the structure of the mounting holder 490 in detail. Referring to the drawings, the mounting holder 490 may be made of synthetic resin or metal, and has the elastically deformable structure. The mounting holder 490 may be fitted into the holder locking hole 445 of the bottom frame 320 and the holder locking groove 343 of the second holder bracket 340 while being elastically deformed, and after fitting, may be recovered to the initial form to be maintained in the locked state. Then, the mounting holder 490 may be elastically deformed during disassembling.

The frame of the mounting holder 490 may consist of a holder body 491. The holder body 491 may have the thickness smaller than the vertical height and the transverse width. Herein, the holder body 491 has an elastic deformation part 495 so that the transverse width of the holder body 491 will vary.

The holder body 491 includes a handle 492 at a lower portion thereof. The handle 492 is a part that is gripped by a user to elastically deform the holder body 491. According to the embodiment, the handle 492 includes a pair of handles 492.

The pair of handles 492 is extended in directions away from the opposite sides of the holder body 491 with the elastic deformation part 495 located between the handles 492. The user can grip both the pair of handles 492 at the same time and apply a force in directions in which the handles 492 are close to each other. Then, the width of the elastic deformation part 495 is narrowed and thus a distance between a pair of coupling grooves 493*a* and 493*b* is reduced. Otherwise, the handle 492 may be provided only at any side of the left side or the right side.

The handle 492 may include the grip portion 492'. The grip portion 492' is extended from the handle 492 of the mounting holder 490 in a direction of enlarging the area of the handle 492. The grip portion 492' enlarges the area where the user can grip the handle. The grip portion 492' protrudes upward and, as shown in FIG. 34, the protruding portion may be seated in the avoidance groove 441*a* of the holder mounting part 440 described above.

The coupling grooves 493*a* and 493*b* are formed between the holder body 491 and the handles 492. The coupling grooves 493*a* and 493*b* have shapes that are recessed on opposite lower portions of the holder body 491 with the elastic deformation part 495 located between the coupling grooves 493*a* and 493*b*. The coupling grooves 493*a* and 493*b* are portions caught by an edge of the holder locking hole 445. When the coupling grooves 493*a* and 493*b* are caught by the edge of the holder locking hole 445, it is possible to prevent the mounting holder 490 from being removed in a separated direction. When the user elastically deforms the holder body 491 in the direction of reducing the width of the elastic deformation part 495, the distance between the pair of coupling grooves 493*a* and 493*b* is reduced shorter than the width of the holder locking hole 445 and then the mounting holder 490 may be separated from the holder locking hole 445.

The holder body 491 may include the elastic deformation part 495. The elastic deformation part 495 is formed by penetrating the holder body 491 in a direction perpendicular to a direction of the mounting holder 490 fitted into both the holder locking hole 445 and the holder locking groove 343, i.e. in the thickness direction. In other words, the elastic deformation part 495 has the form of penetrating the holder body 491 in the longitudinal direction.

The elastic deformation part 495 may provide a space in which the mounting holder 490 is elastically deformable. As shown in FIG. 32, the elastic deformation part 495 includes a first deformation part 495*a* and a second deformation part 495*b*. The first deformation part 495*a* is formed relatively higher than the second deformation part 495*b*, and the second deformation part 495*b* is formed relatively lower than the first deformation part 495*a*. The first deformation part 495*a* and the second deformation part 495*b* are connected to each other and may be considered as one continued space.

The first deformation part 495*a* has approximately a circular shape, and the second deformation part 495*b* has the width narrower than the first deformation part 495*a* and is extended downward. The second deformation part 495*b* is open toward the lower side of the holder body 491 to allow elastic deformation of the mounting holder 490 to be easily performed. Accordingly, when the mounting holder 490 is elastically deformed, the degree of deformation of the second deformation part 495*b* is greater than the degree of deformation of the first deformation part 495*a*, thereby sufficiently reducing the distance between the pair of coupling grooves 493*a* and 493*b* that are adjacent to the second deformation part 495*b*.

According to the embodiment, based on the transverse center portion of the mounting holder 490 (referring to dotted line in FIG. 32), the elastic deformation part 495 is formed at a location away from the center portion of the mounting holder 490. Based on the drawings, the elastic deformation part 495 is located close to the right handle 492 than the left handle 492, so that the mounting holder 490 has an asymmetrical structure. Accordingly, when the user pushes the right handle 492 leftward (in direction of arrow in FIG. 32), the width of the elastic deformation part 495 is reduced, and a left portion of the holder body 491 serves as a portion supporting the right handle 492.

Herein, a holder rib 491*a* is provided on a surface of the holder body 491. The holder rib 491*a* may be located at a location without the elastic deformation part 495 based on the center portion of the holder body 491. The holder rib 491 reinforces the strength of the mounting holder 490, and serves to reduce a clearance between the mounting holder 490 and an inner surface of the holder locking hole 445.

As shown in FIG. 33, a part of the mounting holder 490 is inserted into the holder locking groove 343 through the holder locking hole 445, and the coupling grooves 493*a* and 493*b*, i.e. a remaining part of the mounting holder 490, are caught and fixed to the edge of the holder locking hole 445. Based on the coupling grooves 493*a* and 493*b*, an upper portion of the mounting holder 490 is fitted into both the holder locking hole 445 and the holder locking groove 343 at the same time, and a lower portion of the mounting holder 490 is located below a lower surface edge 433.

FIGS. 33, 34, and 36 are views showing a part of the holder body 491 of the mounting holder 490 inserted into the holder locking groove 343 through the holder locking hole 445. As shown in the drawings, the upper portion of the holder body 491 is fitted into both the holder locking hole 445 and the holder locking groove 343 at the same time, and the handles 492 are limited in the degree of insertion into the mounting holder 490 by being caught at the lower portion of the holder locking hole 445.

Then, the second holder bracket 340 and the upper panel 310 are prevented from being separated in the forward direction away from the bottom frame 320 and also prevented from being separated in the leftward and rightward directions. The second holder bracket 340 and the upper panel 310 are separated from each other in an upward direction, but the first holder bracket 330 is caught by the bottom frame 320 at the first location, so that the second holder bracket 340 and the upper panel 310 are prevented from being separated in the upward direction. Consequently, the assembly of the upper panel 310 and the second holder bracket 340 may be maintained in the all directionally fixed state.

Furthermore, with the holder locking hole 445 as the center, the moving prevention part 447 is located opposite to the supporting step 442, so that the moving prevention part 447 prevents, with the supporting step 442, the mounting holder 490 from shaking upward and downward. Then, the supporting protrusion (not shown) provided at the rear surface of the mounting holder 490 is inserted into the supporting groove 443 of the supporting step 442, so that it is possible to prevent the mounting holder 490 from shaking leftward and rightward in the elastically deformed process of the mounting holder 490 and the mounted state of the mounting holder 490.

Meanwhile, a mounting hole 327 may be formed in a front end portion of the holder mounting part 440 of the bottom of the bottom frame 320.

The mounting hole 327 serve as a hole through which the mounting holder 490 passes when the mounting holder 490 is mounted to the holder mounting part 440 while the upper panel 310 is temporarily assembled to the bottom frame 320 by the holder bracket 330, 340 (e.g., coupling between the supporting step and the accommodating groove). As described above, the cabinet device of the present disclosure may be deformed into various shapes.

Hereinbelow, a third embodiment of the present disclosure will be described. According to the third embodiment, it is possible to replace a front panel 1110 constituting a front surface assembly 1100 of the appearance shape of the cabinet device. Specifically, hereinbelow, the front surface assembly 1100, for example, will be described as a door assembly 1100 serving as a door. For example, the structure of the mounting holder 490 is the same as the mounting holder 490 described in the previous embodiment, so the same reference numeral will be used to the mounting holder 490.

As shown in FIGS. 37 and 38, the cabinet device according to the embodiment of the present disclosure includes the inner casing (referring to '100' in FIG. 3), the outer casing 200, and the upper surface assembly 300, and the door assembly 1100 is installed at the front side of the outer casing 200. Otherwise, the cabinet device has the inner casing and the outer casing 200 are not provided independently of each other, but may be provided in one casing.

The outer casing 200 may include the two side walls 210 providing opposite side surfaces of the outer casing and the bottom part 220. Then, an open rear surface of the outer casing 200 may be closed by a rear surface plate 230. Although not shown in the drawings, the rear surface plate 230 may be coupled to rear surfaces of the two side walls 210.

The door assembly 1100 is installed at the front side of the outer casing 200. According to the embodiment, the door assembly 1100 is hinged to the outer casing 200, and the door assembly 1100 may serve to shield the storage space. Otherwise, the door assembly 1100 may be assembled to the outer casing 200 in a sliding manner.

A front surface of the door assembly 1100 may consist of the glass front panel 1110. Since the front panel 1110 is made of glass, the aesthetic sense of the cabinet device may be increased, but the glass front panel is heavy, so that it may be difficult to satisfy both the stable mounting and easy replacement. Hereinbelow, the replacement structure of the front panel 1110 will be described in priority.

As shown in FIG. 39, the view shows each part of the door assembly 1100 according to the embodiment in the exploded state. As shown in the drawings, the door assembly 1100 includes the front panel 1110 arranged at the front side thereof and a rear frame 1130 arranged the rear side thereof. Then, two brackets 1150 and 470 fixing the front panel 1110 to the rear frame 1130 are arranged between the front panel 1110 and the rear frame 1130.

Herein, the rear frame 1130 is maintained in a fixed state to the outer casing 200, and only the front panel 1110 is separated from the rear frame 1130. The rear frame 1130 may be directly hinged to the outer casing 200, but is coupled to a door frame (not shown), and the door frame may be hinged to the outer casing 200. Furthermore, although not shown in the drawings, a door liner may be provided at the rear side of the rear frame 1130.

The front panel 1110 may be covered with a color film. In other words, the front panel 1110 may have various colors as the film is attached thereto, and thus a request of the user for various colors may be satisfied. Herein, the film may be a film with general color or pattern or an opaque sheet, so that a structure or a form in the front panel 1110 are not seen through the film. In addition, the film may be formed with not only having various colors, but also having various pattern.

The film may be attached to a rear surface of the front panel 1110. Accordingly, it is possible to prevent the film from being unwillingly removed or from being damaged due to outward exposure. Of course, the front panel 1110 may be made of glass having a color itself, or may be covered with one color paint at a rear surface of the front panel 1110.

According to the embodiment, an edge surface 1115 of the front panel 1110 is rounded. When the edge surface, i.e., an edge of the front panel 1110 has a round structure, not an angular structure, it is possible to prevent injuries or abrasions to the user due to the glass front panel 1110 or breakage such as cracks of the glass front panel 1110. For example, the edge surface in the description means an outer edge surface, i.e., an edge surface located surrounding an edge of the front panel 1110.

Next, describing the rear frame 1130, the rear frame 1130 may serve as a body of the door assembly 1100. The rear frame 1130 may be formed by injection because the bottom frame 320 is a non-exposed portion.

As shown in FIG. 41, the rear frame 1130 has approximately a rectangular frame shape, and has an edge portion surrounding an edge thereof. The edge portion is formed in a direction of increasing a longitudinal thickness of the rear frame 1130, and includes an upper edge portion 1131, side edge portions 1132, and a lower edge portion 1133. Among the edge portions, the upper edge portion 1131 includes a fixing protrusion 1136, which will be described below, and the lower edge portion 1133 includes a holder mounting part 1140 to which the mounting holder 490 is mounted.

In the rear frame 1130, the center portion surrounded by the upper edge portion 1131, the side edge portions 1132, and the lower edge portion 1133 has a panel contact part 1135. The panel contact part 1135 may be a portion protruding in a direction toward the front panel 1110, i.e., forward. The panel contact part 1135 may reduce a distance between a front surface of the rear frame 1130 and a rear surface of the front panel 1110, or allow the front surface of the rear frame 1130 and the rear surface of the front panel 1110 to be in close contact with each other.

The panel contact part 1135 includes a reinforcing rib 1135'. The reinforcing rib 1135' is provided to prevent to twisting caused in molding as an injection, and as shown in FIG. 41, may have approximately a grid shape.

An installation part **1135*a* is provided between the edge of the rear frame 1130 and the panel contact part 1135. The installation part 1135*a* is provided between the upper, side, and lower edge portions 1131, 1132, and 1133 and the panel contact part 1135, and serves as a space relatively recessed rearward. The installation part 1135*a* may be formed by surrounding an edge of the panel contact part 1135**.

A fixing magnet (not shown) or a magnetic part (not shown) made of ferromagnetic metal may be installed at the installation part **1135*a*. Then, the magnetic part or the fixing magnet may be installed at a rear surface of the front panel 1110 facing the installation part 1135*a*. Accordingly, the front panel 1110 may be fixed to the rear frame 1130 by magnetic force. Of course, by a first bracket 1150 and a second bracket 1170, which will be described below, the front panel 1110 is fixed to the rear frame 1130, but the fixing magnet and the magnetic part are able to fix the front panel 1110 doubly. In other words, the fixing magnet and the magnetic part may refer to a kind of safety device, and may improve the stability of the door assembly 1100**.

The fixing protrusion 1136 is provided at the upper edge portion 1131. The fixing protrusion 1136 is protrudes on the upper edge portion 1131 toward the lower edge portion 1133. The fixing protrusion 1136 is fitted into a fixing groove 1151 of the first bracket 1150, which will be described below. When the fixing protrusion 1136 is fitted into the fixing groove 1151 of the first bracket 1150, the first bracket 1150 may be fixed to the first location of the rear frame 1130.

Herein, the first location means a location where the first bracket 1150 is fixed to the rear frame 1130. Then, the second location means a location where the second bracket 1170, which will be described, is fixed to the rear frame 1130. According to the embodiment, the first location is an upper edge of the rear frame 1130 and the second location is a lower edge of the rear frame 1130. Of course, unlike the embodiment, the first location and the second location may be left and right edges of the rear frame 1130, respectively.

The fixing protrusion 1136 may include a plurality of fixing protrusions 1136 along the upper edge portion 1131. The fixing protrusion 1136 have a transverse length longer than a protruding length thereof toward the lower edge portion 1133. In a process where the front panel 1110 is coupled to the rear frame 1130, the fixing protrusion 1136 may be naturally fitted into the fixing groove 1151 of the first bracket 1150.

The rear frame 1130 includes a liner coupling hole 1138. The liner coupling hole 1138 may be formed by penetrating the rear frame 1130. The liner coupling hole 1138 is provided to assemble the door liner (not shown), which is arranged at the rear side of the rear frame 1130, to the rear frame 1130. The liner coupling hole 1138 is arranged in the installation part **1135*a*, and a plurality of coupling holes 1138 may be arranged along the installation part 1135*a*** to be spaced apart from each other.

The rear frame 1130 includes the holder mounting part 1140. The holder mounting part 1140 is arranged at the second location of the rear frame 1130, and is a portion to which the mounting holder 490 is mounted. The second bracket 1170 coupled to a rear surface of the front panel 1110 is arranged at the holder mounting part 1140, and when the mounting holder 490 is fitted into the holder mounting part 1140, the second bracket 1170 may be fixed to the holder mounting part 1140.

Referring to the structure of the holder mounting part 1140 referring to FIGS. 42 and 43, the holder mounting part 1140 is provided on the lower edge portion 1133. The holder mounting part 1140 may be a part of the lower edge portion 1133. The holder mounting part 1140 protrudes in a direction from the lower edge portion 1133 toward the center portion of the rear frame 1130, i.e., a direction toward the upper edge portion 1131. Accordingly, the holder mounting part 1140 is arranged an inner portion of the rear frame 1130, thus being prevented from being exposed outward.

The holder mounting part 1140 includes avoidance portions 1141. The avoidance portions 1141 is arranged at opposite side portions of the holder mounting part 1140 with a holder locking hole 1145, into which the second bracket 1170 is inserted, located between the avoidance portions 1141. The avoidance portions 1141 protrude upward on the holder mounting part 1140 and the avoidance grooves 1141*a* are provided at the opposite sides of avoidance portions 1141. Referring to FIG. 57, the grip portion 492' of the mounting holder 490, which will be described below, is seated into each of the avoidance grooves 1141*a*. In other words, each of the avoidance grooves 1141*a* may prevent the grip portion 492' from interfering with the lower edge portion 1133.

A supporting step 1142 protrudes on the holder mounting part 1140. The supporting step 1142 may be provided on one surface of the rear frame 1130, the surface facing a rear surface of the mounting holder 490. More specifically, the supporting step 1142 may be arranged at a portion where the lower edge portion 1133 and the installation part 1135*a* are connected to each other. The supporting step 1142 may protrudes toward the rear surface of the mounting holder 490 and serves to support the mounting holder 490, and prevents the mounting holder 490 from shaking in forward and rearward directions.

A supporting groove 1143 is depressed from the supporting step 1142. The supporting groove 1143 may have a depressed structure at a lower portion of the supporting step 1142. According to the embodiment, the supporting groove 1143 is approximately shaped in a triangle, and into which a supporting protrusion (not shown) formed at the rear surface of the mounting holder 490 may be inserted. When the supporting protrusion is fitted into the supporting groove 1143, in an elastically deformed process of the mounting holder 490, it is possible to prevent the mounting holder 490 from shaking sideways.

The holder mounting part 1140 has a holder locking hole 1145. The holder locking hole 1145 is formed by vertically penetrating the holder mounting part 1140. In the embodiment, the holder locking hole 1145 may be formed in the lower edge portion 1133. A part of the mounting holder 490 is inserted into the holder locking hole 1145, and the inserted part is fitted into a the holder locking groove 1173 of the second bracket 1170. In other words, the part of the mounting holder 490 is fitted into the holder locking groove 1173 through the holder locking hole 1145. Therefore, the second bracket 1170 may be fixed to the rear frame 1130 at the second location.

With the holder locking hole 1145 as the center, a moving prevention part 1147 protrudes on the opposite portion to the supporting step 1142. The moving prevention part 1147 faces a front surface of the mounting holder 490. The moving prevention part 1147 may prevent the mounting holder 490 from shaking in the forward and rearward directions together with the supporting step 1142. The moving prevention part 1147 may have the height equal to or higher than the supporting step 1142 for breakage prevention.

Next, referring to the first bracket 1150, the first bracket 1150 is coupled to a rear surface of the front panel 1110, and is caught and fixed to the rear frame 1130 at the first location. The front panel 1110 may be fixed to the rear frame 1130 at the first location with the first bracket 1150 as a medium. According to the embodiment, the first bracket 1150 is fixed to an upper edge of the front panel 1110.

Referring to FIG. 50, the first bracket 1150 is lengthily extended in the transverse direction, and made of synthetic resin or metal. A protruding body 1152 is provided at an upper portion of the first bracket 1150, and a part of the protruding body 1152 is recessed to form the fixing groove 1151. The fixing groove 1151 is formed at an upper portion of a front surface of the first bracket 1150, the portion being attached to the front panel 1110, and the fixing groove 1151 is open forward. Therefore, the fixing groove 1151 may be formed between the rear surface of the front panel 1110 and the first bracket 1150.

As shown in FIG. 48, the fixing groove 1151 is formed between the first bracket 1150 and the front panel 1110. The fixing groove 1151 is open upward, i.e., toward the edge surface 1115 of the front panel 1110. Accordingly, when the assembly of the front panel 1110 and the first bracket 1150 are pushed in a bottom to top direction, the fixing protrusion 1136 of the rear frame 1130 may be fitted into the fixing groove 1151. The above structure will be shown in FIG. 51.

The front surface of the first bracket 1150 may serve as an adhesion surface and be attached to the rear surface of the front panel 1110. FIGS. 49 and 51 are views showing an adhesion portion K provided between the front surface of the first bracket 1150 and the rear surface of the front panel 1110. In order to increase the adhesion force, the front surface of the first bracket 1150 is preferably formed in a connected single flat surface.

As shown in FIG. 50, the fixing groove 1151 includes a plurality of reinforcing ribs 1155, and a movement prevention protrusion 1159. When the first bracket 1150 is caught by the rear frame 1130 at the first location, the movement prevention protrusion 1159 prevents the first bracket 1150 from shaking in the transverse direction. The movement prevention protrusion 1159 interferes with a movement prevention rib 1139 provided at a front surface of the rear frame 1130, thereby preventing the first bracket 1150 from shaking in the transverse direction.

The second bracket 1170 is coupled to a location of the front panel 1110, the location being spaced apart from the first bracket 1150. Referring to FIG. 50, the second bracket 1170 is lengthily extended in the transverse direction, and made of synthetic resin or metal. Like the first bracket 1150, the second bracket 1170 serves to fix the front panel 1110 to the rear frame 1130. The second bracket 1170 is coupled to a lower portion of the rear surface of the front panel 1110. According to the embodiment, the second bracket 1170 is arranged in parallel to the first bracket 1150. The second bracket 1170 fixes the front panel 1110 to the second location of the rear frame 1130.

According to the embodiment, the first bracket 1150 is fixed to the first location by the fixing protrusion 1136 and the fixing groove 1151, and the second bracket 1170 may be fixed to the rear frame 1130 by the mounting holder 490. In other words, before the mounting holder 490 is fitted into the second bracket 1170, the second bracket 1170 may be separated from the rear frame 1130.

As shown in FIGS. 52 and 54, the second bracket 1170 includes a bracket body 1171 extended lengthily in the transverse direction, and the bracket body 1171 includes a holder locking part 1172. The holder locking part 1172 serves to fix the mounting holder 490, and the holder locking part 1172 includes the holder locking groove 1173. The holder locking groove 1173 is open in one direction and through which a part of the mounting holder 490 is fitted. A front surface of the bracket body 1171 shown in FIG. 52 is a portion attached to the rear surface of the front panel 1110.

The holder locking groove 1173 is connected to the holder locking hole 1145 of the rear frame 1130. For this structure, the holder locking part 1172 may include the same number of holder locking parts 1172 as the number of holder mounting parts 1140 and be located at the same locations as the number of holder mounting parts. Therefore, the mounting holder 490 may be respectively inserted into the holder locking hole 1145 of the rear frame 1130 and the holder locking groove 1173 of the second bracket 1170 that are connected to each other. More specifically, a part of the mounting holder 490 passes through the holder locking hole 1145 and then is inserted into the holder locking groove 1173. Then, the handles 492, i.e., a remaining part of the mounting holder 490, may be limited in the degree of insertion by being caught by the circumference of the holder locking hole 1145.

When the second bracket 1170 is coupled to a second front panel 1110 at the second location of the front panel 1110, the holder locking groove 1173 may be open at an entrance in the opposite direction of the first bracket 1150. In other words, according to the embodiment, the holder locking groove 1173 is open downward. This structure is shown in FIG. 49. The reference numeral K in FIG. 49 is a portion the rear surface of the front panel 1110 and the front surface of the second bracket 1170 are attached to each other.

The second bracket 1170 includes a coupling tool insertion groove 1175. The coupling tool insertion groove 1175 is a portion of preventing a part of a screw coupled to for assembly between the rear frame 1130 and the door liner from interfering with the second bracket 1170. Therefore, the coupling tool insertion groove 1175 may be provided at a location corresponding to the liner coupling hole 1138.

The second bracket 1170 includes bracket reinforcing portions 1176. The bracket reinforcing portions 1176 are provided at a rear surface of the second bracket 1170, i.e., a portion opposite to a front surface of the second bracket 1170 attached to the front panel 1110. According to the embodiment, the bracket reinforcing portions 1176 are extended in the transverse direction in parallel at upper and lower portions of the rear surface of the second bracket 1170. The bracket reinforcing portions 1176 may serve to prevent the second bracket 1170 from being bent or damaged in the manufacturing process of the second bracket 1170 the assembly process between the second bracket 1170 and the rear frame 1130.

The second bracket 1170 may include a hook 1177. The hook 1177 may be caught by a step (not shown) of the rear frame 1130. Herein, the hook 1177 may include a plurality of hooks, and the plurality hooks may be formed by protruding downward from a rear end of the second bracket 1170. Herein, the mounting holder 490 fixes the second bracket 1170 and the rear frame 1130 to each other, so that the hook 1177 may be omitted.

The second bracket 1170 may include shielding covers 1179 at opposite left and right ends thereof. The shielding covers 1179 may protrude on the left and right ends of the second bracket 1170, and shield the hooks 1177 arranged at inner portions of the second bracket 1170 or the holder locking groove 1173, and reduce a distance between the second bracket 1170 and the rear frame 1130.

Meanwhile, referring to FIGS. 44 to 47, the edge surface 1115 of the front panel 1110 may protrude outward than edges of the first bracket 1150 and the second bracket 1170. The reference numeral G is a degree to which the edge surface 1115 of the front panel 1110 protrudes outward than the first bracket 1150 and an edge surface of the second bracket 1170. Accordingly, a portion where the front panel 1110 is exposed forward may be increased, and the front panel 1110 is made of glass, so that the esthetic sense of the door assembly 1100 may be increased.

The second bracket 1170 may be fixed to the rear frame 1130 by the mounting holder 490. The mounting holder 490 is fitted into both the rear frame 1130 and the second bracket 1170 and may fix the second bracket 1170 to the second location of the rear frame 1130. More specifically, the mounting holder 490 is inserted into both the holder locking hole 1145 of the rear frame 1130 and the holder locking groove 1173 of the second bracket 1170 that are connected to each other. Herein, the mounting holder 490 may be fitted into each of a plurality of holder mounting parts 1140 and each of a plurality of the holder locking grooves 1173. According to the embodiment, total four mounting holders 490 are provided to assemble the second bracket 1170 and the rear frame 1130 to each other.

FIGS. 56 to 59 are views showing the mounting holder 490 and the mounting structure of the mounting holder 490 in detail. For example, the structure of the mounting holder 490 will be described with reference to FIGS. 31 and 32 described in the previous embodiment.

The mounting holder 490 may be made of synthetic resin or metal, and has the elastically deformable structure. The mounting holder 490 may be fitted into the holder locking hole 1145 of the rear frame 1130 and the holder locking groove 1173 of the second bracket 1170 while being elastically deformed, and after fitting, may be recovered to the initial form to be maintained in the locked state. Then, the mounting holder 490 may be elastically deformed during disassembling.

The frame of the mounting holder 490 may consist of a holder body 491. The holder body 491 may have the thickness smaller than the vertical height and the transverse width. Herein, the holder body 491 has an elastic deformation part 495 so that the transverse width of the holder body 491 will vary.

The handles 492 are provided at a lower portion of the holder body 491, and the coupling grooves 493*a* and 493*b* are provided between the holder body 491 and the handles 492. The handle 492 is a part that is gripped by a user to elastically deform the holder body 491. According to the embodiment, the handle 492 includes a pair of handles 492.

The pair of handles 492 is extended in directions away from the opposite sides of the holder body 491 with the elastic deformation part 495 located between the handles 492. The user can grip both the pair of handles 492 at the same time and apply a force in directions in which the handles 492 are close to each other. Then, the width of the elastic deformation part 495 is narrowed and thus a distance between the pair of coupling grooves 493*a* and 493*b* is reduced. Otherwise, the handle 492 may be provided only at any side of the left side or the right side.

The handle 492 may include the grip portion 492'. The grip portion 492' is extended from the handle 492 of the mounting holder 490 in a direction of enlarging the area of the handle 492. The grip portion 492' enlarges the area where the user can grip the handle. The grip portion 492' protrudes upward and, as shown in FIG. 57, the protruding portion may be seated in the avoidance groove 1141*a* of the holder mounting part 1140 described above.

The coupling grooves 493*a* and 493*b* are formed between the holder body 491 and the handles 492. The coupling grooves 493*a* and 493*b* have shapes that are recessed on opposite lower portions of the holder body 491 with the elastic deformation part 495 located between the coupling grooves 493*a* and 493*b*. The coupling grooves 493*a* and 493*b* are portions caught by an edge of the holder locking hole 1145. When the coupling grooves 493*a* and 493*b* are caught by the edge of the holder locking hole 1145, it is possible to prevent the mounting holder 490 from being removed in a separated direction. When the user elastically deforms the holder body 491 in the direction of reducing the width of the elastic deformation part 495, the distance between the pair of coupling grooves 493*a* and 493*b* is reduced shorter than the width of the holder locking hole 1145 and then the mounting holder 490 may be separated from the holder locking hole 1145.

The holder body 491 may include the elastic deformation part 495. The elastic deformation part 495 is formed by penetrating the holder body 491 in a direction perpendicular to a direction of the mounting holder 490 fitted into both the holder locking hole 1145 and the holder locking groove 1173, i.e. in the thickness direction. In other words, the elastic deformation part 495 has the form of penetrating the holder body 491 in the longitudinal direction.

The elastic deformation part 495 may provide a space in which the mounting holder 490 is elastically deformable. As shown in FIG. 32, the elastic deformation part 495 includes a first deformation part 495*a* and a second deformation part 495*b*. The first deformation part 495*a* is formed relatively higher than the second deformation part 495*b*, and the second deformation part 495*b* is formed relatively lower than the first deformation part 495*a*. The first deformation part 495*a* and the second deformation part 495*b* are connected to each other and may be considered as one continued space.

The first deformation part 495*a* has approximately a circular shape, and the second deformation part 495*b* has the width narrower than the first deformation part 495*a* and is extended downward. The second deformation part 495*b* is open toward the lower side of the holder body 491 to allow elastic deformation of the mounting holder 490 to be easily performed. Accordingly, when the mounting holder 490 is elastically deformed, the degree of deformation of the second deformation part 495*b* is greater than the degree of deformation of the first deformation part 495*a*, thereby sufficiently reducing the distance between the pair of coupling grooves 493*a* and 493*b* that are adjacent to the second deformation part 495*b*.

According to the embodiment, based on the transverse center portion of the mounting holder 490 (referring to dotted line in FIG. 32), the elastic deformation part 495 is formed at a location away from the center portion of the mounting holder 490. Based on the drawings, the elastic deformation part 495 is located close to the right handle 492 than the left handle 492, so that the mounting holder 490 has an asymmetrical structure. Accordingly, when the user pushes the right handle 492 leftward (in direction of arrow in FIG. 32), the width of the elastic deformation part 495 is reduced, and a left portion of the holder body 491 serves as a portion supporting the right handle 492.

Herein, a holder rib 491*a* is provided on a surface of the holder body 491. The holder rib 491*a* may be located at a location without the elastic deformation part 495 based on the center portion of the holder body 491. The holder rib 491 reinforces the strength of the mounting holder 490, and serves to reduce a clearance between the mounting holder 490 and the inner surface of the holder locking hole 1145.

As shown in FIGS. 56 and 57, a part of the mounting holder 490 is inserted into the holder locking groove 1173 through the holder locking hole 1145 (referring to FIG. 42), and the coupling grooves 493*a* and 493*b*, i.e. a remaining part of the mounting holder 490, are caught and fixed to the edge of the holder locking hole 1145. Based on the coupling grooves 493*a* and 493*b*, an upper portion of the mounting holder 490 is fitted into both the holder locking hole 1145 and the holder locking groove 1173 at the same time, and the lower portion of the mounting holder 490 is located below a lower surface edge 1133.

FIG. 59 is a view showing a part of the holder body 491 of the mounting holder 490 inserted into the holder locking groove 1173 through the holder locking hole 1145. As shown in the drawings, the upper portion of the holder body 491 is fitted into both the holder locking hole 1145 and the holder groove 1173 at the same time, and the handles 492 are limited in the degree of insertion into the mounting holder 490 by being caught at the lower portion of the holder locking hole 1145.

Then, the second bracket 1170 and the front panel 1110 are prevented from being separated in the forward direction away from the rear frame 1130 and also prevented from being separated in the leftward and rightward directions. The second bracket 1170 and the front panel 1110 may be separated from each other in a direction toward the upper edge portion 1131, i.e., upward, but since the first bracket 1150 is caught by the rear frame 1130 at the first location, the second bracket 1170 and the front panel 1110 may not be separated from each other even upward. Consequently, the assembly of the front panel 1110 and the second bracket 1170 may be maintained in the all directionally fixed state.

Furthermore, with the holder mounting hole 1145 as the center, the moving prevention part 1147 is located opposite to the supporting step 1142, so that the moving prevention part 1147 prevents, with the supporting step 1142, the mounting holder 490 from shaking in the longitudinal direction. Then, the supporting protrusion (not shown) provided at the rear surface of the mounting holder 490 is inserted into the supporting groove 1143 of the supporting step 1142, so that it is possible to prevent the mounting holder 490 from shaking leftward and rightward in the elastically deformed process of the mounting holder 490 and the mounted state of the mounting holder 490.

Next, an assembly process of the door assembly 1100 of the cabinet device according to the present disclosure will be described.

First, both the first bracket 1150 and the second bracket 1170 are attached to the rear surface of the front panel 1110. Both the first bracket 1150 and the second bracket 1170 may be fixed to the rear surface of the front panel 1110 by using an adhesive such as a double-sided adhesive tape, etc. Herein, the first bracket 1150 and the second bracket 1170 are arranged to be spaced apart from each other, and the first bracket 1150 is coupled to an upper portion of the rear surface of the front panel 1110, and the second bracket 1170 is coupled to a lower portion thereof.

In this state, the first bracket 1150 may assemble the front panel 1110 to the rear frame 1130 while facing the upper edge portion 1131 of the rear frame 1130. As shown in FIG. 55, when the front panel 1110 is assembled to the rear frame 1130 while being leaned, in this process, the fixing protrusion 1136 of the rear frame 1130 may be fitted into the fixing groove 1151 of the first bracket 1150. Then, the lower portion of the front panel 1110 may be rotated so as to stack the front panel 1110 on the rear frame 1130.

FIG. 51 shows the first bracket 1150 in a fixed state to the rear frame 1130. When the fixing protrusion 1136 of the rear frame 1130 is fitted into the fixing groove 1151 of the first bracket 1150, the front panel 1110 is fixed to the rear frame 1130 at the first location.

Herein, the second bracket 1170 coupled to the front panel 1110 is seated on the lower edge portion 1133, i.e., an edge of the rear frame 1130, so that the front panel 1110 is prevented from being separated from or falling from the rear frame 1130 and maintaining the temporarily assembled state even when the mounting holder 490 is coupled thereto.

Meanwhile, the holder locking hole 1145 of the rear frame 1130 and the holder locking groove 1173 of the second bracket 1170 are connected to each other. Herein, the connection means that the holder locking hole 1145 of the rear frame 1130 and the holder locking groove 1173 of the second bracket 1170 form a connected space. Then, the mounting holder 490 may be inserted into both the holder locking hole 1145 of the rear frame 1130 and the holder locking groove 1173 of the second bracket 1170, which are connected to each other.

The user can elastically deform the mounting holder 490 in the direction of narrowing the elastic deformation part 495 while gripping the grip portion 492' of the mounting holder 490. Referring to FIG. 32, when the user pushes the right handle 492 leftward (direction of arrow in FIG. 32), the width of the elastic deformation part 495 is reduced, and thus the width of the elastic deformation part 495 is reduced, so that the distance between the pair of coupling grooves 493*a* and 493*b* may be reduced.

When the mounting holder 490 is inserted into the holder locking hole 1145 while being elastically deformed, a part of the upper portion of the mounting holder 490 may be fitted into the holder locking groove 1173 through the holder locking hole 1145. In this state, the user removes a force applied to the grip portion 492', the mounting holder 490 is recovered to the initial form and the distance between the coupling grooves 493*a* and 493*b* is recovered.

Then, the pair of coupling grooves 493*a* and 493*b* are respectively fitted into the circumference of the holder locking hole 1145, so that the mounting holder 490 is prevented from being separated. Simultaneously, the grip portion 492' of the mounting holder 490 is seated on each of the avoidance grooves 1141*a*, and the grip portion 492' is prevented from interfering with the lower edge portion 1133.

When the mounting holder 490 is assembled, the second bracket 1170 and the front panel 1110 are prevented from being separated in the forward direction away from the rear frame 1130 and also prevented from being separated in the leftward and rightward directions. The second bracket 1170 and the front panel 1110 may be separated from each other in a direction toward the upper edge portion 1131, i.e., upward, but since the first bracket 1150 is caught by the rear frame 1130 at the first location, the second bracket 1170 and the front panel 1110 may not be separated from each other even upward. Consequently, the assembly of the front panel 1110 and the second bracket 1170 may be maintained in the all directionally fixed state.

Furthermore, since the first bracket 1150 is in a fixed state to the rear frame 1130 at the first location, the front panel 1110 may be securely fixed to the rear frame 1130. Specifically, the door assembly 1100 according to the embodiment is applied to the appliance with a door repeatedly opening and closing, such as furniture, as well as refrigerators, Styler® (clothing treatment system), dishwashers, etc., the two brackets 1150 and 470 may stably fix the front panel 1110 to the rear frame 1130.

On the other hand, in replacing the front panel 1110, the mounting holder 490 is separated from the holder locking hole 1145 to separate the front panel 1110 from the second location, and the fixing groove 1151 is separated from the fixing protrusion 1136, whereby the front panel 1110 may be separated from the rear frame 1130. Therefore, the front panel 1110 is securely fixed to the rear frame 1130 using not only the two brackets 1150 and 470 but also the mounting holder 490 that is attached and detached, so that the front panel 1110 may be easily separated.

Meanwhile, the door liner is assembled to the rear frame 1130, and the assembling of the rear frame 1130 and the door liner may be performed prior to assembling of the front panel 1110. Then, an insulation part may be foamed between the rear frame 1130 and the door liner, and the insulation part may be provided at the door liner itself prior to the assembly of the rear frame 1130 and the door liner.

In the previous embodiment, in the surface assembly, the front panel 1110 of the door assembly 1100 constituting the front surface of the cabinet device is replaceable. However, in the surface assembly, the present disclosure may be applied to replace a side panel (not shown) or a rear panel (not shown), not the front surface. For example, a side panel assembly or a rear panel assembly may include a surface panel arranged at the outside, and a rear frame arranged at the rear side of the surface panel. Then, the surface panel is fixed to the rear frame by a structure of the first bracket 1150, the second bracket 1170, and the mounting holder 490, which are described above, and the surface panel may be separated from the rear frame.

Although the above description is merely illustrative of the technical idea of the present disclosure, the present disclosure may be variously modified and deformed by one of ordinary skill in the art to which the invention present disclosure belongs without departing from the scope and spirit of the present disclosure. Therefore, the embodiments disclosed in the present disclosure are intended to describe, not to limit the technical idea of the present disclosure, and the scope of the technical idea of the present disclosure is not limited to the embodiments. The protective scope of the present disclosure should be interpreted by the accompanying claims, and technical ideas within an equivalent scope may be interpreted as being included in the protective scope of the present disclosure.

The invention claimed is:

1. A cabinet device comprising:

an inner casing to form an inner body of the cabinet device, the inner casing including a first inner side wall, a second inner side wall, a top inner wall and a bottom inner wall, and the inner casing is configured to provide a storage space;

an outer casing to form part of an outer body of the cabinet device, the outer casing including a first outer side wall adjacent to the first inner side wall and a second outer side wall adjacent to the second inner side wall; and an upper surface assembly disposed between an upper end of the first outer side wall and an upper end of the second outer side wall, and the upper surface assembly to provide an upper surface of the cabinet device, wherein the upper surface assembly comprises:

an upper panel that provides an upper surface of the upper surface assembly;

a bottom frame that provides a bottom surface of the upper surface assembly, and the bottom frame is coupled to an upper surface of the top inner wall of the inner casing;

a first holder bracket attached to at least a bottom surface of the upper panel and to the bottom frame; and a second holder bracket attached to the upper panel, and the second holder bracket is removably coupled to the bottom frame, wherein the bottom frame includes:

a first edge wall at a front end of an upper surface of the bottom frame, a second edge wall at a rear end of the upper surface of the bottom frame, and a first protruding support that protrudes from an inside surface of one of the first and second edge walls of the bottom frame, and wherein one of the first and second holder brackets has an accommodating groove, and the accommodating groove is configured to accommodate the first protruding support and prevent movement of the upper panel relative to the bottom frame.

2. The cabinet device of claim 1, wherein the first holder bracket has a first attachment groove that faces the upper panel, and a first adhesive is disposed between the first attachment groove and the bottom surface of the upper panel, the second holder bracket has a second attachment groove that faces the upper panel, and a second adhesive is disposed between the second attachment groove and the bottom surface of the upper panel.

3. The cabinet device of claim 1, wherein said accommodating groove is at an end of the one of the first and second holder brackets and is spaced apart from the upper panel.

4. The cabinet device of claim 1, wherein the bottom frame includes a second protruding support that protrudes from an inside surface of another one of the first and second edge walls of the bottom frame, and wherein another one of the first and second holder brackets includes a hook that protrudes downward from an end of the another one of the first and second holder brackets, and the hook is configured to hook the second protruding support and to restrain upward movement of the upper panel relative to the bottom frame.

5. The cabinet device of claim 1, wherein the upper surface of the bottom frame has a spacing wall that is spaced apart from another one of the first and second edge walls, the spacing wall has at least one mounting hole configured to have a mounting holder pass therethrough, and another one of the first and second holder brackets has a holder locking groove configured to restrain movement of the mounting holder.

6. The cabinet device of claim 5, wherein the bottom frame includes a frame mounting hole that penetrates a portion of the bottom frame adjacent to the spacing wall, and the frame mounting hole is configured to support the mounting holder, and wherein the spacing wall includes a moving prevention wall configured to prevent the mounting holder from vertically moving.

7. The cabinet device of claim 1, wherein an assembly groove is formed in the top inner wall of the inner casing and is open to an upper surface of the top inner wall, and an assembly holder is provided on a bottom of the bottom frame, and is configured to mount to the assembly groove.

8. A cabinet device comprising:

a casing body configured to provide a storage space; and a door assembly configured to couple to the casing body, wherein the door assembly comprises:

a front panel configured to constitute a front surface of the door assembly;

a rear frame disposed at a rear of the front panel;

a first bracket coupled to an upper end of the front panel, and mounted to a first portion of the rear frame;

a second bracket spaced apart from the first bracket and coupled to a lower end of the front panel, and arranged at a second portion of the rear frame; and a mounting holder fitted to the rear frame and to the second bracket so as to attach the second bracket to the second portion of the rear frame, wherein the rear frame includes a fixing protrusion that protrudes from the first portion of the rear frame, and a fixing groove is disposed between a rear surface of the front panel and the first bracket such that the fixing protrusion is fitted into the fixing groove.

9. The cabinet device of claim 8, wherein the rear frame includes a locking hole to receive the mounting holder, and the second bracket has a locking groove to receive the mounting holder.

10. The cabinet device of claim 9, wherein a first part of the mounting holder is inserted into the locking groove of the second bracket through the locking hole of the rear frame, and a second part of the mounting holder is attached to an inner surface of the locking hole.

11. The cabinet device of claim 10, wherein the mounting holder includes:

first and second coupling grooves to engage with the inside surface of the locking hole, and an elastic deformation structure provided between the first coupling groove and the second coupling groove, and is configured to vary a distance between the first coupling groove and the second coupling groove.

12. The cabinet device of claim 9, wherein the locking groove is open at an entrance in a direction from the first bracket.

13. The cabinet device of claim 8, wherein the first bracket has the fixing groove at an end of the first bracket and spaced apart from the front panel to receive the fixing protrusion.

14. The cabinet device of claim 9, wherein the mounting holder comprises:

a holder body having an elastic deformation structure;

a first coupling groove provided at a first side of the holder body, a second coupling groove provided at a second side of the holder body which is opposite to the first side, and the elastic deformation structure is disposed between the first coupling groove and the second coupling groove;

a first handle that extends from the first coupling groove; and a second handle that extends from the second coupling groove in an opposite direction with the elastic deformation structure disposed between the first handle and the second handle, wherein when the holder body is elastically deformed in a direction in which the elastic deformation structure is narrowed, a distance between the first coupling groove and the second coupling groove becomes shorter than a width of the locking hole.

15. The cabinet device of claim 14, wherein the elastic deformation structure comprises:

a first deformation structure formed by penetrating the holder body in a thickness direction of the holder body; and a second deformation structure connected to the first deformation structure, and open toward a lower portion of the holder body, wherein the first deformation structure has a transverse width larger than a transverse width of the second deformation structure.

16. The cabinet device of claim 14, wherein the mounting holder includes a grip handle formed in a direction in which the handle is increased in area, and the rear frame has an avoidance groove to receive the grip handle.

17. A cabinet device comprising:

an inner casing to form an inner body of the cabinet device;

an outer casing to form part of an outer body of the cabinet device, the outer casing including a first outer side wall and a second outer side wall; and an upper assembly disposed between the first outer side wall and the second outer side wall, and the upper assembly to provide an upper surface of the cabinet device, wherein the upper assembly comprises:

an upper panel that provides an upper surface of the upper assembly;

a bottom frame coupled to the inner casing, the bottom frame including a first edge wall having a first protrusion, and a second edge having a second protrusion;

a first holder bracket having a first surface attached to the upper panel and having a first groove to receive the first protrusion; and a second holder bracket having a second surface attached to the upper panel, and having a hook configured to be removably coupled to the second protrusion so as to restrain upward movement of the upper panel relative to the bottom frame when the hook is coupled to the second protrusion.

18. The cabinet device of claim 17, comprising a front assembly arranged at a front of the cabinet device, the front assembly comprising:

a front panel configured to constitute a front surface of the front assembly;

a rear frame disposed at a rear of the front panel;

a first bracket coupled to an upper edge of the front panel, and mounted to the rear frame;

a second bracket spaced apart from the first bracket and coupled to a lower edge of the front panel, and arranged at the rear frame; and a mounting holder fitted to the rear frame and to the second bracket.

19. The cabinet device of claim 18, wherein the mounting holder comprises:

a holder body having an elastic deformation structure;

a first coupling groove provided at a first side of the holder body, a second coupling groove provided at a second side of the holder, and the elastic deformation structure is disposed between the first coupling groove and the second coupling groove;

a first handle that extends from the first side of the holder body; and a second handle that extends from the second side of the holder body, wherein the rear frame includes a locking hole to receive the mounting holder, wherein when the holder body is elastically deformed in a direction in which the elastic deformation structure is narrowed, a distance between the first coupling groove and the second coupling groove becomes shorter than a width of a locking hole of the rear frame.

* * * * *